US010060308B2

(12) United States Patent
Cui et al.

(10) Patent No.: US 10,060,308 B2
(45) Date of Patent: Aug. 28, 2018

(54) MODULARIZED MULTIFUNCTIONAL VARIABLE VALVE ACTUATION SYSTEM FOR USE IN 6-CYLINDER INTERNAL COMBUSTION ENGINE

(71) Applicant: Dalian University of Technology, Dalian (CN)

(72) Inventors: Jingchen Cui, Dalian (CN); Wuqiang Long, Dalian (CN); Jiangping Tian, Dalian (CN); Hua Tian, Dalian (CN); Tianhao Yang, Dalian (CN); Danting Wang, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 143 days.

(21) Appl. No.: 15/108,582

(22) PCT Filed: Mar. 10, 2014

(86) PCT No.: PCT/CN2014/000225
§ 371 (c)(1),
(2) Date: Oct. 1, 2016

(87) PCT Pub. No.: WO2015/096184
PCT Pub. Date: Jul. 2, 2015

(65) Prior Publication Data

US 2017/0009618 A1 Jan. 12, 2017

(30) Foreign Application Priority Data

Dec. 28, 2013 (CN) ..... 2013 1 0738155

(51) Int. Cl.
*F01L 13/06* (2006.01)
*F01L 1/047* (2006.01)
(Continued)

(52) U.S. Cl.
CPC ..... *F01L 13/06* (2013.01); *F01L 1/047* (2013.01); *F01L 1/3442* (2013.01); *F01L 9/025* (2013.01); *F01L 13/065* (2013.01); *F02B 75/18* (2013.01); *F01L 2001/34426* (2013.01); *F01L 2820/03* (2013.01); *F01L 2820/033* (2013.01); *F01L 2820/034* (2013.01); *F02B 2075/1824* (2013.01)

(58) Field of Classification Search
CPC ..... F01L 13/06; F01L 1/047; F01L 1/3442; F01L 9/025; F01L 13/065; F02B 2075/1824
USPC ..... 123/321, 90.12, 90.13, 90.15
See application file for complete search history.

(56) References Cited

U.S. PATENT DOCUMENTS 5,615,653 A * 4/1997 Faletti ..... F01L 13/06 123/322
2004/0094104 A1* 5/2004 Cuadro ..... F01L 9/02 123/90.12

(Continued)

*Primary Examiner* — Mahmoud Gimie
(74) *Attorney, Agent, or Firm* — Matthias Scholl, PC; Matthias Scholl

(57) ABSTRACT

A modularized multifunctional variable valve actuation system for use in a six-cylinder internal combustion engine. The system includes two fuel supply modules that cooperate with two two-way two-position valves for implementing a continuously variable valve event, and that cooperate with two three-way two-position valves and one two-way two-position valve for implementing a fully variable valve event.

10 Claims, 18 Drawing Sheets

(51) Int. Cl.

| | |
|---|---|
| ***F01L 9/02*** | (2006.01) |
| ***F01L 1/344*** | (2006.01) |
| ***F02B 75/18*** | (2006.01) |

(56) References Cited

U.S. PATENT DOCUMENTS

| | | | | |
|---|---|---|---|---|
| 2004/0187842 | A1* | 9/2004 | Yang | F01L 1/08<br>123/322 |
| 2005/0005886 | A1* | 1/2005 | Jiang | F01L 1/022<br>123/90.17 |
| 2011/0184630 | A1* | 7/2011 | Kang | F01L 9/02<br>701/105 |

* cited by examiner

MODULARIZED MULTIFUNCTIONAL VARIABLE VALVE ACTUATION SYSTEM FOR USE IN 6-CYLINDER INTERNAL COMBUSTION ENGINE

CROSS-REFERENCE TO RELATED APPLICATIONS

This application is a National Stage Appl. filed under 35 USC 371 of International Patent Application No. PCT/CN2014/000225 with an international filing date of Mar. 10, 2014, designating the United States, now pending, and further claims priority benefits to Chinese Patent Application No. 201310738155.0 filed Dec. 28, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

FIELD OF THE INVENTION

The present disclosure relates to a variable valve actuation system of internal combustion engines, and more particularly to a modularized multifunctional variable valve actuation system of six-cylinder internal combustion engines.

BACKGROUND OF THE INVENTION

With the rapid development of world economy, energy and environmental problems have adversely affected the sustainable development of economy. Internal combustion engines are widely used, consume a large amount of gasoline and produce many harmful exhaust gases and particles. Therefore, it is urgent to develop internal combustion engines that have lower emissions and consume less energy.

Variable valve technology has attracted widespread attention of internal combustion engine research institutes and enterprises, as it improves the performance of internal combustion engines.

In addition, with the rapid increase of the number of internal combustion engines worldwide, losses in properties and people's lives due to traffic accidents grow year by year. Therefore, people are more and more concerned about vehicle safety and more and more countries list the auxiliary braking system as one of essential accessories of vehicles. However, at present, most auxiliary braking systems, e.g. eddy current retardant module and hydraulic retardant module, exhibit problems during operation.

For instance, brake parts overheat easily, the brake efficiency diminishes quickly, the controllability of braking ability is low, the vehicle tends to deviate while braking, and the brake system occupies too much space.

An auxiliary braking system could potentially solve all these problems.

Among current auxiliary braking systems of engines, the brake efficiency of a 720° C.A/cycle compression release engine brake system is the highest, but this system also has problems with brake power. Hence, it is urgent to develop a set of variable valve actuation system which can satisfy both 720° C.A/cycle actuation mode and 360° C.A/cycle compressor brake mode of an internal combustion engine.

At present, most practical variable valve actuation systems are equipped with distribution cams, have mechanical structures and are mainly divided into: 1) camshaft phase adjusting type, e.g. VVT system of TOYOTA and Vanos system of BMW; 2) staged variable valve lift type, e.g. VTEC system of Honda; 3) continuously variable valve lift type, e.g. Valvetronic system of BMW and CVVL system of Hyundai. These systems adjust the opening/closing timing and/or the maximum valve lift in each cylinder valve of an internal combustion engine.

Compared with cam-based variable valve actuation systems, cam-less systems can realize more flexible valve movements. Meanwhile, the structure of the cam-less systems is complicated, the cost is high and the reliability, durability and thermal expansion compensation control, etc. leave much to be desired. Cam-less systems can mainly be divided into electromagnetic type and electro-hydraulic type. Electro-hydraulic systems leave much to be desired in terms of movement accuracy control and valve lift adjustability. In contrast to electromagnetic systems, electro-hydraulic systems have higher valve flexibility, higher power density and higher layout flexibility, etc., and are the highest potential variable valve actuation systems. The electro-hydraulic systems mainly include common rail oil supply type and cam oil supply type.

Common rail oil supply systems are not equipped with distribution cams and adjust the opening/closing timing and maximum valve lift by controlling the open/close state of the electromagnetic valve and the actuation oil in the energy storage. Ford and Lucas, and others, conducted a study, but further studies are needed regarding cost, response speed, occupied space, etc.

With the increase of the cylinder number, single cylinder valve numbers and speeds of internal combustion engines, common rail oil supply systems still have the following defects: 1) the volume of common rail tube is high and the space layout is difficult; 2) too many electromagnetic valves with high speed and large flow rate are applied in the system, and materials and technical processes of electromagnetic valves decide their high cost. Therefore, the overall cost of the common rail oil supply systems is high. Therefore, also, it is more difficult to utilize traditional common rail oil supply electro-hydraulic variable valve actuators.

Through the combination of advantages of both mechanical and common rail oil supply systems, cam oil supply systems attract the wide attention of researchers and manufacturers, e.g. Multiair system of Fiat and VCM system of ABB. Such systems are equipped with a cam-plunger oil supply device instead of energy storage, occupy a smaller space and can synchronously adjust the opening/closing timing and valve lift. However, improvement is still required with regard to the following two aspects: first, the system needs more oil feeders and electromagnetic valves and its overall cost is high; second, the adjustable operating range of a valve affects the limit of oil supply and control devices, so it can neither realize the independent adjustment among the opening/closing timing and valve lift nor the 360° C.A/cycle valve operation process required by the auxiliary braking mode of an internal combustion engine.

To solve these problems of cam oil supply systems, a cam oil supply electro-hydraulic valve actuation system has been developed. This system adopts the cam-plunger oil supply pattern, the common rail pipe is removed, and few oil feeders are employed, which is favorable to the layout of the system space. However, such a system still has the following problems: 1) the system has too many electromagnetic valves and its cost is high; 2) the adjustable range of its valve actuator is restricted to the oil supply rate of its cam-plunger oil feeder; it is impossible to open the exhaust valve secondarily and change the 720° C.A/cycle mode of an internal combustion engine to the 360° C.A/cycle compressor brake mode, which restricts the extension of its functions.

To solve problems of cam oil supply electro-hydraulic valve actuation systems, a dual-mode fully variable valve actuation system has been developed. Through the use of drive-brake circulator and mode converter, this system has less electromagnetic valves, is driven by the internal combustion engine, and has the variable valve corresponding to the brake mode thereof. However, the dual-mode fully variable valve actuation system still has several defects: 1) as the two-position five-way valve of this system needs to the switched under the different pressure differences of each oil port and the pressure difference change of each oil port is extremely complicated, with the speed increase, the response time of the two-position five-way valve shall be shorter to ensure higher flow rate. Therefore, the two-position five-way valve has complicated structure and the processing cost thereof is high; 2) under the drive mode of the internal combustion engine, this system cannot close the valve when the oil feeder is working, which restricts the performance improvement of this system at idle or at the medium and low speed. While idling or the medium and low speed are common running conditions for urban vehicles, and the operation of the internal combustion engine under these running conditions basically decides the actual oil consumption and emission of the vehicles; 3) the structure of the drive-brake circulator is complicated, more external oil pipes are required, the system manufacturability is low, the production cost is high and its structural layout is difficult; 4) functions of various components of the system are mutually reliable, and the overall layout of the system and many components need to be changed according to different application requirements, which restricts the application range of the system.

To solve the defects of the cam oil supply electro-hydraulic valve actuation system and the dual mode fully variable valve actuation system, an intensive multifunctional variable valve actuation system has been developed in recent years, the electromagnetic valve structure is simplified and the valve can be closed under the drive mode of the internal combustion engine when the oil feeder supplies oil. However, this system still has the following two defects: 1) the cycle selector structure is complicated, more oil pipes are required, the system manufacturability is lower, its cost is higher and its layout is more different; 2) functions of various components of the system are mutually dependent, and the overall layout of the system and many components need to be changed according to different application requirements, which restricts the application scope of the system.

SUMMARY OF THE INVENTION

The purposes of the present disclosure include: 1) by means of introducing phase limit modules, a few of oil supply modules and electromagnetic valves, as well as simple electromagnetic valves, are combined to achieve the function of a variable valve required in the drive and brake mode of an internal combustion engine, so as to combine the variable valve technology and auxiliary braking technology of the internal combustion engine, simplify the system to a large extent, and lower the cost; 2) simplifying structures of key components of the system, e.g. phase limit module, reducing the quantity of external oil pipes, optimizing the manufacturability of components and lowering the cost; 3) adopting the modularized design method to make functions of all parts of the system independent, so as to select components of the system according to the practical requirements, instead of changing components and the layout of the system, thus intensifying the adaptability of the system to engine types, extending the application scope of the system, and improving the acceptance of the system in the market.

To achieve the above objective, in accordance with one embodiment of the invention, there is provided a modularized multifunctional variable valve actuation system for six-cylinder internal combustion engine. The system mainly comprises a valve actuation module 1, a first oil supply module 6, a second oil supply module 5, an oil delivery module 7, an oil tank 8, an oil drain valve 9 and oil pipe; it also comprises a phase limit module 2, a mode selection module 22, a first control module 3 and a second control module 4. The first oil supply module 6 and the second oil supply module 5 are cam-plunger oil supply modules with the camshaft angle with the phase difference of 180°, and its rotation period is double the ignition interval angle of the internal combustion engine, i.e. 240° crank angle. The first control module 3 comprises the first oil supply port 3*a*, the oil drain port 3*b*, the 1 drive port 3*c* and the oil delivery port 3*d* of the first control module. The second control module 4 comprises the first oil supply port 4*a*, the oil drain port 4*b*, the first drive port 4*c* and the oil delivery port 4*d* of the second control module. The oil delivery module 7 comprises the second oil delivery port 7*a*, the oil drain port 7*b*, the first oil delivery port 7*c* and oil inlet 7*d* of the oil delivery module. The phase limit module 2 comprises the second oil supply port 2*a*, the first oil supply port 2*b*, the second oil supply port 2*d*, the first drive port 2*e*, the second drive port 2*f*, the third drive port 2*g*, the fourth drive port 2*h*, the fifth drive port 2*i* and the sixth drive port 2*j* of the phase limit module. The oil drain port 7*b* and oil inlet 7*d* of the oil delivery module, the oil drain port 3*b* of the first control module and the oil drain port 4*b* of the second control module all connect to the oil tank 8, the second oil delivery port 7*a* of the oil delivery module connects with the oil delivery port of the second control module 4*d*, the first oil delivery port 7*c* of the oil delivery module connects with the oil delivery port 3*d* of the first control module, the first oil supply port 3*a* of the first control module connects with the first oil supply module 6 of the first oil supply port 3*a*, the first oil supply port 4*a* of the second control module connects with the second oil supply module 5, the first drive port 3*c* of the first control module connects with the first oil supply port 2*b* of the phase limit module, the first drive port 4*c* of The second control module connects with the second oil supply port 2*a* of the phase limit module. Besides, the fully variable valve actuation system of the non-independent oil drain valve further comprises an oil drain valve 9, and the phase limit module 2 further comprises a first oil drain port 2*c* of the phase limit module. The first oil drain port 2*c* of the phase limit module connects with the oil inlet of oil drain valve 9*b*. The oil outlet 9*a* of the oil drain valve connects with the oil tank 8. Without the brake mode, the first drive port 2*e*, the second drive port 2*f*, the third drive port 2*g*, the fourth drive port 2*h*, the fifth drive port 2*i* and the sixth drive port 2*j* of the phase limit module connect to valve actuation modules of one-cylinder, six-cylinder, two-cylinder, five-cylinder, three-cylinder and four-cylinder respectively, and both connect to the oil tank 8 and the second oil drain port 2*d* of the phase limit module respectively. With the brake mode, the mode selection module 22 is added, the mode selection module 22 comprises the first oil supply port 22*a*, the second oil supply port 22*b*, the third oil supply port 22*c*, the fourth oil supply port 22*d*, the fifth oil supply port 22*e* and the sixth oil supply port 22*f* of the mode selection module, and the six ports connect to the first drive port 2*e*, the second drive port 2*f*, the third drive port 2*g*, the fourth drive port 2*h*, the fifth drive port 2*i* and the sixth drive port 2*j* of the phase limit module respectively. In addition, the mode selection module 22 comprises the first drive port 22*g*, the second drive port 22*h*, the third drive port 22*i*, the fourth drive port 22*j*, the fifth drive port 22*k* and the sixth drive port 22*m* of the mode selection module, and they connect to valve actuation modules of one-cylinder, six-cylinder, five-cylinder, three-cylinder and four-cylinder respectively. Besides, the mode selection module 22 comprises the oil control inlet 22*r* and oil control outlet 22*s* of the mode selection module, and both connect to the second oil drain port 2*d* and oil tank 8 of the phase limit module. For the valve actuation system of an internal combustion engine with the cylinder number as an integral multiple of 6, every 6 cylinders are classified into a group at the crank angle of 120° according to the ignition sequence and each group is equipped with a set of the variable valve actuation system.

For the fully variable valve actuation system of a continuously variable or independent oil drain valve controlled on the valve side, the first control module 3 further comprises a fifth drive port 3*k*. The sixth drive port 3*m* and the seventh drive port 3*n* of the first control module. The fifth drive port 3*k* of the first control module connects with the oil path between the first drive port 2*e* of the phase limit module and the first oil supply port 22*a* of the mode selection module or the oil path between the first drive port 22*g* of the mode selection module and the valve actuation module of one-cylinder. The sixth drive port 3*m* of the first control module connects with the oil path between the third drive port 2*g* of the phase limit module and the third oil supply port 22*c* of the mode selection module or the oil path between the third drive port 22*i* of the mode selection module and the valve actuation module of two-cylinder. The seventh drive port 3*n* of the first control module connects with the oil path between the fifth drive port 2*i* of the phase limit module and the fifth oil supply port 22*e* of the mode selection module or the oil path between the fifth drive port 22*k* of the mode selection module and the valve actuation module of three-cylinder. The second control module 4 further comprises a fifth drive port 4*k* of the second control module, the sixth drive port 4*m* of the second control module and the seventh drive port 4*n* of the second control module. The fifth drive port 4*k* of the second control module connects with the oil path between the second drive port 2*f* of the phase limit module and the second oil supply port 22*b* of the mode selection module or the oil path between the second drive port 22*h* of the mode selection module and the valve actuation module of six-cylinder. The sixth drive port 4*m* of the second control module connects with the oil path between the fourth drive port 2*h* of the phase limit module and the fourth oil supply port 22*d* of the mode selection module or the oil path between the fourth drive port 22*j* of the mode selection module and the valve actuation module of five-cylinder. The seventh drive port 4*n* of the second control module connects with the oil path between the sixth drive port 2*j* of the phase limit module and the sixth oil supply port 22*f* of the mode selection module or the oil path between the sixth drive port 22*m* of the mode selection module and the valve actuation module of four-cylinder.

For the fully variable valve actuation system controlled on the valve side, the first control module 3 further comprises a second oil supply port 3*e*, the third oil supply port 3*f* and the fourth oil supply port 3*g* of the first control module, as well as the second drive port 3*h*, the third drive port 3*i* and the fourth drive port 3*j* of the first control module. The second oil supply port 3*e* of the first control module and the second drive port 3*h* of the first control module respectively connect to the first drive port 2*e* of the phase limit module and the first oil supply port 22*a* or the first drive port 22*g* of the mode selection module and the valve actuation module of one-cylinder. The third oil supply port 3*f* of the first control module and the third drive port 3*i* of the first control module respectively connect to the third drive port 2*g* of the phase limit module and the third oil supply port 22*c* of the mode selection module or the third drive port 22*i* of the mode selection module and the valve actuation module of two-cylinder. The fourth oil supply port 3*g* of the first control module and the fourth drive port 3*j* of the first control module respectively connect to the fifth drive port 2*i* of the phase limit module and the fifth oil supply port 22*e* of the mode selection module or the fifth drive port 22*k* of the mode selection module and the valve actuation module of three-cylinder. The second control module 4 further comprises a second oil supply port 4*e*, the third oil supply port 4*f*, the fourth oil supply port 4*g*, the second drive port 4*h*, the third drive port 4*i* and the fourth drive port 4*j* of the second control module. The second oil supply port 4*e* and the second drive port 4*h* of the second control module respectively connect to the second drive port 2*f* of the phase limit module and the second oil supply port 22*b* of the mode selection module or the second drive port 22*h* of the mode selection module and the valve actuation module of six-cylinder. The third oil supply port 4*f* and the third drive port 4*i* of the second control module respectively connect to the fourth drive port 2*h* of the phase limit module and the fourth oil supply port 22*d* of the mode selection module or the fourth drive port 22*j* of the mode selection module and the valve actuation module of five-cylinder. The fourth oil supply port 4*g* and the fourth drive port 4*j* of the second control module respectively connect to the sixth drive port 2*j* of the phase limit module and the sixth oil supply port 22*f* of the mode selection module or the sixth drive port 22*m* of the mode selection module and the valve actuation module of four-cylinder.

For the fully variable valve actuation system of the independent oil drain valve controlled on the valve side, the phase limit module 2 and the mode selection module 22 can be cancelled. The first oil supply port 3*a*, the first drive port 3*c*, the second oil supply port 3*e*, the third oil supply port 3*f* and the fourth oil supply port 3*g* of the first control module all connect to the first oil supply module 6. The second drive port 3*h* and the fifth drive port 3*k* of the first control module both connect to the valve actuation module of one-cylinder, the third drive port 3*i* and the sixth drive port 3*m* of the first control module both connect to the valve actuation module of two-cylinder, and the fourth drive port 3*j* of the control module and the seventh drive port 3*n* of the first control module both connect to the valve actuation module of three-cylinder. The first oil supply port 4*a*, the first drive port 4*c*, the second oil supply port 4*e*, the third oil supply port 4*f* and the fourth oil supply port 4*g* of the second control module all connect to the second oil supply module 5, the second drive port 4*h* and the fifth drive port 4*k* of the second control module both connect to the valve actuation module of six-cylinder, the third drive port 4*i* and the sixth drive port 4*m* of the second control module both connect to the valve actuation module of five-cylinder, and the fourth drive port 4*j* and the seventh drive port 4*n* of the second control module both connect to the valve actuation module of four-cylinder.

For the continuously variable valve actuation system, the oil delivery module 7, comprising oil delivery pump 10, safety valve 11 of the oil delivery pump, the first oil delivery check valve 12 and the second oil delivery check valve 13. The oil inlet of oil delivery pump 10*a* connects with the oil inlet of oil delivery module 7*d*, the oil outlet 11*a* of the safety valve of the oil delivery pump connects with the oil drain port 7*b* of the oil delivery module, the oil outlet 12*b* of the first oil delivery check valve connects with the first oil delivery port 7*c* of the oil delivery module, the oil outlet 13*b* of the second oil delivery check valve connects with the second oil delivery port 7*a* of the oil delivery module, and the oil outlet 10*b* of the delivery pump, the oil inlet 11*b* of the safety valve of the oil delivery pump, the oil inlet 12*a* of the first oil delivery check valve and the oil inlet 13*a* of the second oil delivery check valve connect to each other. For the fully variable valve actuation system, the oil delivery module 7 comprises the oil delivery pump 10, the safety valve 11 of the oil delivery pump, the oil delivery check valve 16 and the system safety valve 17. The oil inlet of oil delivery pump 10*a* connects with the oil inlet of oil delivery module 7*d*. The oil outlet 10*b* of the delivery pump, the oil inlet 11*b* of the safety valve of the oil delivery pump and the oil inlet 16*a* of the oil delivery check valve connect to each other. The oil outlet 11*a* of the safety valve of the oil delivery pump, the oil outlet 17*a* of the system safety valve and the oil drain port 7*b* of the oil delivery module are connected to each other. The oil outlet 16*b* of the oil delivery check valve, the oil outlet 17*b* of the system safety valve, the second oil delivery port 7*a* of the oil delivery module and the first oil delivery port 7*c* of the oil delivery module are connected to each other.

For the continuously variable valve actuation system controlled on the oil supply side, the first control module 3 comprises the first two-position two-way valve 14. The oil outlet 14*a* of the first two-position two-way valve connects with the oil drain port 3*b* of the first control module. The oil inlet 14*b* of the first two-position two-way valve, the first oil supply port 3*a* of the first control module, the first drive port 3*c* of the first control module and the oil delivery port 3*d* of the first control module are connected to each other. For the continuously variable valve actuation system controlled on the valve side, the first control module 3 comprises the 1-1 two-position two-way valve 141, the 1-2 two-position two-way valve 142 and the 1-3 two-position two-way valve 143. The first oil supply port 3*a* of the first control module, the first drive port 3*c* of the first control module and the oil delivery port 3*d* of the first control module are connected to each other. The oil outlet 141*a* of the 1-1 two-position two-way valve, the oil outlet 142*a* of the 1-2 two-position two-way valve, the oil outlet 143*a* of the 1-3 two-position two-way valve and the oil drain port 3*b* of the first control module are connected to each other. Oil inlet of the 1-1 two-position two-way valve 141*b* connects with the fifth drive port 3*k* of the first control module, the oil inlet 142*b* of the 1-2 two-position two-way valve connects with the sixth drive port 3*m* of the first control module. The oil inlet 143*b* of the 1-3 two-position two-way valve connects with the seventh drive port 3*n* of the first control module. For the non-independent fully variable valve actuation system controlled on the oil supply side, the first control module 3 comprises the first check valve 18 and the first two-position three-way valve 19. The oil inlet 18*a* of the first check valve connects with the oil drain port 3*b* of the first control module. The oil supply port 19*a* of the first two-position three-way valve connects with the first oil supply port 3*a* of the first control module. The oil delivery port 19*b* of the first two-position three-way valve connects with the oil delivery port 3*d* of the first control module. The drive port 19*c* of the first two-position three-way valve connects with the first drive port 3*c* of the first control module. The oil outlet 18*b* of the first check valve connects with the oil supply port 19*a* of the first two-position three-way valve or the drive port 19*c* of the first two-position three-way valve. For the fully variable valve actuation system of the non-independent oil drain valve controlled on the valve side, the first control module 3 comprises the first check valve 18, the 1-1 two-position three-way valve 191, the 1-2 two-position three-way valve 192 and the 1-3 two-position three-way valve 193. The oil inlet 18*a* of the first check valve connects with the oil drain port 3*b* of the first control module. The oil outlet 18*b* of the first check valve, the first oil supply port 3*a* of the first control module and the first drive port 3*c* of the first control module are connected to each other. The oil delivery port 191*b* of the 1-1 two-position three-way valve, the oil delivery port 192*b* of the 1-2 two-position three-way valve, the oil delivery port 193*b* of the 1-3 two-position three-way valve and the oil delivery port 3*d* of the first control module are connected to each other. Oil supply port of the 1-1 two-position three-way valve 191*a* connects with the second oil supply port 3*e* of the first control module, oil supply port of the 1-2 two-position three-way valve 192*a* connects with the third oil supply port 3*f* of the first control module. Oil supply port of the 1-3 two-position three-way valve 193*a* connects with the fourth oil supply port 3*g* of the first control module, drive port of the 1-1 two-position three-way valve 191*c* connects with the second drive port 3*h* of the first control module, drive port of the 1-2 two-position three-way valve 192*c* connects with the third drive port 3*i* of the first control module, and drive port of the 1-3 two-position three-way valve 193*c* connects with the fourth drive port 3*j* of the first control module. For the fully variable valve actuation system of the independent oil drain valve controlled on the oil supply side, the first control module 3 comprises the first check valve 18, the first two-position three-way valve 19, the first oil drain valve 91, the second oil drain valve 92 and the third oil drain valve 93. The oil supply port 19*a* of the first two-position three-way valve connects with the first oil supply port 3*a* of the first control module, the oil delivery port 19*b* of the first two-position three-way valve connects with the oil delivery port 3*d* of the first control module, and the drive port 19*c* of the first two-position three-way valve connects with the first drive port 3*c* of the first control module. The oil outlet 91*a* of the first oil drain valve, the oil outlet 92*a* of the second oil drain valve, the oil outlet 93*a* of the third oil drain valve, the oil inlet 18*a* of the first check valve and the oil drain port 3*b* of the first control module are connected to each other. The oil inlet 91*b* of the first oil drain valve connects with the fifth drive port 3*k* of the first control module, the oil inlet 92*b* of the second oil drain valve connects with the sixth drive port 3*m* of the first control module, the oil inlet 93*b* of the third oil drain valve connects with the seventh drive port 3*n* of the first control module, the oil outlet 18*b* of the first check valve connects with the oil supply port 19*a* of the first two-position three-way valve or the drive port 19*c* of the first two-position three-way valve. For the fully variable valve actuation system of the independent oil drain valve controlled on the valve side, the first control module 3 comprises the first check valve 18, the 1-1 two-position three-way valve 191, the 1-2 two-position three-way valve 192, the 1-3 two-position three-way valve 193, the first oil drain valve 91, the second oil drain valve 92 and the third oil drain valve 93. The oil outlet 18*b* of the first check valve, the first oil supply port 3*a* of the first control module and the first drive port 3*c* of the first control module are connected to each other. The oil delivery port 191*b* of the 1-1 two-position three-way valve, the oil delivery port 192*b* of the 1-2 two-position three-way valve, the oil delivery port 193*b* of the 1-3 two-position three-way valve and the oil delivery port 3*d* of the first control module are connected to each other. Oil supply port of the 1-1 two-position three-way valve 191*a* connects with the second oil supply port 3*e* of the first control module, oil supply port of the 1-2 two-position three-way valve 192*a* connects with the third oil supply port 3*f* of the first control module, and oil supply port of the 1-3 two-position three-way valve 193*a* connects with the fourth oil supply port 3*g* of the first control module. Drive port of the 1-1 two-position three-way valve 191*c* connects with the second drive port 3*h* of the first control module, drive port of the 1-2 two-position three-way valve 192*c* connects with the third drive port 3*i* of the first control module, and drive port of the 1-3 two-position three-way valve 193*c* connects with the fourth drive port 3*j* of the first control module. The oil outlet 91*a* of the first oil drain valve, the oil outlet 92*a* of the second oil drain valve, the oil outlet 93*a* of the third oil drain valve, the oil inlet 18*a* of the first check valve and the oil drain port 3*b* of the first control module are connected to each other. The oil inlet 91*b* of the first oil drain valve connects with the fifth drive port 3*k* of the first control module, the oil inlet 92*b* of the second oil drain valve connects with the sixth drive port 3*m* of the first control module, and the oil inlet 93*b* of the third oil drain valve connects with the seventh drive port 3*n* of the first control module.

For the continuously variable valve actuation system controlled on the oil supply side, the second control module 4 comprises the a second two-position two-way valve 15. The oil outlet 15*a* of the second two-position two-way valve connects with the oil drain port 4*b* of the second control module. The oil inlet 15*b* of the second two-position two-way valve, the first oil supply port 4*a* of the second control module, the first drive port 4*c* of the second control module and the oil delivery port 4*d* of the second control module are connected to each other. For the continuously variable valve actuation system controlled on the valve side, the second control module 4 comprises the 2-1 two-position two-way valve 151, the 2-2 two-position two-way valve 152 and the 2-3 two-position two-way valve 153. The first oil supply port 4*a* of the second control module, the first drive port 4*c* of the second control module and the oil delivery port 4*d* of the second control module are connected to each other. The oil outlet 151*a* of the 2-1 two-position two-way valve, oil outlet 152*a* of the 2-2 two-position two-way valve, oil outlet 153*a* of the 2-3 two-position two-way valve and the oil drain port 4*b* of the second control module are connected to each other. Oil inlet of the 2-1 two-position two-way valve 151*b* connects with the fifth drive port 4*k* of the second control module, the oil inlet 152*b* of the 2-2 two-position two-way valve connects with the sixth drive port 4*m* of the second control module, and the oil inlet 153*b* of the 2-3 two-position two-way valve connects with the seventh drive port 4*n* of the second control module. For the fully variable valve actuation system of the non-independent oil drain valve controlled on the oil supply side, the second control module 4 comprises the second check valve 20 and the a second two-position three-way valve 21. The oil inlet 20*a* of the second check valve connects with the oil drain port 4*b* of the second control module, the oil supply port 21*a* of the second two-position three-way valve connects with the first oil supply port 4*a* of the 2nd control module, and the oil delivery port 21*b* of the second two-position three-way valve connects with the oil delivery port 4*d* of the second control module. The drive port 21*c* of the second two-position three-way valve connects with the first drive port 4*c* of the second control module, and the oil outlet 20*b* of the second check valve connects with the oil supply port 21*a* of the second two-position three-way valve or the drive port 21*c* of the second two-position three-way valve. For the fully variable valve actuation system of the non-independent oil drain valve on the valve side, the second control module 4 comprises the second check valve 20, the 2-1 two-position three-way valve 211, the 2-2 two-position three-way valve 212 and the 2-3 two-position three-way valve 213. The oil inlet 20*a* of the second check valve connects with the oil drain port 4*b* of the second control module. The oil outlet 20*b* of the second check valve, the first oil supply port 4*a* of the second control module and the first drive port 4*c* of the second control module are connected to each other. The oil delivery port 211*b* of the 2-1 two-position three-way valve, the oil delivery port 212*b* of the 2-2 two-position three-way valve, the oil delivery port 213*b* of the 2-3 two-position three-way valve and the oil delivery port 4*d* of the second control module are connected to each other. The oil supply port 211*a* of the 2-1 two-position three-way valve connects with the second oil supply port 4*e* of the second control module, the oil supply port 212*a* of the 2-2 two-position three-way valve connects with the third oil supply port 4*f* of the second control module, and the oil supply port 213*a* of the 2-3 two-position three-way valve connects with the fourth oil supply port 4*g* of the second control module. The drive port 211*c* of the 2-1 two-position three-way valve connects with the second drive port 4*h* of the second control module, the drive port 212*c* of the 2-2 two-position three-way valve connects with the third drive port 4*i* of the second control module, and the drive port 213*c* of the 2-3 two-position three-way valve connects with the fourth drive port 4*j* of the second control module. For the fully variable valve actuation system of the independent oil drain valve controlled on the oil supply side, the second control module 4 comprises the second check valve 20, the a second two-position three-way valve 21, the fourth oil drain valve 94, the fifth oil drain valve 95 and the sixth oil drain valve 96. The oil supply port 21*a* of the second two-position three-way valve connects with the first oil supply port 4*a* of the second control module, the oil delivery port 21*b* of the second two-position three-way valve connects with the oil delivery port 4*d* of the second control module, and the drive port 21*c* of the second two-position three-way valve connects with the first drive port 4*c* of the second control module. The oil outlet 94*a* of the fourth oil drain valve, the oil outlet 95*a* of the fifth oil drain valve, the oil outlet 96*a* of the sixth oil drain valve, the oil inlet 20*a* of the second check valve and the oil drain port 4*b* of the second control module are connected to each other. The oil inlet 94*b* of the fourth oil drain valve connects with the fifth drive port 4*k* of the second control module, the oil inlet 95*b* of the fifth oil drain valve connects with the sixth drive port 4*m* of the second control module, and the oil inlet 96*b* of the sixth oil drain valve connects with the seventh drive port 4*n* of the second control module. The oil outlet 20*b* of the second check valve connects with the oil supply port 21*a* of the second two-position three-way valve or the drive port 21*c* of the second two-position three-way valve. For the fully variable valve actuation system of the independent oil drain valve controlled on the valve side, the second control module 4 comprises the second check valve 20, the 2-1 two-position three-way valve 211, the 2-2 two-position three-way valve 212, the 2-3 two-position three-way valve 213, the fourth oil drain valve 94, the fifth oil drain valve 95 and the sixth oil drain valve 96. The oil outlet 20*b* of the second check valve, the first oil supply port 4*a* of the second control module and the first drive port 4*c* of the second control module are connected to each other. The oil delivery port 211*b* of the 2-1 two-position three-way valve, the oil delivery port 212*b* of the 2-2 two-position three-way valve, the oil delivery port 213*b* of the 2-3 two-position three-way valve and the oil delivery port 4*d* of the second control module are connected to each other. The oil supply port 211*a* of the 2-1 two-position three-way valve connects with the second oil supply port 4*e* of the second control module, the oil supply port 212*a* of the 2-2 two-position three-way valve connects with the third oil supply port 4*f* of the second control module, and the oil supply port 213*a* of the 2-3 two-position three-way valve connects with the fourth oil supply port 4*g* of the second control module. The drive port 211*c* of the 2-1 two-position three-way valve connects with the second drive port 4*h* of the second control module, the drive port 212*c* of the 2-2 two-position three-way valve connects with the third drive port 4*i* of the second control module, and the drive port 213*c* of the 2-3 two-position three-way valve connects with the fourth drive port 4*j* of the second control module. The oil outlet 94*a* of the fourth oil drain valve, the oil outlet 95*a* of the fifth oil drain valve, the oil outlet 96*a* of the sixth oil drain valve, the oil inlet 20*a* of the second check valve and the oil drain port 4*b* of the second control module are connected to each other. The oil inlet 94*b* of the fourth oil drain valve connects with the fifth drive port 4*k* of the second control module, the oil inlet 95*b* of the fifth oil drain valve connects with the sixth drive port 4*m* of the second control module, and the oil inlet 96*b* of the sixth oil drain valve connects with the seventh drive port 4*n* of the second control module.

The phase limit module 2 comprises the three-layer nested structure. From the exterior to the interior, there are the phase limit module housing 2*k* with an oil opening, the phase limit module sleeve 2*m* notched and tapped axially and the phase limit module axle spindle 2*n* notched radially. Thereof, the phase limit module spindle 2*n* is actuated by the crankshaft of the internal combustion engine through the gear or chain wheel transmission mechanism, the crank angle rotates a cycle every 720°, and the phase limit module sleeve 2*m* is nested and fixed inside the phase limit module housing 2*k* and rotates constantly with the phase limit module spindle 2*n* according to the ignition sequence of the internal combustion engine. For the continuously variable valve actuation system, with the constant rotation of the phase limit module spindle 2*n*, the first drive port 2*e* of the phase limit module, the third drive port 2*g* of the phase limit module and the fifth drive port 2*i* of the phase limit module connect to the first oil supply port 2*b* or the second oil drain port 2*d* of the phase limit module respectively and alternately. The second drive port 2*f* of the phase limit module, the fourth drive port 2*h* of the phase limit module and the sixth drive port 2*j* of the phase limit module connect to the second oil supply port 2*a* or the second oil drain port 2*d* of the phase limit module respectively and alternately. For the fully variable valve actuation system, the first drive port 2*e* of the phase limit module, the third drive port 2*g* of the phase limit module and the fifth drive port 2*i* of the phase limit module connect to the first oil supply port 2*b* of the phase limit module, the first oil drain port 2*c* of the phase limit module or the second oil drain port 2*d* of the phase limit module respectively and alternately. The second drive port 2*f*, the fourth drive port 2*h* and the sixth drive port 2*j* of the phase limit module connect to the second oil supply port 2*a*, the first oil drain port 2*c* or the second oil drain port 2*d* of the phase limit module respectively and alternately.

The mode selection module 22 comprises the dual-layer nested structure, comprising mode selection module housing 22*n* with an oil opening and the notched mode selection module spindle 22*q*. Actuated by the electromagnetic, hydraulic, mechanical or pneumatic mechanism, the mode selection module spindle 22*q* rotates or moves axially in the mode selection module housing 22*n* and has two positions. Under the drive mode, the mode selection module spindle 22*q* is not actuated. Meanwhile, the oil control inlet 22*r* of the mode selection module connects with the oil control outlet 22*s* of the mode selection module, the first oil supply port 22*a* of the mode selection module connects with the first drive port 22*g* of the mode selection module, and the second oil supply port 22*b* of the mode selection module connects with the second drive port 22*h* of the mode selection module. The third oil supply port 22*c* of the mode selection module connects with the third drive port 22*i* of the mode selection module, the fourth oil supply port 22*d* of the mode selection module connects with the fourth drive port 22*j* of the mode selection module, the fifth oil supply port 22*e* of the mode selection module connects with the fifth drive port 22*k* of the mode selection module, and the sixth oil supply port 22*f* of the mode selection module connects with the sixth drive port 22*m* of the mode selection module. Under the brake mode, when the drive mode selection module spindle 22*q* rotates over a certain angle or moves to a certain distance axially, the oil control inlet 22*r* of the mode selection module disconnects with its oil control outlet 22*s*. When the supply-for-drain & drain-for-supply brake mode is adopted, the first oil supply port 22*a*, the second oil supply port 22*b*, the first drive port 22*g* and the second drive port 22*h* of the mode selection module are connected to each other; the third oil supply port 22*c*, the fourth oil supply port 22*d*, the third drive port 22*i* and the fourth drive port 22*j* of the mode selection module are connected to each other; and the fifth oil supply port 22*e*, the sixth oil supply port 22*f*, the fifth drive port 22*k* and the sixth drive port 22*m* of the mode selection module are connected to each other. When the supply-for-supply & drain-for-drain brake mode is adopted, the first oil supply port 22*a*, the second oil supply port, the fifth drive port 22*k* and the sixth drive port 22*m* of the mode selection module are connected to each other; the third oil supply port 22*c*, the fourth oil supply port 22*d*, the first drive port 22*g* and the second drive port 22*h* of the mode selection module are connected to each other; and the fifth oil supply port 22*e*, the sixth oil supply port 22*f*, the third drive port 22*i* and the fourth drive port 22*j* of the mode selection module are connected to each other.

For the valve actuation system with the drain-for-drain & drain-for-supply brake mode, the mode conversion 22 may also have the switch valve assembly structure, and the switch valve assembly 27 may have the dual-layer nested structure, comprising the switch valve assembly housing 27*n* with an oil opening and the notched switch valve assembly spindle 27*q*. Actuated by the electromagnetic, hydraulic, mechanical or pneumatic mechanism, the switch valve assembly spindle 27*q* rotates or moves axially in the switch valve assembly housing 27*n* and has two positions. The switch valve assembly 27 comprises the first oil port 27*a*, the second oil port 27*b*, the third oil port 27*c*, the fourth oil port 27*d*, the fifth oil port 27*e*, the sixth oil port 27*f*, the seventh oil port 27*g* and the eighth oil port 27*h* of the switch valve assembly. The first oil supply port 22*a* of the mode selection module, the first drive port 22*g* of the mode selection module and the first oil port 27*a* of the switch valve assembly connect to each other. The second oil supply port 22*b* of the mode selection module, the second drive port 22*h* of the mode selection module and the fifth oil port 27*e* of the switch valve assembly connect to each other. The third oil supply port 22*c* of the mode selection module, the third drive port 22*i* of the mode selection module and the second oil port 27*b* of the switch valve assembly connect to each other. The fourth oil supply port 22*d* of the mode selection module, the fourth drive port 22*j* of the mode selection module and the sixth oil port 27*f* of the switch valve assembly connect to each other. The fifth oil supply port 22*e* of the mode selection module, the fifth drive port 22*k* of the mode selection module and the third oil port 27*c* of the switch valve assembly connect to each other. The sixth oil supply port 22*f* of the mode selection module, the sixth drive port 22*m* of the mode selection module and the seventh oil port 27*g* of the switch valve assembly connect to each other. The oil control inlet 22*r* of the mode selection module connects with the fourth oil port 27*d* of the switch valve assembly, and the oil control outlet 22*s* of the mode selection module connects with the eighth oil port 27*h* of the switch valve assembly. Under the drive mode, the switch valve assembly spindle 27*q* is not actuated. Meanwhile, the first oil port 27*a* of the switch valve assembly disconnects with its 5th oil port 27*e*, the second oil port 27*b* of the switch valve assembly disconnects with its 6th oil port 27*f*, the third oil port 27*c* of the switch valve assembly disconnects with its 7th oil port 27*g* and the fourth oil port 27*d* of the switch valve assembly disconnects with its 8th oil port 27*h*. Under the brake mode, the switch valve assembly spindle 27*q* rotates over a certain angle or moves to a certain distance axially. The first oil port 27*a* of the switch valve assembly connects with its 5th oil port 27*e*, the second oil port 27*b* of the switch valve assembly connects with its 6th oil port 27*f*, and the third oil port 27*c* of the switch valve assembly connects with its 7th oil port 27*g*, but the fourth oil port 27*d* of the switch valve assembly disconnects with its 8th oil port 27*h*. The switch valve assembly 27 may also have the independent switch valve structure, comprising the first switch valve 23, the 2nd switch valve 24, the third switch valve 25 and the fourth switch valve 26. The fifth oil port 27*e* of the switch valve assembly connects with the first oil port 23*a* of the first switch valve, the first oil port 27*a* of the switch valve assembly connects with the first oil port 23*b* of the first switch valve, the sixth oil port 27*f* of the switch valve assembly connects with the first oil port 24*a* of the second switch valve, the second oil port 27*b* of the switch valve assembly connects with the second oil port 24*b* of the second switch valve, the seventh oil port 27*g* of the switch valve assembly connects with the first oil port 25*a* of the third switch valve, the third oil port 27*c* of the switch valve assembly connects with the second oil port 25*b* of the third switch valve, the eighth oil port 27*h* of the switch valve assembly connects with the first oil port 26*a* of the fourth switch valve, and the fourth oil port 27*d* of the switch valve assembly connects with the second oil port 26*b* of the fourth switch valve. Under the drive mode, the first oil port 26*a* of the fourth switch valve connects with its second oil port 26*b*, but the first oil port 23*a* of the first switch valve disconnects with its first oil port 23*b*, the first oil port 24*a* of the second switch valve disconnects with its second oil port 24*b*, and the first oil port 25*a* of the third switch valve disconnects with its second oil port 25*b*. Under the brake mode, the first oil port 26*a* of the fourth switch valve is actuated to disconnect to its second oil port 26*b*, the first oil port 23*a* of the first switch valve disconnects with its first oil port 23*b*, the first oil port 24*a* of the second switch valve disconnects with its second oil port 24*b*, and the first oil port 25*a* of the third switch valve disconnects with its second oil port 25*b*.

Benefits of the present disclosure are: (a) the modularized multifunctional variable valve actuation system for a six-cylinder internal combustion engine needs only two oil supply modules to supply hydraulic oil for all intake (exhaust) valve actuation modules of the engine, it needs only two oil supply modules and two two-position two-way valves to realize the continuously variable valve event, and it needs only two oil supply module, two two-position three-way valves and one two-position two-way valve to realize the fully variable valve event. Its oil supply modules and electromagnetic valves are reduced to a large extent, the simplification of its electromagnetic valve structure largely reduces the system cost and improves the acceptance of the market; (b) the impact of the oil supply module operation phase on the valve operation process is weakened. In particular, the valve closing process is not restricted by the operation phase of the oil supply module, and the idling, low-speed and medium-speed performance of the internal combustion engine can be optimized further by closing the intake valve earlier, so as to improve the oil consumption and exhaust of vehicles in the operation process and expand the system application effect; (c) the phase limit module structure is simplified a lot, less oil pipes are assembled externally, and the system manufacturability and practicability is enhanced. Meanwhile, independent with the phase limit module and the mode selection module, it is more compatible with internal combustion engines without a brake mode or with different brake modes; (d) by means of modularized design, functions of various components of the system are independent, parts can be selected according to actual application requirements, and other parts of the system are not affected. The system has high adaptability for engine types and is applicable widely: the setup of the mode selection module can be decided depending on the brake mode; the mode selection module structure can be selected according to the brake mode and the drive pattern of the mode selection module; control modules and oil delivery modules can be selected according to the variability and flexibility of valves, the speed range of internal combustion engines and their special layout and so on. The opening angle of each oil port section of a phase limit module spindle can be adjusted according to the ignition sequence of an internal combustion engine. For the internal combustion engine with a brake mode, the connection object of oil path between the phase limit module and the mode selection module can be changed; for the internal combustion engine without a brake mode, the connection object of oil path between the phase limit module and the valve actuation module of each cylinder can be changed; (e) the mode selection module will combine the variable valve technology and auxiliary braking technology of internal combustion engines together, so as to use less auto accessories, largely reduce the cost and enhance functions of the system; (f) various components of the system are connected via an oil pipes, which is beneficial for its layout on application vehicles.

BRIEF DESCRIPTION OF THE DRAWINGS

The present disclosure is illustrated further below in connection with figures and examples.

Figure 1:
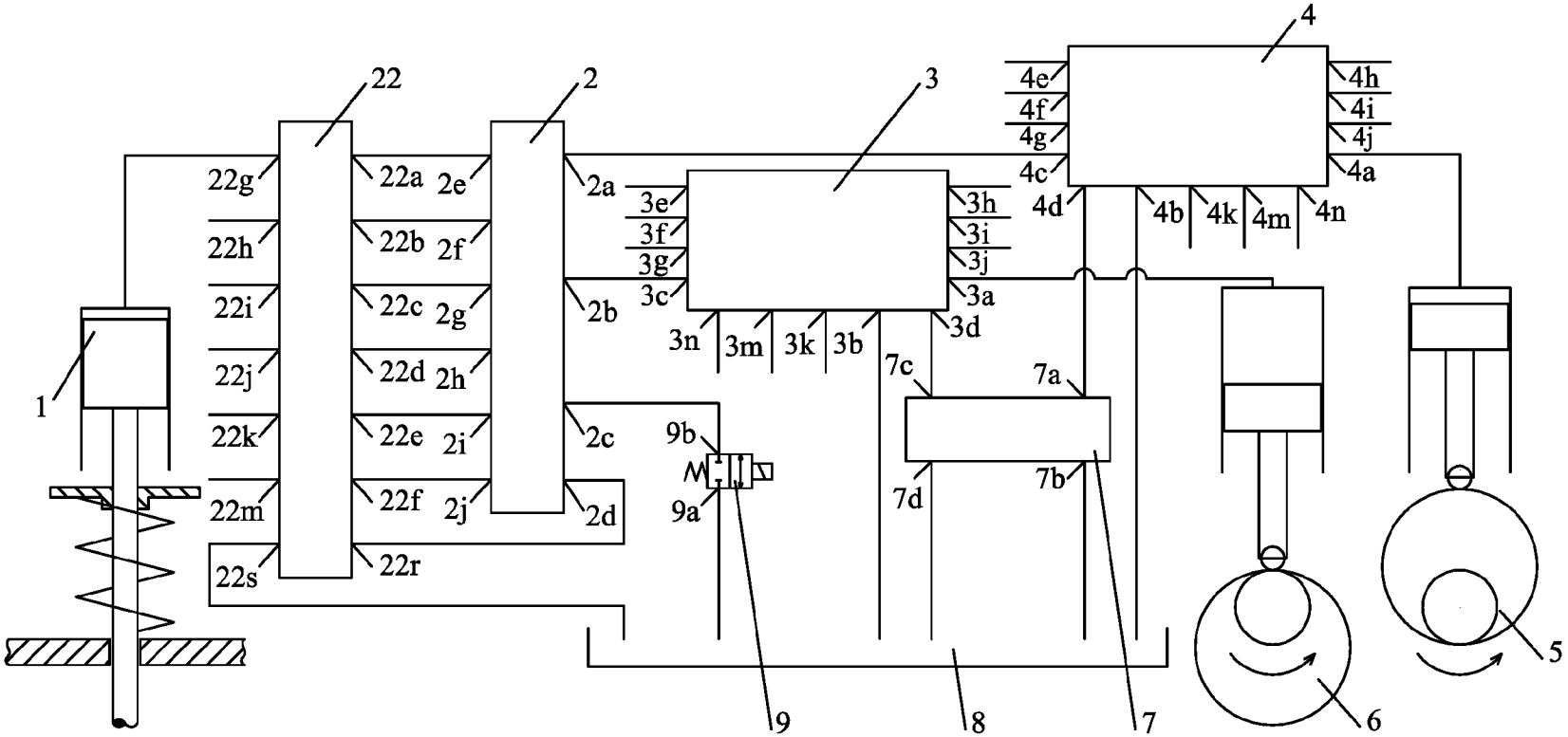
FIG. 1 is a diagram of a modularized multifunctional variable valve actuation system.

The figure shows 1: valve actuation module; 2: phase limit module; 2*a*: the second oil supply port of the phase limit module; 2*b*: the first oil supply port of the phase limit module; 2*c*: the first oil drain port of the phase limit module; 2*d*: the second oil drain port of the phase limit module; 2*e*: the first oil drain port of the phase limit module; 2*f*: the second drive port of the phase limit module; 2*g*: the third drive port of phase limit module; 2*h*: the fourth drive port of the phase limit module; 2*i*: the fifth drive port of the phase limit module; 2*j*: the sixth drive port of the phase limit module; 2*k*: phase limit module housing; 2*m*: phase limit module sleeve; 2*n*: phase limit module spindle; 3: the first control module; 3*a*: the first oil supply port of the first control module; 3*b*: oil drain port of the first control module; 3*c*: the first drive port of the first control module; 3*d*: oil delivery port of the first control module; 3*e*: the second oil supply port of the first control module; 3*f*: the third oil supply port of the first control module; 3*g*: the fourth oil supply port of the first control module; 3*h*: the second drive port of the first control module; 3*i*: the third drive port of the first control module; 3*j*: the fourth drive port of the first control module; 3*k*: the fifth drive port of the first control module; 3*m*: the sixth drive port of the first control module; 3*n*: the seventh drive port of the first control module; 4: the second control module; 4*a*: the first oil supply port of the second control module; 4*b*: oil drain port of the second control module; 4*c*: the first drain port of the second control module; 4*d*: oil delivery port of the second control module; 4*e*: the second oil supply port of the second control module; 4*f*: the third oil supply port of the second control module; 4*g*: the fourth oil supply port of the second control module; 4*h*: the second drive port of the second control module; 4*i*: the third drive port of the second control module; 4*j*: the fourth drive port of the second control module; 4*k*: the fifth drive port of the second control module; 4*m*: the sixth drive port of the second control module; 4*n*: the seventh drive port of the second control module; 5: the second oil supply module; 6: the first oil supply module; 7: oil delivery module; 7*a*: the second oil delivery port of the oil delivery module; 7*b*: oil delivery port of the oil delivery module; 7*c*: the first oil delivery port of the oil delivery module; 7*d*: oil inlet of oil delivery module; 8: oil tank; 9: oil drain valve; 9*a*: oil outlet of oil drain valve; 9*b*: oil inlet of oil drain valve; 10: oil delivery pump; 10*a*: oil inlet of oil delivery pump; 10*b*: oil outlet of oil delivery pump; 11: safety valve of oil delivery pump; 11*a*: oil outlet of safety valve of oil delivery pump; 11*b*: safety valve of oil delivery pump oil inlet; 12: the first oil delivery check valve; 12*a*: oil inlet of the first oil delivery check valve; 12*b*: oil outlet of the first oil delivery check valve; 13: the second oil delivery check valve; 13*a*: oil inlet of the second oil delivery check valve; 13*b*: oil outlet of the second oil delivery check valve; 14: the first two-position two-way valve; 14*a*: oil outlet of the first two-position two-way valve; 14*b*: oil inlet of the first two-position two-way valve; 15: the second two-position two-way valve; 15*a*: oil outlet of the second two-position two-way valve; 15*b*: oil inlet of the second two-position two-way valve; 16: oil delivery check valve; 16*a*: oil inlet of oil delivery check valve; 16*b*: oil outlet of oil delivery check valve; 17: system safety valve; 17*a*: oil outlet of system safety valve; 17*b*: oil inlet of system safety valve; 18: the first check valve; 18*a*: oil inlet of the first check valve; 18*b*: oil outlet of the first check valve; 19: the first two-position three-way valve; 19*a*: oil supply port of the first two-position three-way valve; 19*b*: oil delivery port of the first two-position three-way valve; 19*c*: valve drive port of the first two-position three-way; 20: the second check valve; 20*a*: oil inlet of the second check valve; 20*b*: oil outlet of the second check valve; 21: the second two-position three-way valve; 21*a*: oil supply port of the second two-position three-way valve; 21*b*: oil delivery port of the second two-position three-way valve; 21*c*: drive port of the second two-position three-way valve; 22: mode selection module; 22*a*: the first oil supply port of the mode selection module; 22*b*: the second oil supply port of the mode selection module; 22*c*: the third oil supply port of the mode selection module; 22*d*: the fourth oil supply port of the mode selection module; 22*e*: the fifth oil supply port of the mode selection module; 22*f*: the sixth oil supply port of the mode selection module; 22*g*: the first drive port of the mode selection module; 22*h*: the second drive port of the mode selection module; 22*i*: the third drive port of the mode selection module; 22*j*: the fourth drive port of the mode selection module; 22*k*: the fifth drive port of the mode selection module; 22*m*: the sixth drive port of the mode selection module; 22*n*: mode selection module housing; 22*q*: mode selection module spindle; 22*r*: oil control inlet of the mode selection module; 22*s*: oil control outlet of the mode selection module; 23: the first switch valve; 23*a*: the first oil port of the first switch valve; 23*b*: the second oil port of the first switch valve; 24: the second switch valve; 24*a*: the first oil port of the second switch valve; 24*b*: the second oil port of the second switch valve; 25: the third switch valve; 25*a*: the first oil port of the third switch valve; 25*b*: the second oil port of the third switch valve; 26: the fourth switch valve; 26*a*: the first oil port of the fourth switch valve; 26*b*: the second oil port of the fourth switch valve; 27: switch valve assembly; 27*a*: the first oil port of the switch valve assembly; 27*b*: the second oil port of the switch valve assembly; 27*c*: the third oil port of the switch valve assembly; 27*d*: the fourth oil port of the switch valve assembly; 27*e*: the fifth oil port of the switch valve assembly; 27*f*: the sixth oil port of the switch valve assembly; 27*g*: the seventh oil port of the switch valve assembly; 27*h*: the eighth oil port of the switch valve assembly; 27*n*: switch valve assembly housing; 27*q*: switch valve assembly spindle; 91: the first oil drain valve; 91*a*: the first oil outlet of oil drain valve; 91*b*: the first oil inlet of oil drain valve; 92: the second oil drain valve; 92*a*: the second oil outlet of oil drain valve; 92*b*: the second oil inlet of oil drain valve; 93: the third oil drain valve; 93*a*: the third oil outlet of oil drain valve; 93*b*: the third oil inlet of oil drain valve; 94: the fourth oil drain valve; 94*a*: the fourth oil outlet of oil drain valve; 94*b*: the fourth oil inlet of oil drain valve; 95: the fifth oil drain valve; 95*a*: the fifth oil outlet of oil drain valve; 95*b*: the fifth oil inlet of oil drain valve; 96: the sixth oil drain valve; 96*a*: the sixth oil outlet of oil drain valve; 96*b*: the sixth oil inlet of oil drain valve; 141: the 1-1 two-position two-way valve; 141*a*: oil outlet of the 1-1 two-position two-way valve; 141*b*: oil inlet of the 1-1 two-position two-way valve; 142: the 1-2 two-position two-way valve; 142*a*: oil outlet of the 1-2 two-position two-way valve; 142*b*: oil inlet of the 1-2 two-position two-way valve; 143: the 1-3 two-position two-way valve; 143*a*: oil outlet of the 1-3 two-position two-way valve; 143*b*: oil inlet of the 1-3 two-position two-way valve; 151: the 2-1 two-position two-way valve; 151*a*: oil outlet of the 2-1 two-position two-way valve; 151*b*: oil inlet of the 2-1 two-position two-way valve; 152: the 2-2 two-position two-way valve; 152*a*: oil outlet of the 2-2 two-position two-way valve; 152*b*: oil inlet of the 2-2 two-position two-way valve; 153: the 2-3 two-position two-way valve; 153*a*: oil outlet of the 2-3 two-position two-way valve; 153*b*: oil inlet of the 2-3 two-position two-way valve; 191: the 1-1 two-position three-way valve; 191*a*: oil supply port of the 1-1 two-position three-way valve; 191*b*: oil delivery port of the 1-1 two-position three-way valve; 191*c*: drive port of the 1-1 two-position three-way valve; 192: the 1-2 two-position three-way valve; 192*a*: oil supply port of the 1-2 two-position three-way valve; 192*b*: oil delivery port of the 1-2 two-position three-way valve; 192*c*: drive port of the 1-2 two-position three-way valve; 193: the 1-3 two-position three-way valve; 193*a*: oil supply port of the 1-3 two-position three-way valve; 193*b*: oil delivery port of the 1-3 two-position three-way valve; 193*c*: drive port of the 1-3 two-position three-way valve; 211: the 2-1 two-position three-way valve; 211*a*: oil supply port of the 2-1 two-position three-way valve; 211*b*: oil delivery port of the 2-1 two-position three-way valve; 211*c*: drive port of the 2-1 two-position three-way valve; 212: the 2-2 two-position three-way valve; 212*a*: oil supply port of the 2-2 two-position three-way valve; 212*b*: oil delivery port of the 2-2 two-position three-way valve; 212*c*: drive port of the 2-2 two-position three-way valve; 213: the 2-3 two-position three-way valve; 213*a*: oil supply port of the 2-3 two-position three-way valve; 213*b*: oil delivery port of the 2-3 two-position three-way valve; 213*c*: drive port of the 2-3 two-position three-way valve.

DETAILED DESCRIPTION OF THE EMBODIMENTS

FIG. 1 shows a diagram of a modularized multifunctional variable valve actuation system for a six-cylinder internal combustion engine. This system mainly comprises the valve actuation module 1, the first oil supply module 6, the second oil supply module 5, oil delivery module 7, oil tank 8, oil drain valve 9 and oil pipe; besides, it also comprises the phase limit module 2, mode selection module 22, the first control module 3, the second control module 4; The first oil supply module 6 and the second oil supply module 5 are cam-plunger oil supply modules with the camshaft angle with the phase difference of 180° and its rotation period is double of the ignition interval angle of the internal combustion engine, i.e. 240° crank angle. The first control module 3 comprises the first oil supply port 3*a*, the oil drain port 3*b*, the 1 drive port 3*c* and the oil delivery port 3*d* of the first control module. The second control module 4 comprises the first oil supply port 4*a*, the oil drain port 4*b*, the first drive port 4*c* and the oil delivery port 4*d* of the second control module. The oil delivery module 7 comprises the second oil delivery port 7*a*, the oil drain port 7*b*, the first oil delivery port 7*c* and oil inlet 7*d* of the oil delivery module. The phase limit module 2 comprises the second oil supply port 2*a*, the first oil supply port 2*b*, the second oil supply port 2*d*, the first drive port 2*e*, the second drive port 2*f*, the third drive port 2*g*, the fourth drive port 2*h*, the fifth drive port 2*i* and the sixth drive port 2*j* of the phase limit module. The oil drain port 7*b* and oil inlet 7*d* of the oil delivery module, the oil drain port 3*b* of the first control module and the oil drain port 4*b* of the second control module all connect to the oil tank 8, the second oil delivery port 7*a* of the oil delivery module connects with the oil delivery port of the second control module 4*d*, the first oil delivery port 7*c* of the oil delivery module connects with the oil delivery port 3*d* of the first control module, the first oil supply port 3*a* of the first control module connects with the first oil supply module 6 of the first oil supply port 3*a*, the first oil supply port 4*a* of the second control module connects with the second oil supply module 5, the first drive port 3*c* of the first control module connects with the first oil supply port 2*b* of the phase limit module, the first drive port 4*c* of The second control module connects with the second oil supply port 2*a* of the phase limit module. Without the brake mode, the first drive port 2*e* of the phase limit module, the second drive port 2*f* of the phase limit module, the third drive port 2*g* of the phase limit module, the fourth drive port 2*h* of the phase limit module, the fifth drive port 2*i* of the phase limit module and the sixth drive port 2*j* of the phase limit module connect to valve actuation modules of one-cylinder, six-cylinder, two-cylinder, five-cylinder, three-cylinder and four-cylinder respectively, and the second oil drain port 2*d* of the phase limit module connects with the oil tank 8. With the brake mode, the system further comprises a mode selection module 22. The mode selection module 22 comprises the first oil supply port 22*a* of the mode selection module, the second oil supply port 22*b* of the mode selection module, the third oil supply port 22*c* of the mode selection module, the fourth oil supply port 22*d* of the mode selection module, the fifth oil supply port 22*e* of the mode selection module and the sixth oil supply port 22*f* of the mode selection module. These modules connect to the first drive port 2*e*, the second drive port 2*f*, the third drive port 2*g*, the fourth drive port 2*h*, the fifth drive port 2*i* and the sixth drive port 2*j* of the phase limit module respectively. Besides, the mode selection module 22 comprises the first drive port 22*g*, the second drive port 22*h*, the third drive port 22*i*, the fourth drive port 22*j*, the fifth drive port 22*k* and the sixth drive port 22*m* of the mode selection module. These modules connect to valve actuation modules of one-cylinder, six-cylinder, two-cylinder, five-cylinder, three-cylinder and four-cylinder respective. In addition, the mode selection module 22 comprises the oil control inlet 22*r* and the oil control outlet 22*s* of the mode selection module, and both connect to the second oil drain port 2*d* of the phase limit module and the oil tank 8 respectively. For the valve actuation system of an internal combustion engine with the cylinder number as an integral multiple of 6, every 6 cylinders are classified into a group at the crank angle of 120° according to the ignition sequence and each group is equipped with a set of the variable valve actuation system.

For the fully variable valve actuation system of a continuously variable or independent oil drain valve controlled on the valve side, the first control module 3 further comprises a fifth drive port 3*k*. The sixth drive port 3*m* and the seventh drive port 3*n* of the first control module. The fifth drive port 3*k* of the first control module connects with the oil path between the first drive port 2*e* of the phase limit module and the first oil supply port 22*a* of the mode selection module or the oil path between the first drive port 22*g* of the mode selection module and the valve actuation module of one-cylinder. The sixth drive port 3*m* of the first control module connects with the oil path between the third drive port 2*g* of the phase limit module and the third oil supply port 22*c* of the mode selection module or the oil path between the third drive port 22*i* of the mode selection module and the valve actuation module of two-cylinder. The seventh drive port 3*n* of the first control module connects with the oil path between the fifth drive port 2*i* of the phase limit module and the fifth oil supply port 22*e* of the mode selection module or the oil path between the fifth drive port 22*k* of the mode selection module and the valve actuation module of three-cylinder. The second control module 4 further comprises a fifth drive port 4*k* of the second control module, the sixth drive port 4*m* of the second control module and the seventh drive port 4*n* of the second control module. The fifth drive port 4*k* of the second control module connects with the oil path between the second drive port 2*f* of the phase limit module and the second oil supply port 22*b* of the mode selection module or the oil path between the second drive port 22*h* of the mode selection module and the valve actuation module of six-cylinder. The sixth drive port 4*m* of the second control module connects with the oil path between the fourth drive port 2*h* of the phase limit module and the fourth oil supply port 22*d* of the mode selection module or the oil path between the fourth drive port 22*j* of the mode selection module and the valve actuation module of five-cylinder. The seventh drive port 4*n* of the second control module connects with the oil path between the sixth drive port 2*j* of the phase limit module and the sixth oil supply port 22*f* of the mode selection module or the oil path between the sixth drive port 22*m* of the mode selection module and the valve actuation module of four-cylinder.

For the fully variable valve actuation system controlled on the valve side, the first control module 3 further comprises a second oil supply port 3*e*, the third oil supply port 3*f* and the fourth oil supply port 3*g* of the first control module, as well as the second drive port 3*h*, the third drive port 3*i* and the fourth drive port 3*j* of the first control module. The second oil supply port 3*e* of the first control module and the second drive port 3*h* of the first control module respectively connect to the first drive port 2*e* of the phase limit module and the first oil supply port 22*a* or the first drive port 22*g* of the mode selection module and the valve actuation module of one-cylinder. The third oil supply port 3*f* of the first control module and the third drive port 3*i* of the first control module respectively connect to the third drive port 2*g* of the phase limit module and the third oil supply port 22*c* of the mode selection module or the third drive port 22*i* of the mode selection module and the valve actuation module of two-cylinder. The fourth oil supply port 3*g* of the first control module and the fourth drive port 3*j* of the first control module respectively connect to the fifth drive port 2*i* of the phase limit module and the fifth oil supply port 22*e* of the mode selection module or the fifth drive port 22*k* of the mode selection module and the valve actuation module of three-cylinder. The second control module 4 further comprises a second oil supply port 4*e*, the third oil supply port 4*f*, the fourth oil supply port 4*g*, the second drive port 4*h*, the third drive port 4*i* and the fourth drive port 4*j* of the second control module. The second oil supply port 4*e* and the second drive port 4*h* of the second control module respectively connect to the second drive port 2*f* of the phase limit module and the second oil supply port 22*b* of the mode selection module or the second drive port 22*h* of the mode selection module and the valve actuation module of six-cylinder. The third oil supply port 4*f* and the third drive port 4*i* of the second control module respectively connect to the fourth drive port 2*h* of the phase limit module and the fourth oil supply port 22*d* of the mode selection module or the fourth drive port 22*j* of the mode selection module and the valve actuation module of five-cylinder. The fourth oil supply port 4*g* and the fourth drive port 4*j* of the second control module respectively connect to the sixth drive port 2*j* of the phase limit module and the sixth oil supply port 22*f* of the mode selection module or the sixth drive port 22*m* of the mode selection module and the valve actuation module of four-cylinder.

For the fully variable valve actuation system of the independent oil drain valve controlled on the valve side, the phase limit module 2 and the mode selection module 22 can be cancelled. The first oil supply port 3*a*, the first drive port 3*c*, the second oil supply port 3*e*, the third oil supply port 3*f* and the fourth oil supply port 3*g* of the first control module all connect to the first oil supply module 6. The second drive port 3*h* and the fifth drive port 3*k* of the first control module both connect to the valve actuation module of one-cylinder, the third drive port 3*i* and the sixth drive port 3*m* of the first control module both connect to the valve actuation module of two-cylinder, and the fourth drive port 3*j* of the control module and the seventh drive port 3*n* of the first control module both connect to the valve actuation module of three-cylinder. The first oil supply port 4*a*, the first drive port 4*c*, the second oil supply port 4*e*, the third oil supply port 4*f* and the fourth oil supply port 4*g* of the second control module all connect to the second oil supply module 5, the second drive port 4*h* and the fifth drive port 4*k* of the second control module both connect to the valve actuation module of six-cylinder, the third drive port 4*i* and the sixth drive port 4*m* of the second control module both connect to the valve actuation module of five-cylinder, and the fourth drive port 4*j* and the seventh drive port 4*n* of the second control module both connect to the valve actuation module of four-cylinder.

In addition, the fully variable valve actuation system of an independent oil drain valve is equipped with oil drain valve 9, the phase limit module 2 comprises the first oil drain port 2*c* of the phase limit module, the first oil drain port 2*c* of the phase limit module connects with the oil inlet of oil drain valve 9*b*, the oil outlet 9*a* of the oil drain valve connects with the oil tank 8.

The oil delivery module 7 delivers hydraulic oil for the first oil supply module 6 and the second oil supply module 5. As for valve actuation system controlled on the oil supply side, the first control module 3 controls the hydraulic oil connection object in the first oil supply module 6 and the second control module 4 controls the hydraulic oil connection object in the second oil supply module. As for the valve actuation system controlled on the valve side, the first control module 3 controls the hydraulic oil connection objects in the valve actuation modules of four-cylinder, five-cylinder and six-cylinder. The mode selection module 22 selects the current operating mode of the valve actuation system, i.e. drive mode or brake mode, depending on the operation of the internal combustion engine. The valve actuation module 1 finishes opening and closing the valve by means of hydraulic actuation and spring reset.

Under the drive mode, the phase limit module 2 makes the first oil supply module 6 supplies oil to the valve actuation modules of one-cylinder, two-cylinder and three-cylinder alternatively, and/or the first control module 3 coordinates with the oil drain valve 9 separately and controls the open/close parameters of valve actuation modules of one-cylinder, two-cylinder and three-cylinder alternatively. The second oil supply module 5 supplies oil to valve actuation modules of four-cylinder, five-cylinder and six-cylinder, and/or the second control module coordinates with the oil drain valve 9 separately and controls the open/close parameters of valve actuation modules of four-cylinder, five-cylinder and six-cylinder alternatively. At the 720° crank angle, i.e. an operating cycle of the phase limit module 2, the valve is closed according to the sequence from one-cylinder to five-cylinder to three-cylinder to six-cylinder to two-cylinder to four-cylinder or from one-cylinder to four-cylinder to two-cylinder to six-cylinder to three-cylinder to five-cylinder and meets the drive mode requirement. Under the brake mode, the mode selection module 22 classifies valve actuation modules of the internal combustion engine into three groups: one-cylinder and six-cylinder, two-cylinder and five-cylinder, and three-cylinder and four-cylinder. The first oil supply module 6 or the second oil supply module 5 supplies oil to the three groups of valve actuation modules alternatively, the first control module 3 and the oil drain valve 9 coordinate with each other or the second control module 4 coordinates with the oil drain valve 9 separately and controls the open/close parameters of the three groups of valve actuation modules alternatively. At the 720° crank angle, i.e. an operating cycle of the phase limit module 2, the valve is closed according to the sequence from one-cylinder+six-cylinder to two-cylinder+five-cylinder to three-cylinder+four-cylinder to one-cylinder+six-cylinder to two-cylinder+five-cylinder to three-cylinder+four-cylinder and meets the drive mode requirement.

Figure 2:
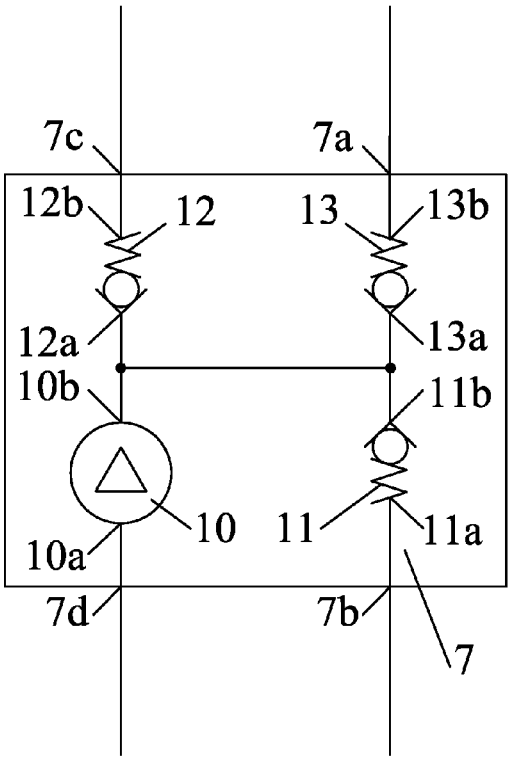
FIG. 2 is a diagram of an oil delivery module of the continuously variable system.

FIG. 2 is a diagram of an oil delivery module of the continuously variable system. The oil delivery module 7 comprises the oil delivery pump 10, the safety valve 11 of the oil delivery pump, the first oil delivery check valve 12 and the second oil delivery check valve 13. The oil inlet of oil delivery pump 10*a* connects with oil inlet of oil delivery module 7*d*, the oil outlet 11*a* of the safety valve of the oil delivery pump connects with oil drain port 7*b* of the oil delivery module, and the oil outlet 12*b* of the first oil delivery check valve connects with the first oil delivery port 7*c* of the oil delivery module. The oil outlet 13*b* of the second oil delivery check valve connects with the second oil delivery port 7*a* of the oil delivery module. The oil outlet 10*b* of the delivery pump, the oil inlet 11*b* of the safety valve of the oil delivery pump, the oil inlet 12*a* of the first oil delivery check valve and the oil inlet 13*a* of the second oil delivery check valve connect to each other.

Figure 3:
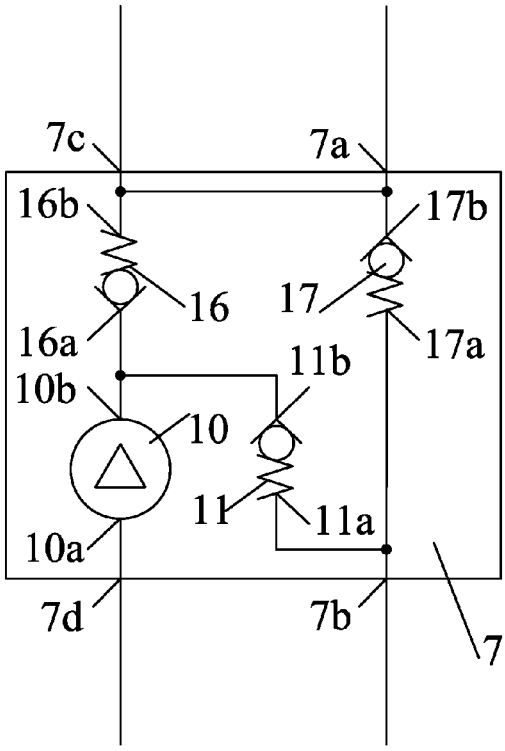
FIG. 3 is a diagram of an oil delivery module of the fully variable system.

FIG. 3 is a diagram of an oil delivery module of the fully variable system. The oil delivery module 7 comprises the oil delivery pump 10, the safety valve 11 of the oil delivery pump, the oil delivery check valve 16 and the system safety valve 17. The oil inlet of oil delivery pump 10*a* connects with the oil inlet of oil delivery module 7*d*. The oil the oil outlet 10*b* of the delivery pump, the oil inlet 11*b* of the safety valve of the oil delivery pump and the oil inlet 16*a* of the oil delivery check valve connect to each other. The oil outlet 11*a* of the safety valve of the oil delivery pump, the oil outlet 17*a* of the system safety valve and the oil drain port 7*b* of the oil delivery module are connected to each other. The oil outlet 16*b* of the oil delivery check valve, the oil outlet 17*b* of the system safety valve, the second oil delivery port 7*a* of the oil delivery module and the first oil delivery port 7*c* of the oil delivery module are connected to each other.

Figure 4:
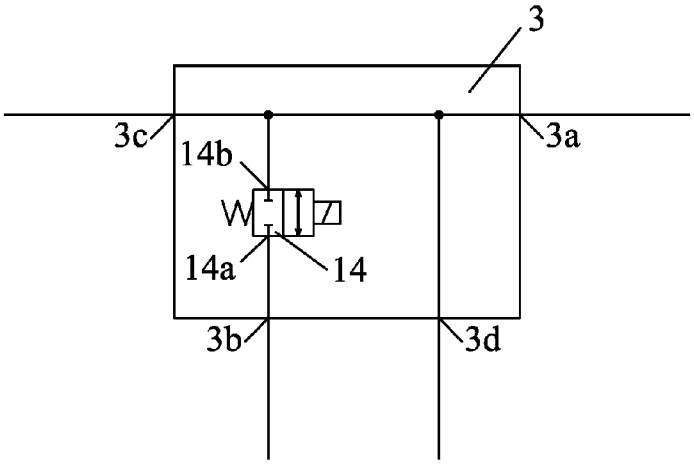
FIG. 4 is a diagram of a first control module of continuously variable valve system controlled on the oil supply side.

FIG. 4 is a diagram of a first control module of the continuously variable valve system controlled on the oil supply side. The first control module 3 comprises the first two-position two-way valve 14. The oil outlet 14*a* of the first two-position two-way valve connects with the oil drain port 3*b* of the first control module. The oil inlet 14*b* of the first two-position two-way valve, the first oil supply port 3*a* of the first control module, the first drive port 3*c* of the first control module and the oil delivery port 3*d* of the first control module are connected to each other.

Figure 5:
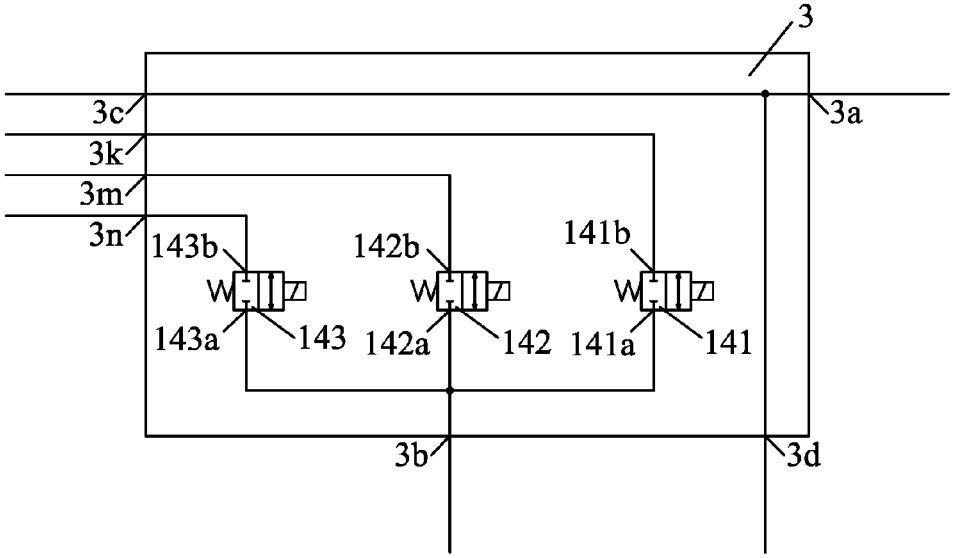
FIG. 5 is a diagram of a first control module of the continuously variable valve system controlled on the valve side.

FIG. 5 is a diagram of a first control module of the continuously variable valve system controlled on the valve side. The first control module 3 comprises the 1-1 two-position two-way valve 141, the 1-2 two-position two-way valve 142 and the 1-3 two-position two-way valve 143. The first oil supply port 3*a*, the first drive port 3*c* and the oil delivery port 3*d* of the first control module are connected to each other. The oil outlet 141*a* of the 1-1 two-position two-way valve, the oil outlet 142*a* of the 1-2 two-position two-way valve, the oil outlet 143*a* of the 1-3 two-position two-way valve and the oil drain port 3*b* of the first control module are connected to each other. The oil inlet of the 1-1 two-position two-way valve 141*b* connects with the fifth drive port 3*k* of the first control module, the oil inlet 142*b* of the 1-2 two-position two-way valve connects with the sixth drive port 3*m* of the first control module, and the oil inlet 143*b* of the 1-3 two-position two-way valve connects with the seventh drive port 3*n* of the first control module.

Figure 6:
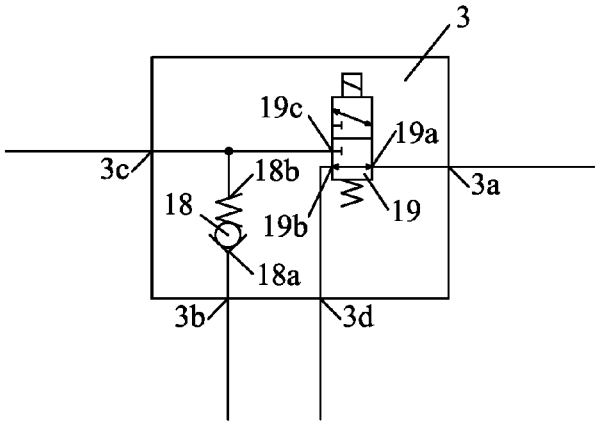
FIG. 6 is a first kind of structure diagram of the first control module of the fully variable valve system of the non-independent oil drain valve controlled on the oil supply side.
Figure 7:
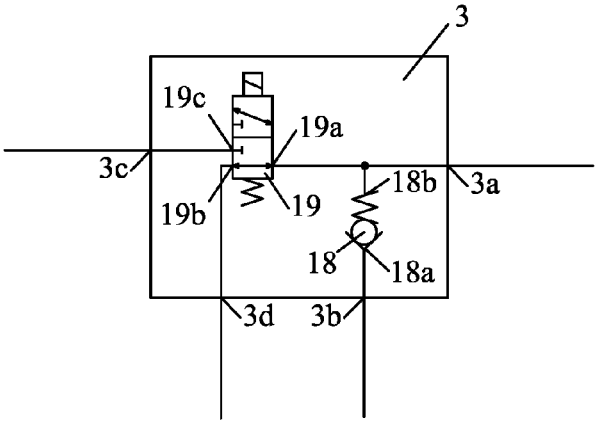
FIG. 7 is a $2^{nd}$ kind of structure diagram of the first control module of the fully variable valve system of the non-independent oil drain valve controlled on the oil supply side.

FIG. 6 and FIG. 7 are diagrams of the first and second structures of the first control module of the fully variable valve system of the non-independent oil drain valve controlled on the oil supply side respectively. The first control module 3 comprises the first check valve 18 and the first two-position three-way valve 19. The oil inlet 18*a* of the first check valve connects with the oil drain port 3*b* of the first control module, the oil supply port 19*a* of the first two-position three-way valve connects with the first oil supply port 3*a* of the first control module, and the oil delivery port 19*b* of the first two-position three-way valve connects with the oil delivery port 3*d* of the first control module. The drive port 19*c* of the first two-position three-way valve connects with the first drive port 3*c* of the first control module, and the oil outlet 18*b* of the first check valve connects with the oil supply port 19*a* of the first two-position three-way valve or the drive port 19*c* of the first two-position three-way valve.

Figure 8:
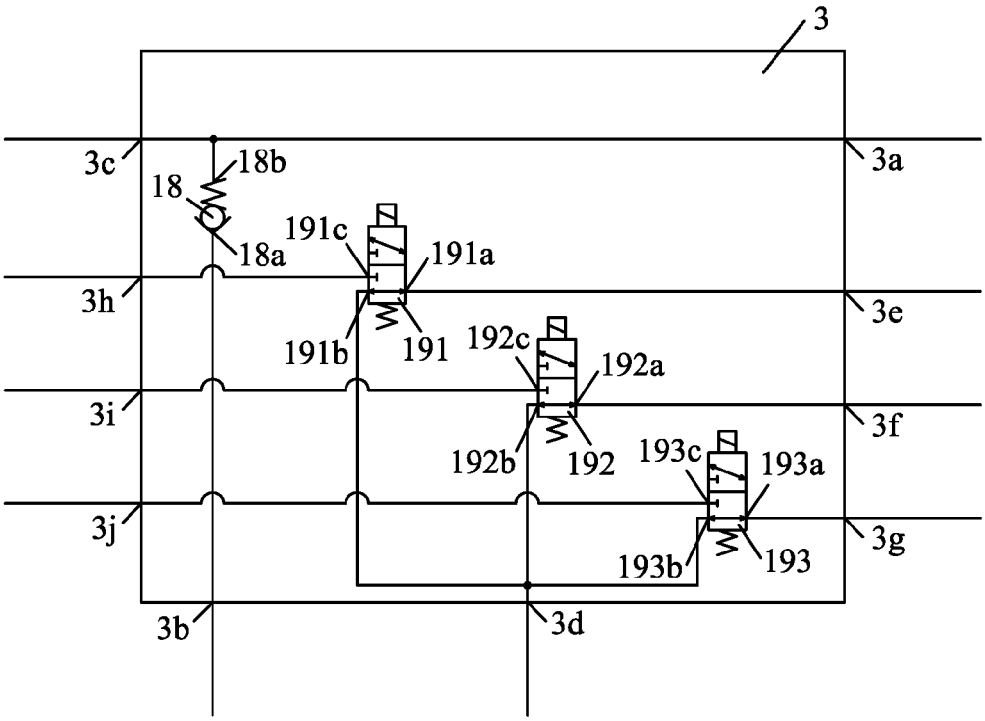
FIG. 8 is a diagram of a first control module of the fully variable valve system of the non-independent oil drain valve controlled on the valve side.

FIG. 8 is a diagram of a first control module of the fully variable valve system of the non-independent oil drain valve controlled on the valve side. The first control module 3 comprises the first check valve 18, the 1-1 two-position three-way valve 191, the 1-2 two-position three-way valve 192 and the 1-3 two-position three-way valve 193. The oil inlet 18*a* of the first check valve connects with the oil drain port 3*b* of the first control module. The oil outlet 18*b* of the first check valve, the first oil supply port 3*a* of the first control module and the first drive port 3*c* of the first control module are connected to each other. The oil delivery port

191*b* of the 1-1 two-position three-way valve, the oil delivery port 192*b* of the 1-2 two-position three-way valve, the oil delivery port 193*b* of the 1-3 two-position three-way valve and the oil delivery port 3*d* of the first control module are connected to each other. The oil supply port of the 1-1 two-position three-way valve 191*a* connects with the second oil supply port 3*e* of the first control module, the oil supply port of the 1-2 two-position three-way valve 192*a* connects with the third oil supply port 3*f* of the first control module, and the oil supply port of the 1-3 two-position three-way valve 193*a* connects with the fourth oil supply port 3*g* of the first control module. The drive port of the 1-1 two-position three-way valve 191*c* connects with the second drive port 3*h* of the first control module, the drive port of the 1-2 two-position three-way valve 192*c* connects with the third drive port 3*i* of the first control module, and the drive port of the 1-3 two-position three-way valve 193*c* connects with the fourth drive port 3*j* of the first control module.

Figure 9:
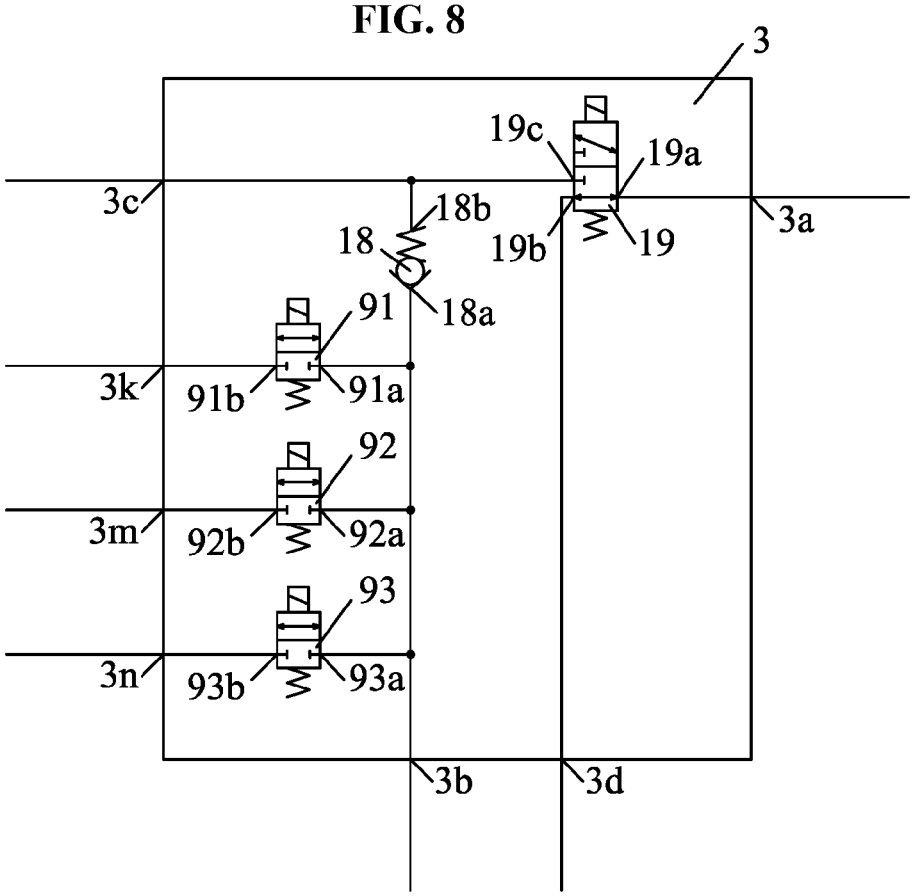
FIG. 9 is a first kind of structure diagram of the first control module of the fully variable valve system of the independent oil drain valve controlled on the oil supply side.
Figure 10:
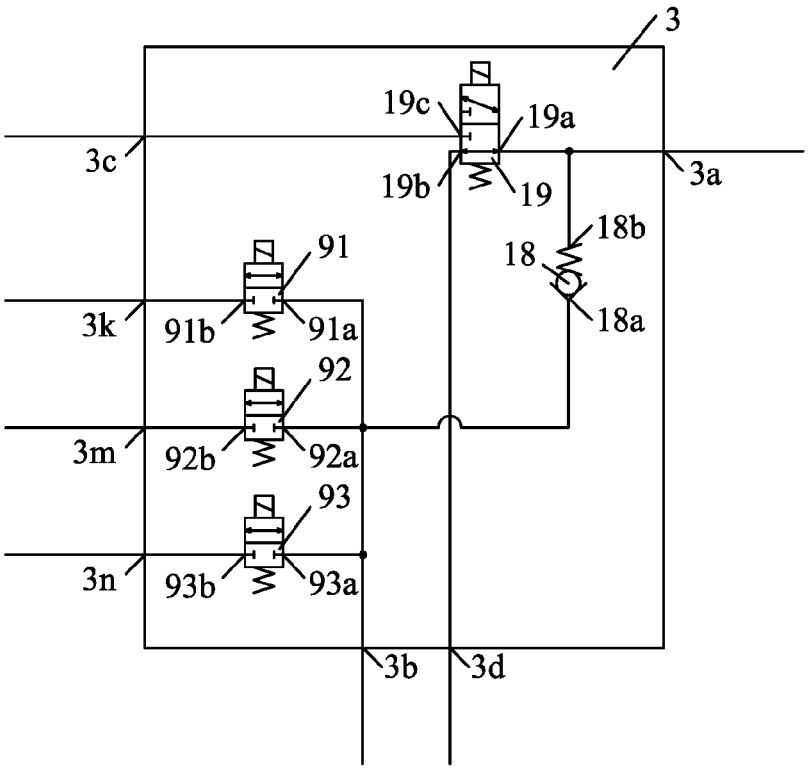
FIG. 10 is a second kind of structure diagram of the first control module of the fully variable valve system of the independent oil drain valve controlled on the oil supply side.

FIG. 9 and FIG. 10 are diagrams of the first and second kinds of structures of the fully variable valve system of the independent oil drain valve controlled on the oil supply side respectively. The first control module 3 comprises the first check valve 18, the first two-position three-way valve 19, the first oil drain valve 91, the second oil drain valve 92 and the third oil drain valve 93. The oil supply port 19*a* of the first two-position three-way valve connects with the first oil supply port 3*a* of the first control module, the oil delivery port 19*b* of the first two-position three-way valve connects with the oil delivery port 3*d* of the first control module, and the drive port 19*c* of the first two-position three-way valve connects with the first drive port 3*c* of the first control module. The oil outlet 91*a* of the first oil drain valve, the oil outlet 92*a* of the second oil drain valve, the oil outlet 93*a* of the third oil drain valve, the oil inlet 18*a* of the first check valve and the oil drain port 3*b* of the first control module are connected to each other. The oil inlet 91*b* of the first oil drain valve connects with the fifth drive port 3*k* of the first control module, the oil inlet 92*b* of the second oil drain valve connects with the sixth drive port 3*m* of the first control module, and the oil inlet 93*b* of the third oil drain valve connects with the seventh drive port 3*n* of the first control module. The oil outlet 18*b* of the first check valve connects with the oil supply port 19*a* of the first two-position three-way valve or the drive port 19*c* of the first two-position three-way valve.

Figure 11:
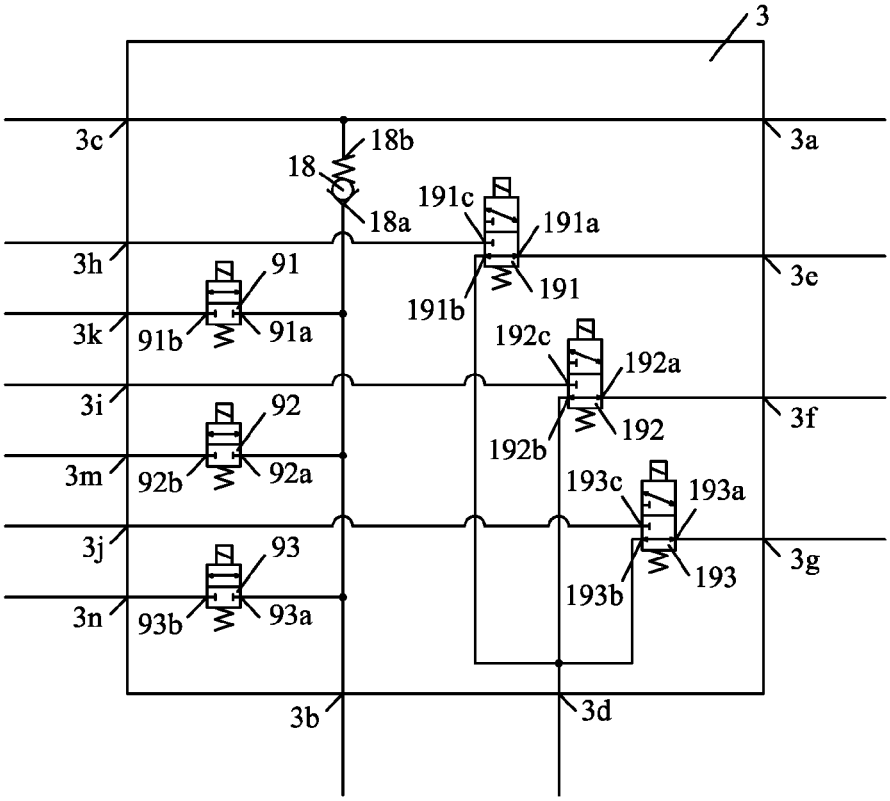
FIG. 11 is a diagram of a first control module of the fully variable valve system of the independent oil drain valve controlled on the valve side.

FIG. 11 is a diagram of a first control module of the fully variable valve system of the independent oil drain valve controlled on the valve side. The first control module 3 comprises the first check valve 18, the 1-1 two-position three-way valve 191, the 1-2 two-position three-way valve 192, the 1-3 two-position three-way valve 193, the first oil drain valve 91, the second oil drain valve 92 and the third oil drain valve 93. The oil outlet 18*b* of the first check valve, the first oil supply port 3*a* of the first control module and the first drive port 3*c* of the first control module are connected to each other. The oil delivery port 191*b* of the 1-1 two-position three-way valve, the oil delivery port 192*b* of the 1-2 two-position three-way valve, the oil delivery port 193*b* of the 1-3 two-position three-way valve and the oil delivery port 3*d* of the first control module are connected to each other. The oil supply port of the 1-1 two-position three-way valve 191*a* connects with the second oil supply port 3*e* of the first control module, the oil supply port of the 1-2 two-position three-way valve 192*a* connects with the third oil supply port 3*f* of the first control module, and the oil supply port of the 1-3 two-position three-way valve 193*a* connects with the fourth oil supply port 3*g* of the first control module. The drive port of the 1-1 two-position three-way valve 191*c* connects with the second drive port 3*h* of the first control module, the drive port of the 1-2 two-position three-way valve 192*c* connects with the third drive port 3*i* of the first control module, and the drive port of the 1-3 two-position three-way valve 193*c* connects with the fourth drive port 3*j* of the first control module. The oil outlet 91*a* of the first oil drain valve, the oil outlet 92*a* of the second oil drain valve, the oil outlet 93*a* of the third oil drain valve, the oil inlet 18*a* of the first check valve and the oil drain port 3*b* of the first control module are connected to each other. The oil inlet 91*b* of the first oil drain valve connects with the fifth drive port 3*k* of the first control module, the oil inlet 92*b* of the second oil drain valve connects with the sixth drive port 3*m* of the first control module, and the oil inlet 93*b* of the third oil drain valve connects with the seventh drive port 3*n* of the first control module.

Figure 12:
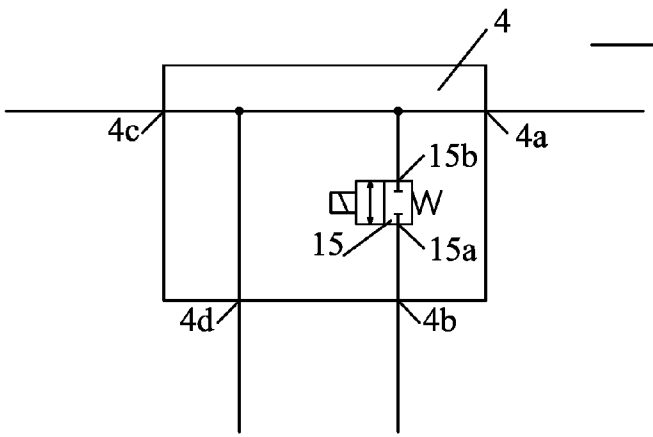
FIG. 12 is a diagram of the second control module of the continuously variable valve system controlled on the oil supply side.

FIG. 12 is a diagram of the second control module of the continuously variable valve system controlled on the oil supply side. The second control module 4 comprises the a second two-position two-way valve 15. The oil outlet 15*a* of the second two-position two-way valve connects with the oil drain port 4*b* of the second control module. The oil inlet 15*b* of the second two-position two-way valve, the first oil supply port 4*a* of the second control module, the first drive port 4*c* of the second control module and the oil delivery port 4*d* of the second control module are connected to each other.

Figure 13:
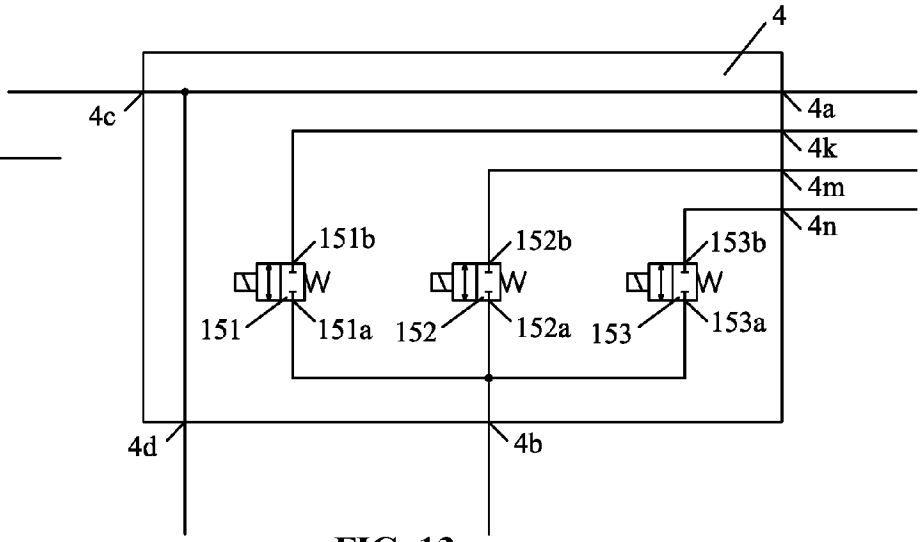
FIG. 13 is a diagram of the second control module of the continuously variable valve system controlled on the valve side.

FIG. 13 is a diagram of the second control module of the continuously variable valve system controlled on the valve side. The second control module 4 comprises the 2-1 two-position two-way valve 151, the 2-2 two-position two-way valve 152 and the 2-3 two-position two-way valve 153. The first oil supply port 4*a* of the second control module, the first drive port 4*c* of the second control module and the oil delivery port 4*d* of the second control module are connected to each other. The oil outlet 151*a* of the 2-1 two-position two-way valve, the oil outlet 152*a* of the 2-2 two-position two-way valve, the oil outlet 153*a* of the 2-3 two-position two-way valve and the oil drain port 4*b* of the second control module are connected to each other. The oil inlet of the 2-1 two-position two-way valve 151*b* connects with the fifth drive port 4*k* of the 2nd control module, the oil inlet 152*b* of the 2-2 two-position two-way valve connects with the sixth drive port 4*m* of the second control module, and the oil inlet 153*b* of the 2-3 two-position two-way valve connects with the seventh drive port 4*n* of the second control module.

Figure 14:
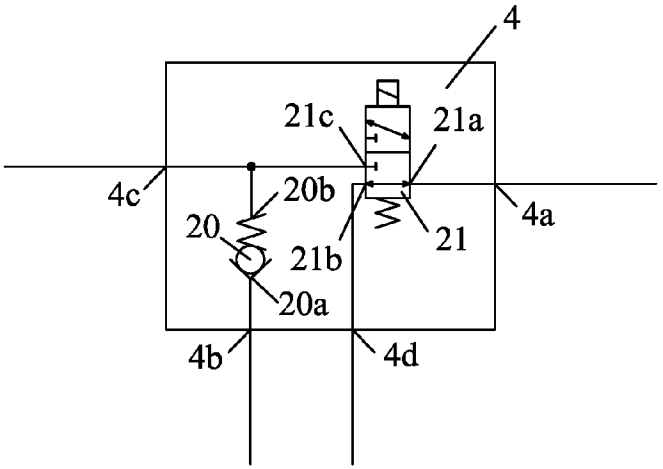
FIG. 14 is a first kind of structure diagram of the second control module of the fully variable valve system of the non-independent oil drain valve controlled on the oil supply side.
Figure 15:
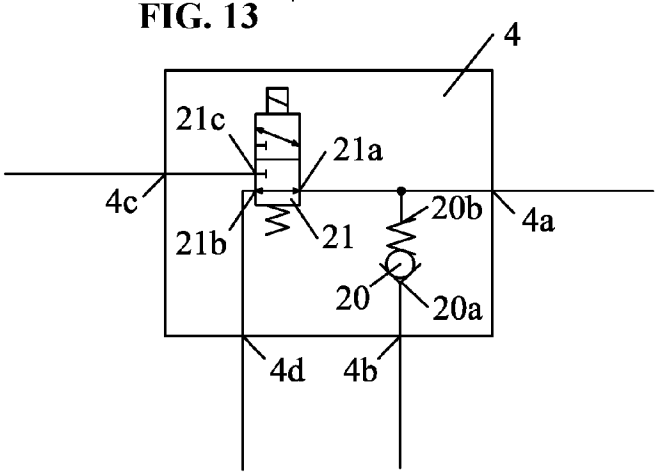
FIG. 15 is a second kind of structure diagram of the second control module of the fully variable valve system of the non-independent oil drain valve controlled on the oil supply side.

FIG. 14 and FIG. 15 are diagrams of the first and second kinds of structures of the second control module of the fully variable valve system of the non-independent oil drain valve controlled on the oil supply side respectively. The second control module 4 comprises the second check valve 20 and the a second two-position three-way valve 21. The oil inlet 20*a* of the second check valve connects with the oil drain port 4*b* of the second control module, the oil supply port 21*a* of the second two-position three-way valve connects with the first oil supply port 4*a* of the second control module, and the oil delivery port 21*b* of the second two-position three-way valve connects with the oil delivery port 4*d* of the second control module. The drive port 21*c* of the second two-position three-way valve connects with the first drive port 4*c* of the second control module, and the oil outlet 20*b* of the second check valve connects with the oil supply port 21*a* of the second two-position three-way valve or the drive port 21*c* of the second two-position three-way valve.

Figure 16:
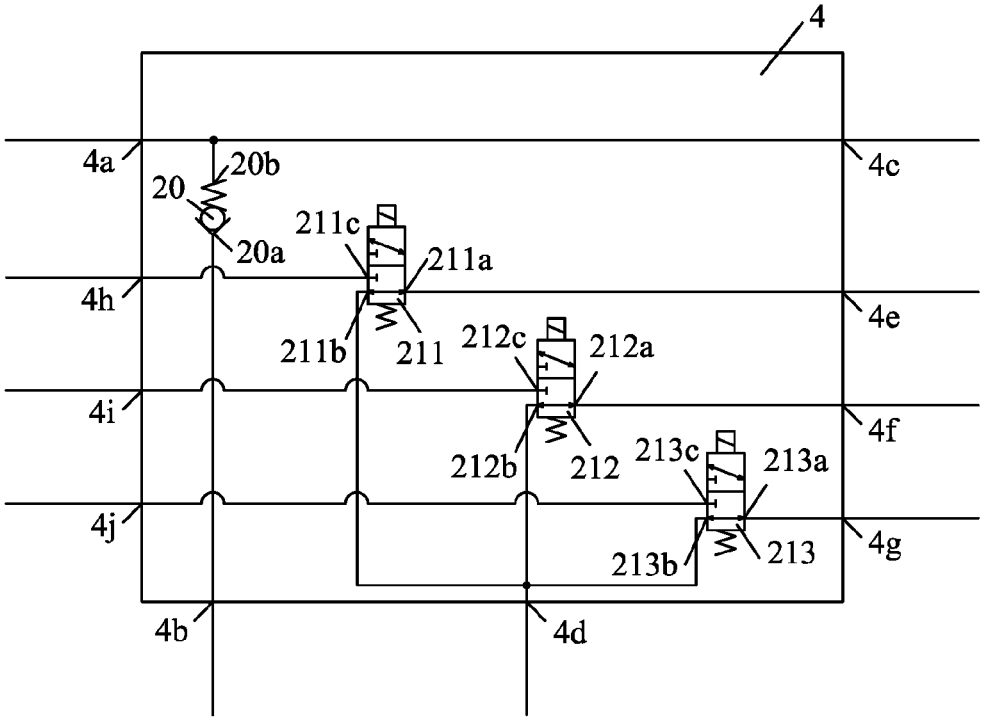
FIG. 16 is a diagram of the second control module of the fully variable valve system of the non-independent oil drain valve controlled on the valve side.

FIG. 16 is a diagram of the second control module of the fully variable valve system of the non-independent oil drain valve controlled on the valve side. The second control module 4 comprises the second check valve 20, the 2-1 two-position three-way valve 211, the 2-2 two-position three-way valve 212 and the 2-3 two-position three-way valve 213. The oil inlet 20*a* of the second check valve connects with the oil drain port 4*b* of the second control module. The oil outlet 20*b* of the second check valve, the first oil supply port 4*a* of the second control module and the first drive port 4*c* of the second control module are connected to each other. The oil delivery port 211*b* of the 2-1 two-position three-way valve, the oil delivery port 212*b* of the 2-2 two-position three-way valve, the oil delivery port 213*b* of the 2-3 two-position three-way valve and the oil delivery port 4*d* of the second control module are connected to each other. The oil supply port 211*a* of the 2-1 two-position three-way valve connects with the second oil supply port 4*e* of the second control module, the oil supply port 212*a* of the 2-2 two-position three-way valve connects with the third oil supply port 4*f* of the second control module, and the oil supply port 213*a* of the 2-3 two-position three-way valve connects with the fourth oil supply port 4*g* of the second control module. The drive port 211*c* of the 2-1 two-position three-way valve connects with the second drive port 4*h* of the second control module, the drive port 212*c* of the 2-2 two-position three-way valve connects with the third drive port 4*i* of the second control module, and the drive port 213*c* of the 2-3 two-position three-way valve connects with the fourth drive port 4*j* of the second control module.

Figure 17:
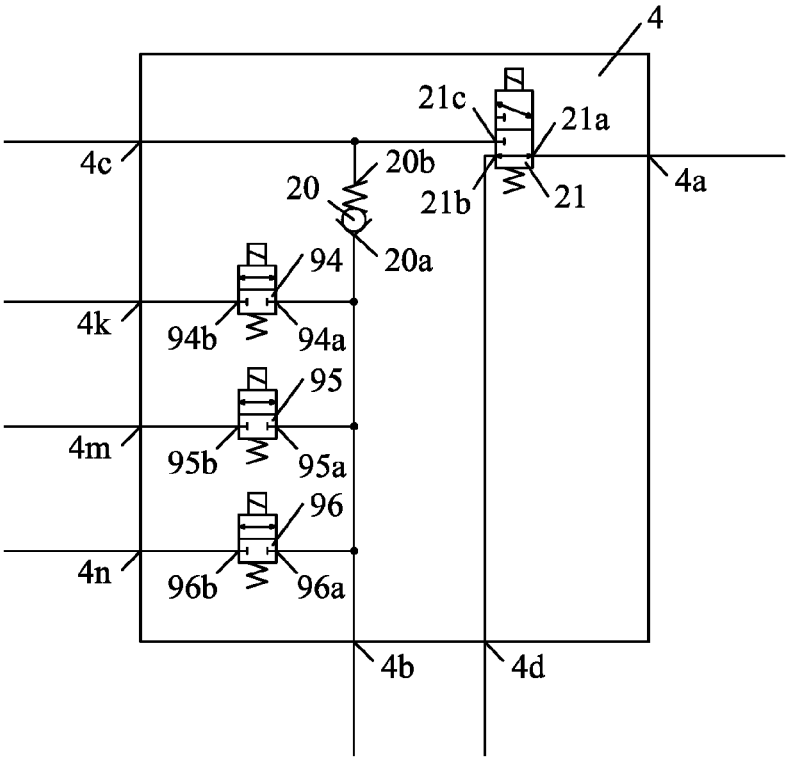
FIG. 17 is a first kind of structure diagram of the second control module of the fully variable valve system of the independent oil drain valve controlled on the oil supply side.
Figure 18:
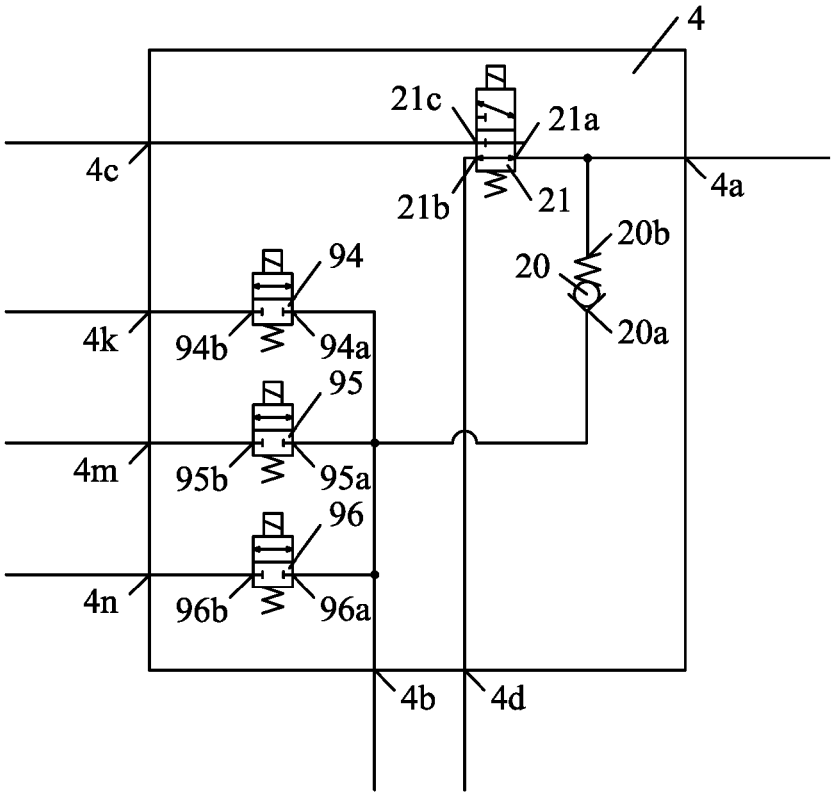
FIG. 18 is a second structure diagram of the second control module of the fully variable valve system of the independent oil drain valve controlled on the oil supply side.

FIG. 17 and FIG. 18 the diagrams of the first and second kinds of structures of the second control module of the fully variable valve system of the independent oil drain valve controlled on the oil supply side respectively. The second control module 4 comprises the second check valve 20, the a second two-position three-way valve 21, the fourth oil drain valve 94, the fifth oil drain valve 95 and the sixth oil drain valve 96. The oil supply port 21*a* of the second two-position three-way valve connects with the first oil supply port 4*a* of the second control module, the oil delivery port 21*b* of the second two-position three-way valve connects with the oil delivery port 4*d* of the second control module, and the drive port 21*c* of the second two-position three-way valve connects with the first drive port 4*c* of the second control module. The oil outlet 94*a* of the fourth oil drain valve, the oil outlet 95*a* of the fifth oil drain valve, the oil outlet 96*a* of the sixth oil drain valve, the oil inlet 20*a* of the second check valve and the oil drain port 4*b* of the second control module are connected to each other. The oil inlet 94*b* of the fourth oil drain valve connects with the fifth drive port 4*k* of the second control module, the oil inlet 95*b* of the fifth oil drain valve connects with the sixth drive port 4*m* of the second control module, and the oil inlet 96*b* of the sixth oil drain valve connects with the seventh drive port 4*n* of the second control module. The oil outlet 20*b* of the second check valve connects with the oil supply port 21*a* of the second two-position three-way valve or the drive port 21*c* of the second two-position three-way valve.

Figure 19:
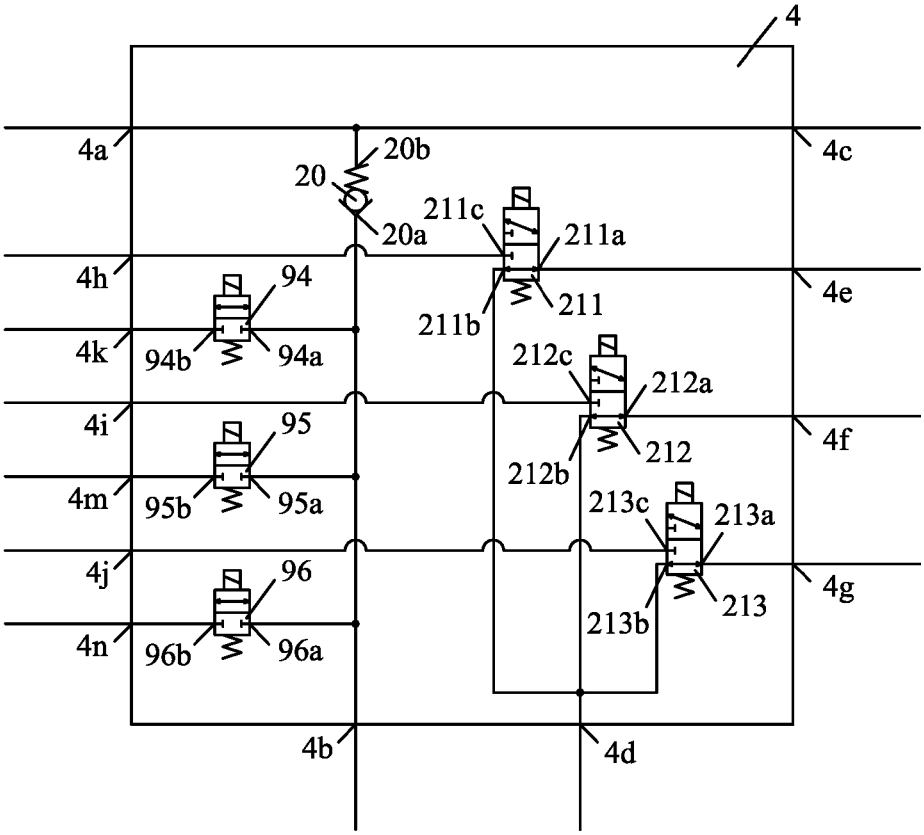
FIG. 19 is a diagram of the second control module of the fully variable valve system of the independent oil drain valve controlled on the valve side.
Figure 20:
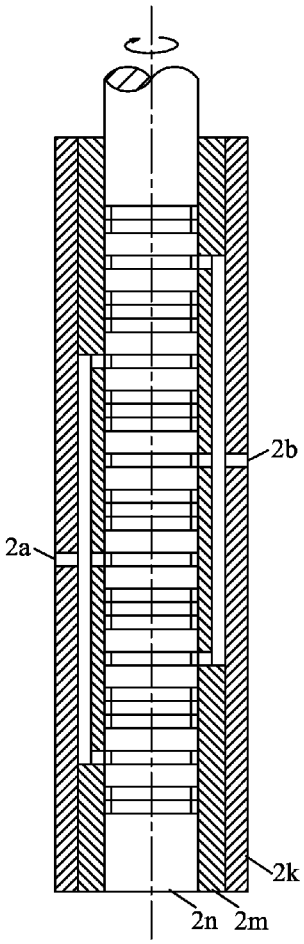
FIG. 20 is a front view of the phase limit module.
Figure 21:
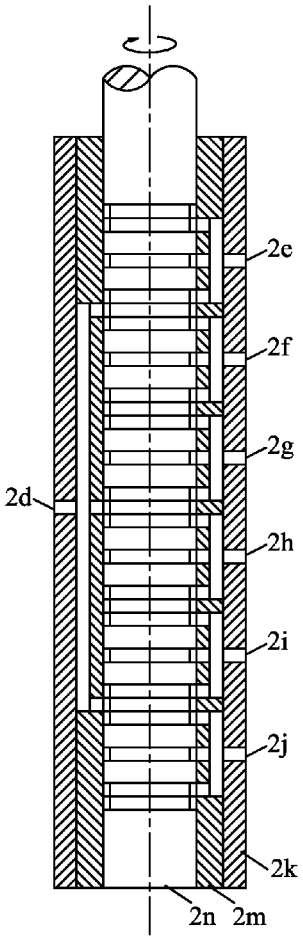
FIG. 21 is a left view of the phase limit module.
Figure 22:
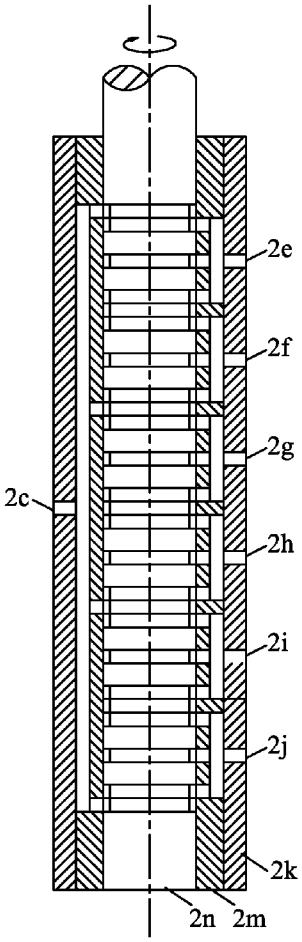
FIG. 22 is a section view of the first oil drain port of the phase limit module.
Figure 23:
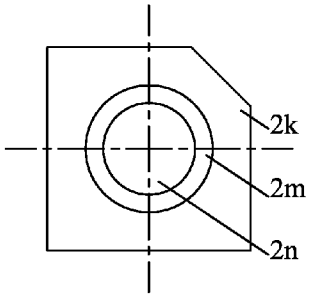
FIG. 23 is a top view of the phase limit module.
Figure 24:
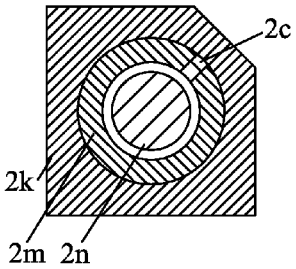
FIG. 24 is a cross-section view of the phase limit module A-A.
Figure 25:
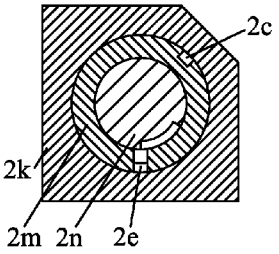
FIG. 25 is a cross-section view of the phase limit module B-B.
Figure 26:
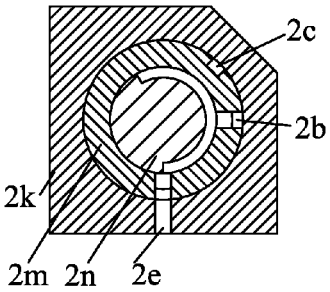
FIG. 26 is a cross-section view of the phase limit module C-C.
Figure 27:
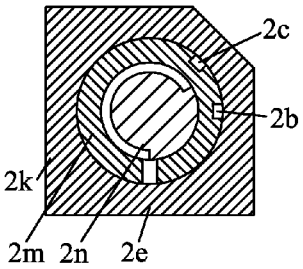
FIG. 27 is a cross-section view of the phase limit module D-D.
Figure 28:
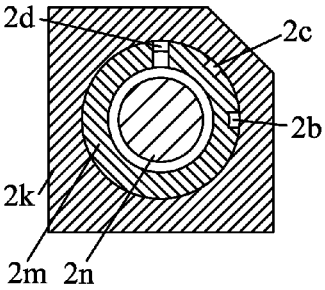
FIG. 28 is a cross-section view of the phase limit module E-E.
Figure 29:
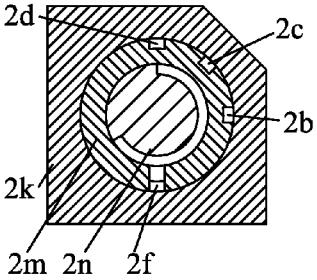
FIG. 29 is a cross-section view of the phase limit module F-F.
Figure 30:
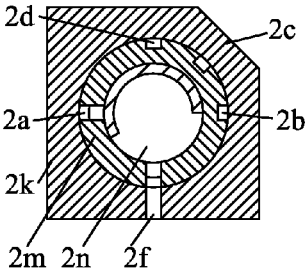
FIG. 30 is a cross-section view of the phase limit module G-G
Figure 31:
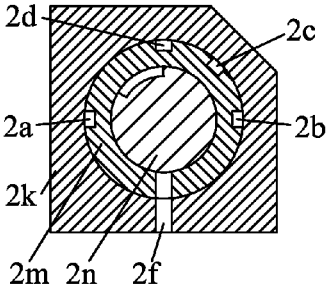
FIG. 31 is a cross-section view of the phase limit module H-H.
Figure 32:
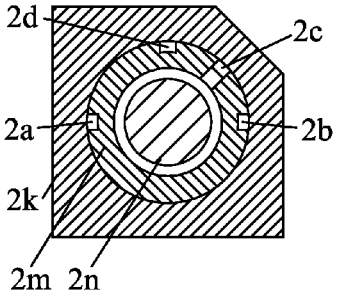
FIG. 32 is a cross-section view of the phase limit module I-I.
Figure 33:
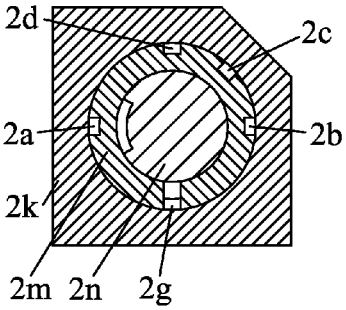
FIG. 33 is a cross-section view of the phase limit module J-J.
Figure 34:
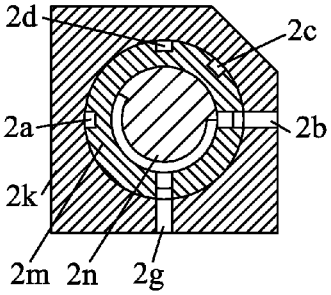
FIG. 34 is a cross-section view of the phase limit module K-K.
Figure 35:
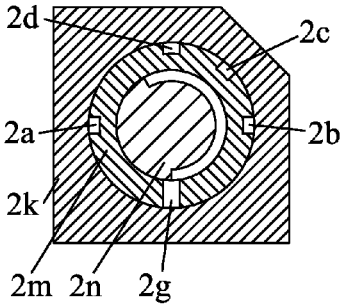
FIG. 35 is a cross-section view of the phase limit module L-L.
Figure 36:
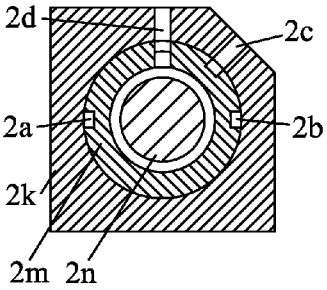
FIG. 36 is a cross-section view of the phase limit module M-M.
Figure 37:
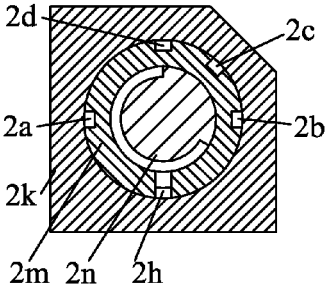
FIG. 37 is a cross-section view of the phase limit module N-N.
Figure 38:
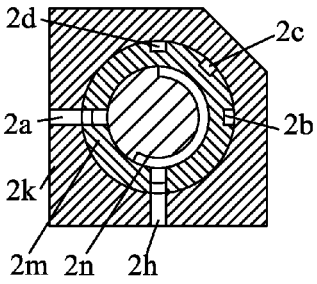
FIG. 38 is a cross-section view of the phase limit module O-O.
Figure 39:
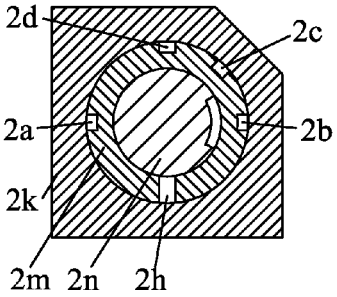
FIG. 39 is a cross-section view of the phase limit module P-P.
Figure 40:
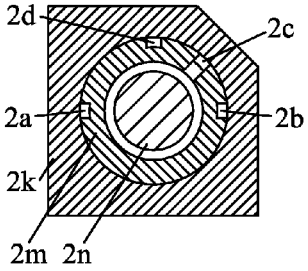
FIG. 40 is a cross-section view of the phase limit module Q-Q.
Figure 41:
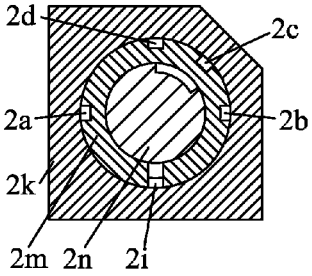
FIG. 41 is a cross-section view of the phase limit module R-R.
Figure 42:
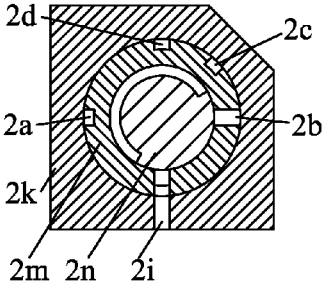
FIG. 42 is a cross-section view of the phase limit module S-S.
Figure 43:
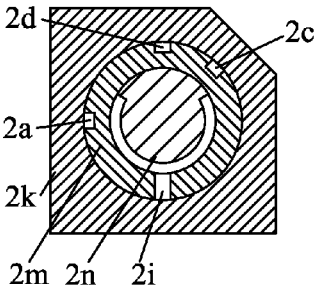
FIG. 43 is a cross-section view of the phase limit module T-T.
Figure 44:
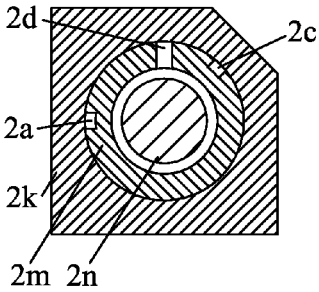
FIG. 44 is a cross-section view of the phase limit module U-U.
Figure 45:
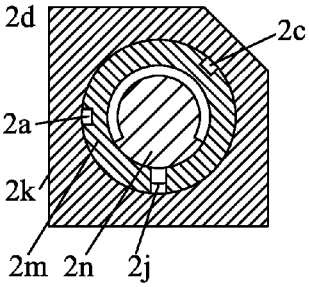
FIG. 45 is a cross-section view of the phase limit module V-V.
Figure 46:
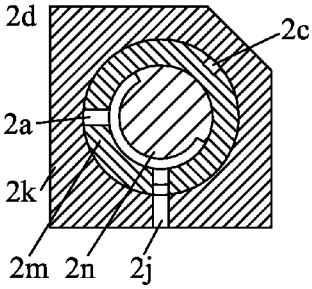
FIG. 46 is a cross-section view of the phase limit module W-W.
Figure 47:
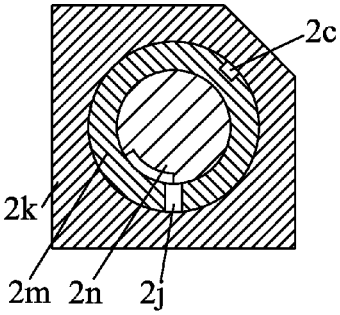
FIG. 47 is a cross-section view of the phase limit module X-X.
Figure 48:
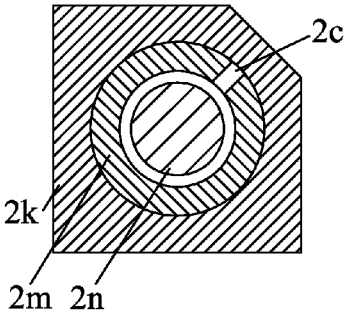
FIG. 48 is a cross-section view of the phase limit module Y-Y.
Figure 49:
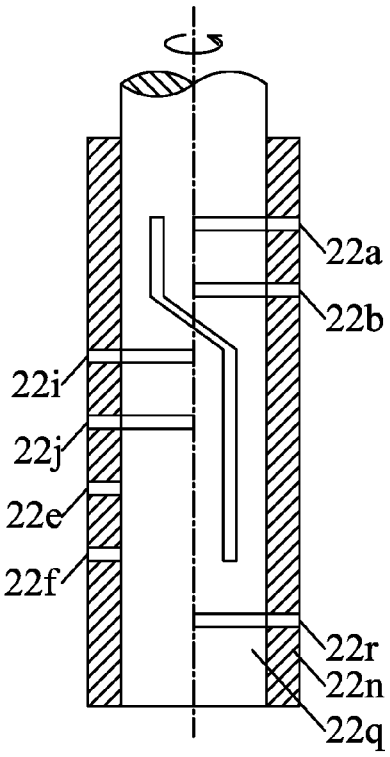
FIG. 49 is a front view of the rotary mode selection module for the supply-for-supply & brake-for-brake mode.
Figure 50:
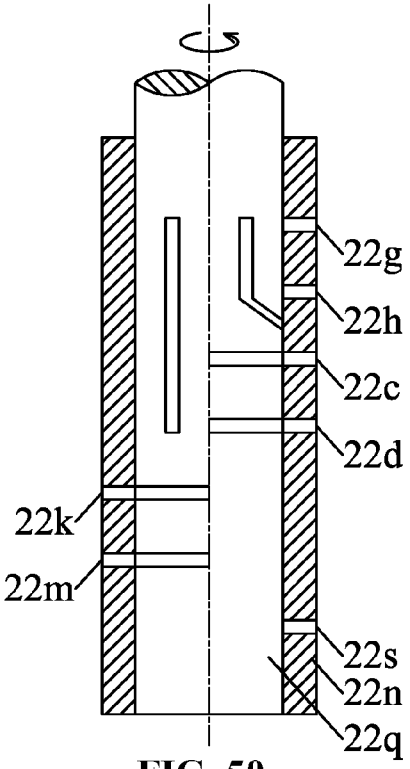
FIG. 50 is a left view of the rotary mode selection module for the supply-for-supply & brake-for-brake mode.
Figure 51:
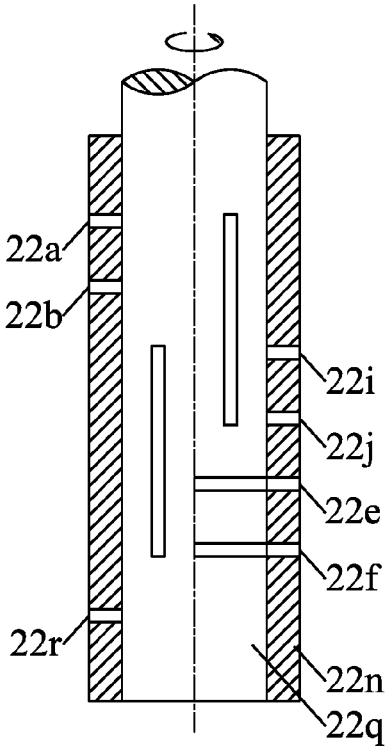
FIG. 51 is a rear view of the rotary mode selection module for the supply-for-supply & brake-for-brake mode.
Figure 52:
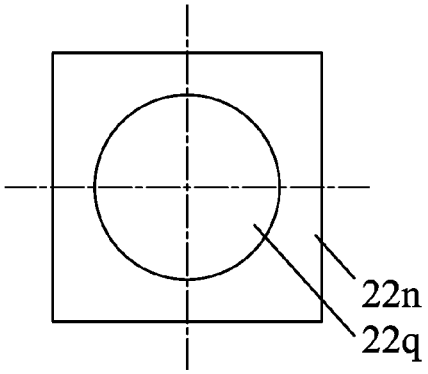
FIG. 52 is a top view of the rotary mode selection module for the supply-for-supply & brake-for-brake mode.
Figure 53:
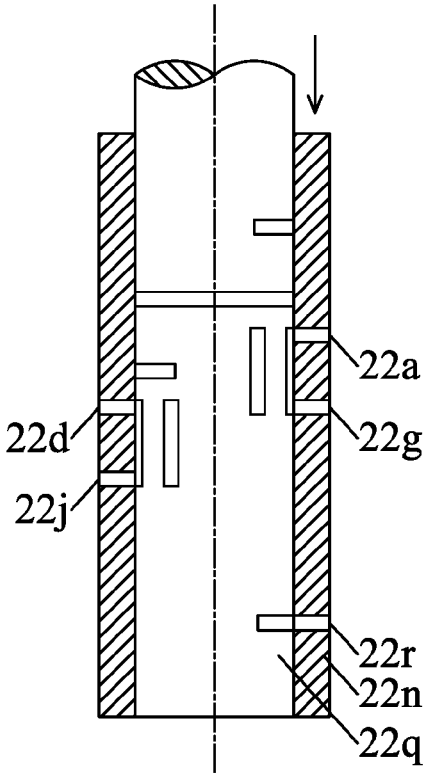
FIG. 53 is a front view of the mode selection module for the direct-acting supply-for-supply & brake-for-brake mode of the supply-for-supply & brake-for-brake mode.
Figure 54:
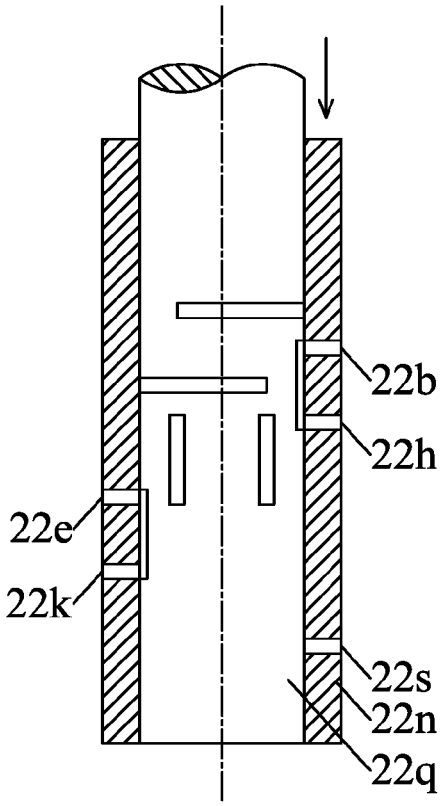
FIG. 54 is a vertical section view of the second oil supply port of the direct-acting mode selection module for the supply-for-supply & brake-for-brake mode.
Figure 55:
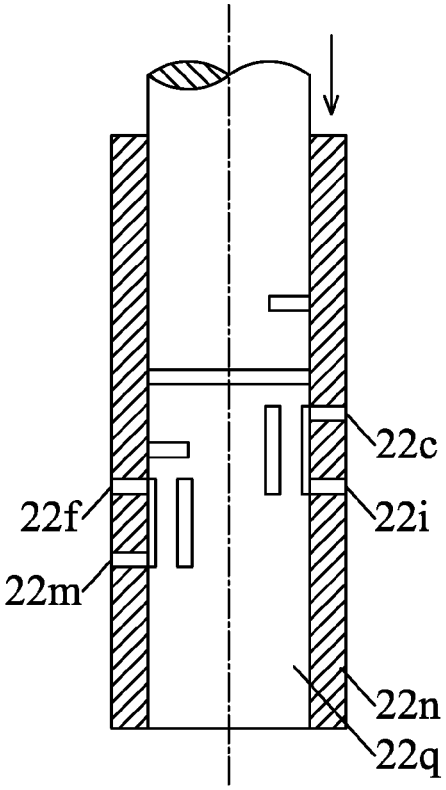
FIG. 55 is a vertical section view of the third oil supply port of the direct-acting mode selection module for the supply-for-supply & brake-for-brake mode.
Figure 56:
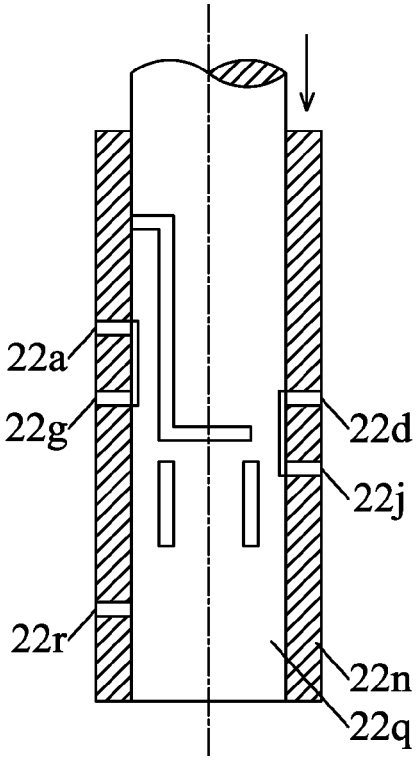
FIG. 56 is a rear view of the direct-acting mode selection module for the supply-for-supply & brake-for-brake mode.
Figure 57:
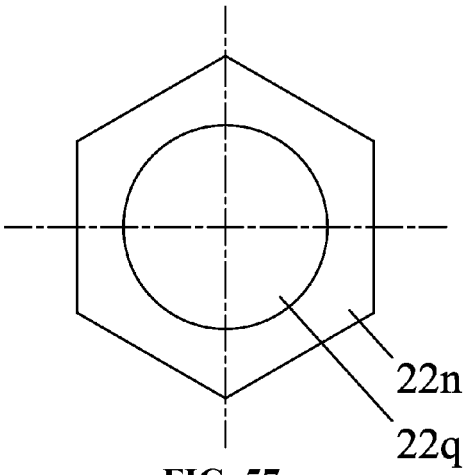
FIG. 57 is a top view of the direct-acting mode selection module for the supply-for-supply & brake-for-brake mode.

FIG. 19 is a diagram of the second control module of the fully variable valve system of the independent oil drain valve controlled on the valve side. The second control module 4 comprises the second check valve 20, the 2-1 two-position three-way valve 211, the 2-2 two-position three-way valve 212, the 2-3 two-position three-way valve 213, the fourth oil drain valve 94, the fifth oil drain valve 95 and the sixth oil drain valve 96. The oil outlet 20*b* of the second check valve, the first oil supply port 4*a* of the second control module and the first drive port 4*c* of the second control module are connected to each other. The oil delivery port 211*b* of the 2-1 two-position three-way valve, the oil delivery port 212*b* of the 2-2 two-position three-way valve, the oil delivery port 213*b* of the 2-3 two-position three-way valve and the oil delivery port 4*d* of the second control module are connected to each other. The oil supply port 211*a* of the 2-1 two-position three-way valve connects with the second oil supply port 4*e* of the second control module, the oil supply port 212*a* of the 2-2 two-position three-way valve connects with the third oil supply port 4*f* of the second control module, and the oil supply port 213*a* of the 2-3 two-position three-way valve connects with the fourth oil supply port 4*g* of the second control module. The drive port 211*c* of the 2-1 two-position three-way valve connects with the second drive port 4*h* of the second control module, the drive port 212*c* of the 2-2 two-position three-way valve connects with the third drive port 4*i* of the second control module, and the drive port 213*c* of the 2-3 two-position three-way valve connects with the fourth drive port 4*j* of the second control module. The oil outlet 94*a* of the fourth oil drain valve, the oil outlet 95*a* of the fifth oil drain valve, the oil outlet 96*a* of the sixth oil drain valve, the oil inlet 20*a* of the second check valve and the oil drain port 4*b* of the second control module are connected to each other. The oil inlet 94*b* of the fourth oil drain valve connects with the fifth drive port 4*k* of the second control module, the oil inlet 95*b* of the fifth oil drain valve connects with the sixth drive port 4*m* of the second control module, and the oil inlet 96*b* of the sixth oil drain valve connects with the seventh drive port 4*n* of the second control module.

Take the six-cylinder internal combustion engine with the sequence of 1-5-3-6-2-4 as an example, the phase limit module 2 and the mode selection module 22 are designed. For the phase limit module 2 of the six-cylinder internal combustion engine with the sequence of 1-4-2-6-3-5, it is only necessary to adjust the opening angle of each oil port section of the phase limit module spindle 2*n* on the basis of the phase limit module 2 accordingly. Or for the internal combustion engine with the brake mode, it is necessary to change the connection object of the oil path between the phase limit module 2 and the mode selection module 22. For the internal combustion engine without the brake mode, it is only necessary to change the connection object of the oil path between the phase limit module 2 and the valve actuation module of each cylinder, but repeated work is not needed.

FIG. 20-FIG. 23 are the front view and left view of the phase limit module as well as the section view and top view of the first oil drain port respectively. FIG. 24-FIG. 48 are cross section views of various oil ports on the phase limit module respectively. For the internal combustion engine of the continuously variable valve event, the first oil drain port 2*c* of the phase limit module and its cross sections are cancelled. In other words, FIG. 24-FIG. 25, FIG. 31-FIG. 33, FIG. 39-FIG. 41 and FIG. 47-FIG. 48 are cancelled.

According the requirement of the six-cylinder internal combustion engine for the valve open/close event under the drive mode, the relations of the first oil supply module 6, the second oil supply module 5, the valve actuation modules of each cylinder and the oil tank 8 with crank angle are figured out. See Table 1. Please note that the rough relations under the actual operating condition of the internal combustion engine are not considered in Table 1. In the actual application, data in Table 1 shall be corrected according to the actual requirement of the internal combustion engine. For the internal combustion engine with the continuously variable valve event, the direct relation with the oil tank 8 is cancelled.

TABLE 1

Connection relations of the first oil supply module 6, the second oil supply module 5, valve actuation modules of all cylinders and oil tank 8 with the crank angle under the drive mode

| | Connection Range | | | |
|---|---|---|---|---|
| | The first oil supply module 6 | The second oil supply module 5 | Oil tank 8 (Direct) | Oil tank 8 (Indirect) |
| Valve actuation module of one-cylinder | 0°-240° | | 240°-720° | 0°-120° |
| Valve actuation module of two-cylinder | 480°-720° | | 0°-480° | 480°-600° |
| Valve actuation module of three-cylinder | 240°-480° | | −240°-240° | 240°-360° |
| Valve actuation module of four-cylinder | | −120°-120° | 120°-600° | 600°-720° |
| Valve actuation module of five-cylinder | | 120°-360° | −360°-120° | 120°-240° |
| Valve actuation module of six-cylinder | | 360°-600° | −120°-360° | 360°-480° |

According to the relations of various parts in Table 1, the phase limit module 2 comprises the three-layer nested structure. From the exterior to the interior, there are the phase limit module housing 2*k* with an oil opening, the phase limit module sleeve 2*m* notched and tapped axially and the phase limit module axle spindle 2*n* notched radially. Thereof, the phase limit module spindle 2*n* is actuated by the crankshaft of the internal combustion engine through the gear or chain wheel transmission mechanism, the crank angle rotates a cycle every 720°, and the phase limit module sleeve 2*m* is nested and fixed inside the phase limit module housing 2*k* and rotates constantly with the phase limit module spindle 2*n* according to the ignition sequence of the internal combustion engine. With the constant rotation of the phase limit module spindle 2*n*, each oil port is connected or disconnected through the axial notch of the phase limit module spindle 2*n* and the notch or the axial opening of the phase limit module sleeve 2*m* according to requirements in Table 1. See Table 2 for the relation of each oil port of the phase limit module 2 with the crank angle and see Table 3 for its relation with the phase limit module angle. For the internal combustion engine with the continuously variable valve event, the first oil drain port 2*c* of the phase limit module is cancelled.

TABLE 2

Connection relations of all ports on phase limit module 2 with crank angle

| | Connection Range | | | |
|---|---|---|---|---|
| | The first oil supply port 2b | The second oil supply port 2a | The second oil drain port 2d | The second oil drain port 2c |
| The first drive port 2e | 0°-240° | | 240°-720° | 0°-120° |
| The third drive port 2g | 480°-720° | | 0°-480° | 480°-600° |
| The fifth drive port 2i | 240°-480° | | −240°-240° | 240°-360° |

TABLE 2-continued

Connection relations of all ports on phase limit module 2 with crank angle

| | Connection Range | | | |
|---|---|---|---|---|
| | The first oil supply port 2b | The second oil supply port 2a | The second oil drain port 2d | The second oil drain port 2c |
| The sixth drive port 2j | | −120°-120° | 120°-600° | 600°-720° |
| The fourth drive port 2h | | 120°-360° | −360°-120° | 120°-240° |
| The second drive port 2f | | 360°-600° | −120°-360° | 360°-480° |

TABLE 3

Connection relations of all ports on phase limit module 2 with phase limit angle

| | Connection Range | | | |
|---|---|---|---|---|
| | The first oil supply port 2b | The second oil supply port 2a | The second oil drain port 2d | The second oil drain port 2c |
| The first drive port 2e | 0°-120° | | 120°-360° | 0°-60° |
| The third drive port 2g | 240°-360° | | 0°-240° | 240°-300° |
| The fifth drive port 2i | 120°-240° | | −120°-120° | 120°-180° |
| The sixth drive port 2j | | −60°-60° | 60°-300° | 300°-360° |
| The fourth drive port 2h | | 60°-180° | −180°-60° | 60°-120° |
| The second drive port 2f | | 180°-300° | −60°-180° | 180°-240° |

According to the valve open/close requirement of the internal combustion engine under the brake mode, when the naturally aspirated internal combustion engine with the drain-for-drain &drain-for-supply brake mode needs to brake, the valve actuation system switches on the intake valve near the TDC and the engine vents the compressed air in the cylinder along the air intake duct, so as to reduce the power of the compressed air for the piston when the piston goes down; when the engine opens the exhaust valve at the BDC and sucks air into the cylinder from the exhaust duct, so as to increase the negative power of the compressed air of the piston when the piston goes up. When the turbo-charged or naturally aspirated internal combustion engine with the supply-for-supply & brake-for-brake mode needs to brake, the valve actuation system opens the exhaust valve near the TDC and the engine vents the compressed air in the cylinder along the air intake duct, so as to reduce the power of the compressed air on the piston when the piston goes down; the engine opens the intake valve near the BDC and sucks air into the air cylinder via the intake duct, so as to increase the negative power of the compressed air for the piston when the piston goes up.

According to requirements of the six-cylinder internal combustion engine for the valve open/close event under the brake mode, the relations of the first oil supply module 6, the second oil supply module 5, the valve actuation modules of each cylinder and the oil tank 8 with crank angle are figured out. See Table 4. Please note that the rough relations under the actual operating condition of the internal combustion engine are not considered in Table 4. In the actual application, data in the table shall be corrected according to the actual requirement of the internal combustion engine. For the internal combustion engine with the continuously variable valve event, the indirect relation with the oil tank 8 is cancelled.

TABLE 4

Connection relations of the first oil supply module 6, the second oil supply module 5 and valve actuation modules of all cylinders with crank angle under the brake mode

| | Connection Range | | |
|---|---|---|---|
| | The first oil supply module 6 | The second oil supply module 5 | Oil tank 8 (indirect) |
| Supply-for-drain & drain-for-supply brake mode | | | |
| Valve actuation module of one-cylinder | 0°-240° | 360°-600° | 0°-120°&360°-480° |
| Valve actuation module of two-cylinder | 480°-720° | 120°-360° | 480°-600°&120°-240° |
| Valve actuation module of three-cylinder | 240°-480° | −120°-120° | 240°-360°&600°-720° |
| Valve actuation module of four-cylinder | 240°-480° | −120°-120° | 240°-360°&600°-720° |
| Valve actuation module of five-cylinder | 480°-720° | 120°-360° | 480°-600°&120°-240° |
| Valve actuation module of six-cylinder | 0°-240° | 360°-600° | 0°-120°&360°-480° |
| Supply-for-supply & drain-for-drain brake mode | | | |
| Valve actuation module of one-cylinder | 480°-720° | 120°-360° | 480°-600°&120°-240° |
| Valve actuation module of two-cylinder | 240°-480° | −120°-120° | 240°-360°&600°-720° |
| Valve actuation module of three-cylinder | 0°-240° | 360°-600° | 0°-120°&360°-480° |
| Valve actuation module of four-cylinder | 0°-240° | 360°-600° | 0°-120°&360°-480° |
| Valve actuation module of five-cylinder | 240°-480° | −120°-120° | 240°-360°&600°-720° |
| Valve actuation module of six-cylinder | 480°-720° | 120°-360° | 480°-600°&120°-240° |

Based on different cylinder numbers and under different modes, the first oil supply module 6, the relations of the second oil supply module 5, the valve actuation module of each cylinder and the oil tank 8 with the crank angle, and operation features of the phase limit module 2, the mode selection module 22 is designed. Table 5 shows the relation of each oil port on the selection module 22. For the four-cylinder internal combustion engine under the drive mode and the drain-for-drain & drain-for-supply brake mode, the fifth oil supply port 22*e* of the mode selection module, the sixth oil supply port 22*f* of the mode selection module, the fifth drive port 22*k* of the mode selection module and the sixth drive port 22*m* of the mode selection module are cancelled.

TABLE 5

Connection relations of all oil ports of mode selection module 22

| | |
|---|---|
| Drive mode | The oil control inlet 22r connects with the oil control outlet 22s.<br>The first oil supply port 22a connects with the first drive port 22g.<br>The second oil supply port 22b connects with the second drive port 22h.<br>The third oil supply port 22c connects with the third drive port 22i.<br>The fourth oil supply port 22d connects with the fourth drive port 22j.<br>The fourth oil supply port 22e connects with the fifth drive port 22k.<br>The sixth oil supply port 22f connects with The sixth drive port 22m. |
| Supply-for-drain & drain-for-supply brake mode | The oil control inlet 22r disconnects with the oil control outlet 22s.<br>The first oil supply port 22a, the second oil supply port 22b, the first drive port 22g and the second drive port 22h connect to each other.<br>The third oil supply port 22c, the fourth oil supply port 22d, the third drive port 22i and the fourth drive port 22j connect to each other.<br>The fourth oil supply port 22e, the sixth oil supply port 22f, the fifth drive port 22k and the sixth drive port 22m connect to each other. |
| Supply-for-supply & drain-for-drain brake mode | The oil control inlet 22r disconnects with the oil control outlet 22s.<br>The first oil supply port 22a, the second oil supply port 22b, the fifth drive port 22k and the sixth drive port 22m connect to each other.<br>The third oil supply port 22c, the fourth oil supply port 22d, the first drive port 22g and the second drive port 22h connect to each other.<br>The fourth oil supply port 22e, the sixth oil supply port 22f, the third drive port 22i and the fourth drive port 22j connect to each other. |

Figure 58:
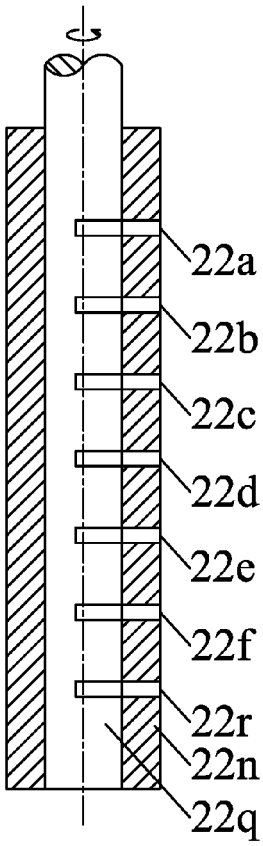
FIG. 58 is a front view of the rotary mode selection module for the drain-for-drain & drain-for-supply brake mode.
Figure 59:
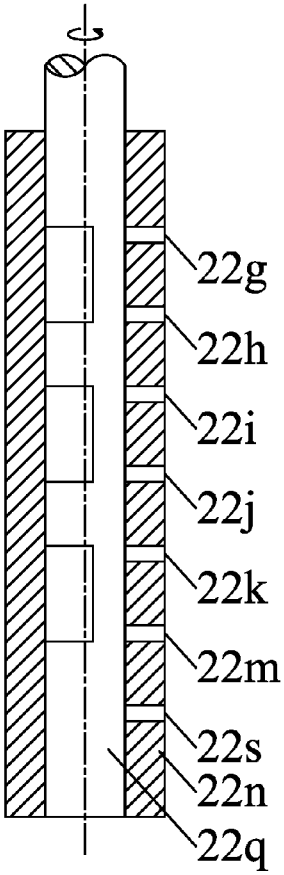
FIG. 59 is a left view of the rotary mode selection module for the drain-for-drain & drain-for-supply brake mode.
Figure 60:
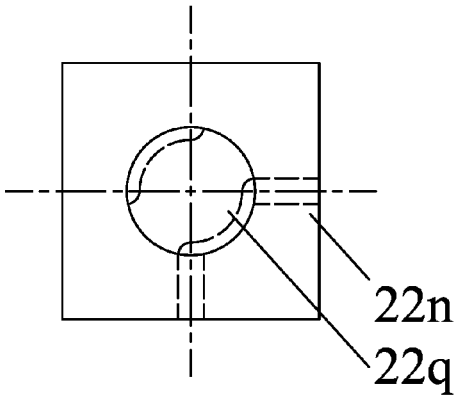
FIG. 60 is a top view of the rotary mode selection module for the drain-for-drain & drain-for-supply brake mode.
Figure 61:
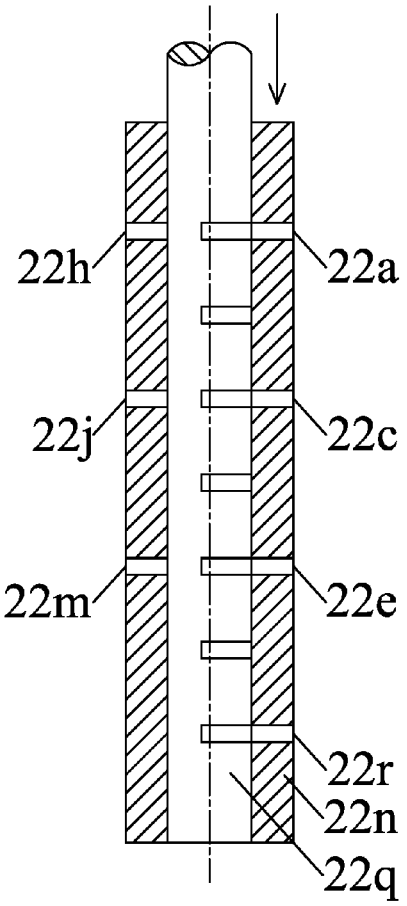
FIG. 61 is a front view of the direct-acting mode selection module for the drain-for-drain &drain-for-supply brake mode.
Figure 62:
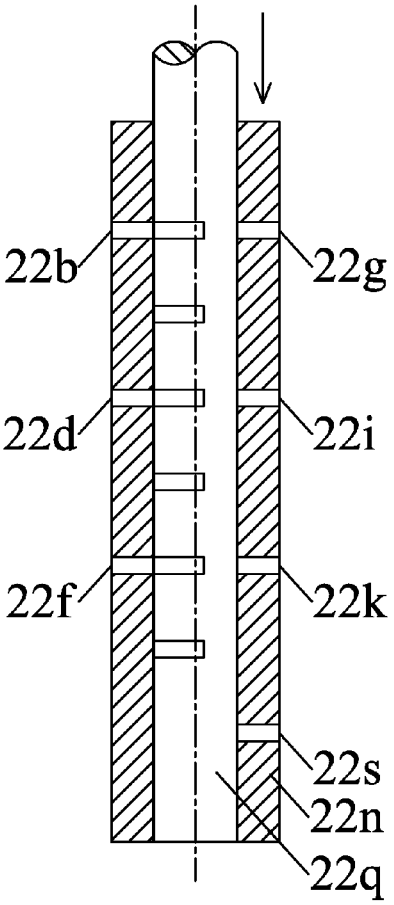
FIG. 62 is a left view of the direct-acting mode selection module for the drain-for-drain &drain-for-supply brake mode.
Figure 63:
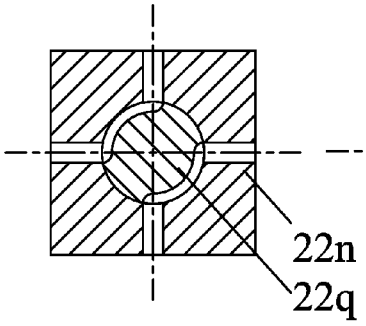
FIG. 63 is a first, $3^{rd}$ and $5^{th}$ cross section views of the direct-acting mode selection module for the drain-for-drain &drain-for-supply brake mode.
Figure 64:
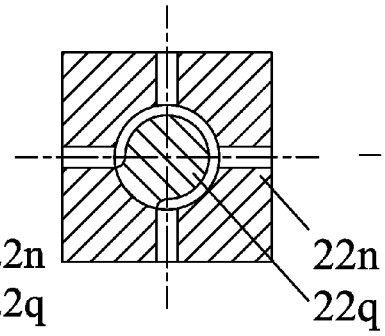
FIG. 64 is a $2^{nd}$, $4^{th}$ and $6^{th}$ cross section views of the direct-acting mode selection module for the drain-for-drain &drain-for-supply brake mode.
Figure 65:
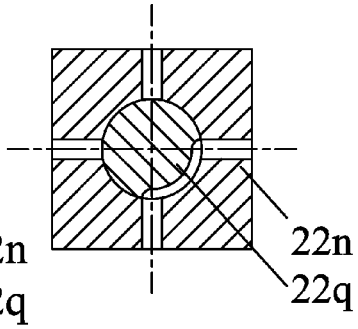
FIG. 65 is a seventh cross section views of the direct-acting mode selection module for the drain-for-drain &drain-for-supply brake mode.

FIG. 49-FIG. 52 are the front view, left view, rear view and top view of the rotary mode selection module of the supply-for-supply & brake-for-brake mode respectively. FIG. 53-FIG. 57 are the front of the mode selection module of the direct-acting supply-for-supply & brake-for-brake mode, the vertical section view of the second oil supply port, and the vertical section view, rear view and top view of the third oil supply port respectively. FIG. 58-FIG. 60 are the front view, left view and top view of the rotary mode selection module for the drain-for-drain & drain-for-supply brake mode respectively. FIG. 61-FIG. 65 are the front view and left view of the direct-acting mode selection module for the drain-for-drain & drain-for-supply brake mode, the first, $3^{rd}$, $5^{th}$ cross-section views, the $2^{nd}$, $4^{th}$ and $6^{th}$ cross-section views and the seventh cross-section view respectively. These several kinds of the mode selection modules 22 all have the mode selection module housing 22*n* with an oil opening and the notched mode selection module spindle 22*q*. The mode selection module spindle 22*q* is actuated by the electromagnetic, hydraulic, mechanical or pneumatic mechanism and has two positions. When the internal combustion engine is deemed as the power drive mode, the mode selection module spindle 22*q* is not actuated. When the internal combustion engine is deemed as the consumption brake mode, the drive mode selection module spindle 22*q* rotates over a certain angle or moves to a certain distance axially.

Figure 66:
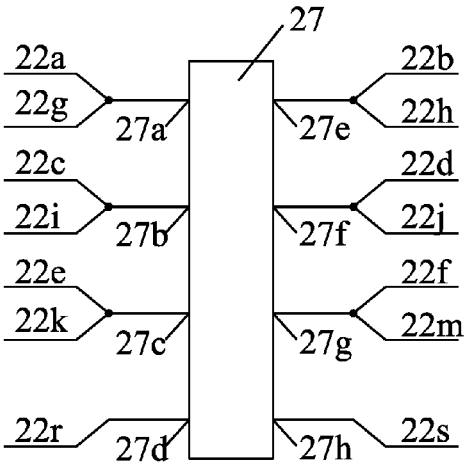
FIG. 66 is a diagram of the switch valve assembly mode selection module for the drain-for-drain &drain-for-supply brake mode.
Figure 67:
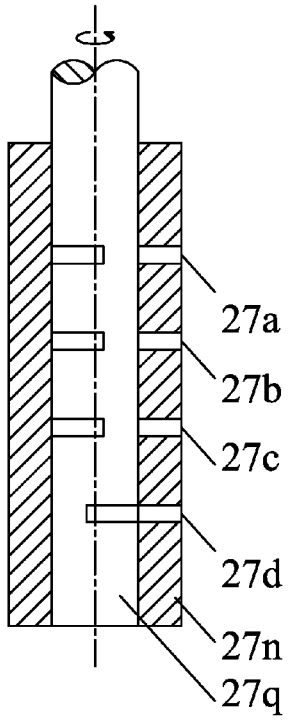
FIG. 67 is a front view of the rotary switch valve assembly.
Figure 68:
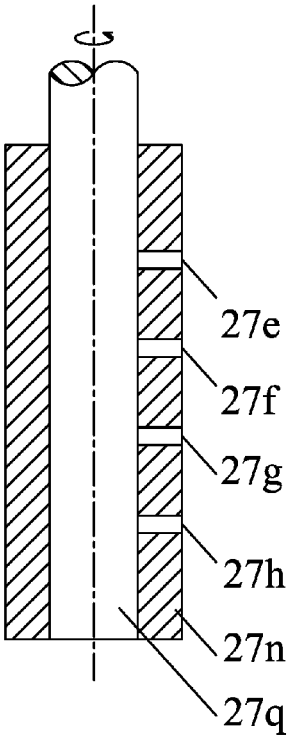
FIG. 68 is a left view of the rotary switch valve assembly.
Figure 69:
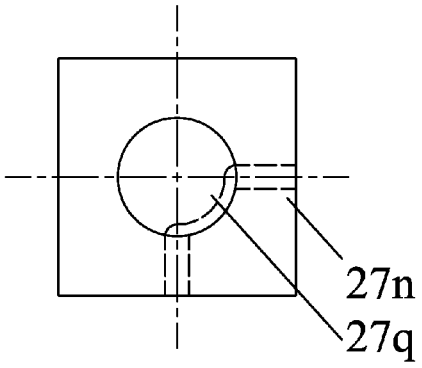
FIG. 69 is a top view of the rotary switch valve assembly.
Figure 70:
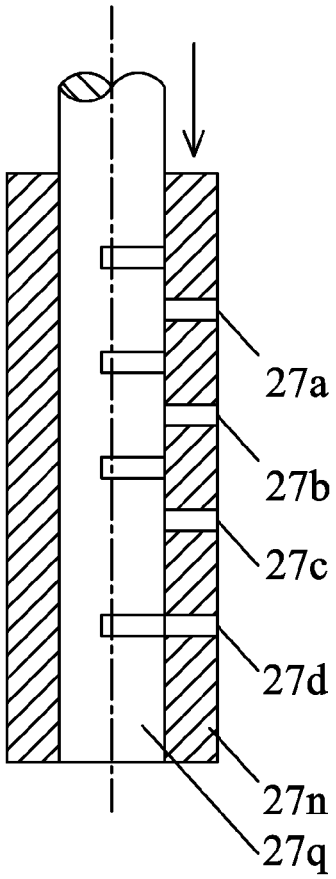
FIG. 70 is a front view of the direct-acting switch valve assembly.
Figure 71:
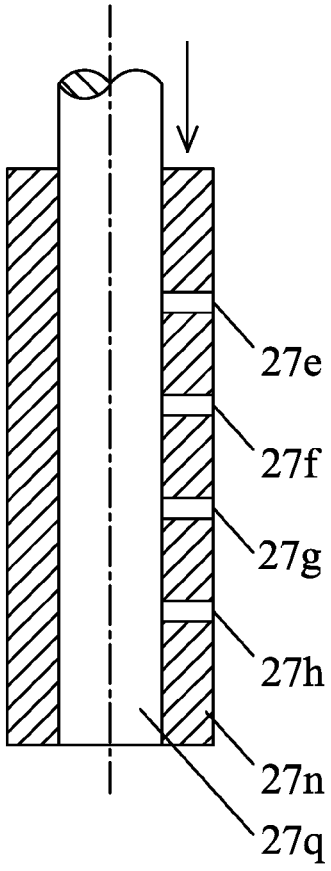
FIG. 71 is a left view of the direct-acting switch valve assembly.
Figure 72:
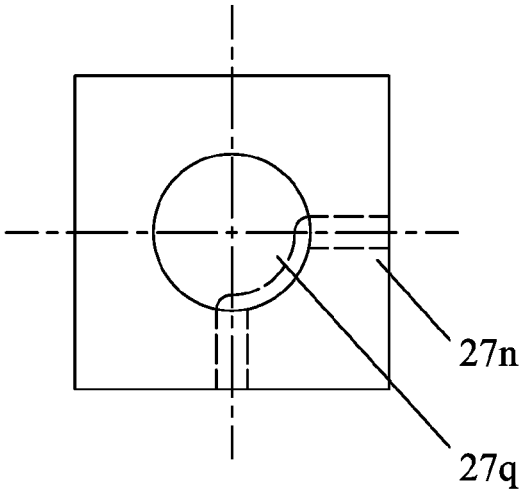
FIG. 72 is a top view of the direct-acting switch valve assembly.
Figure 73:
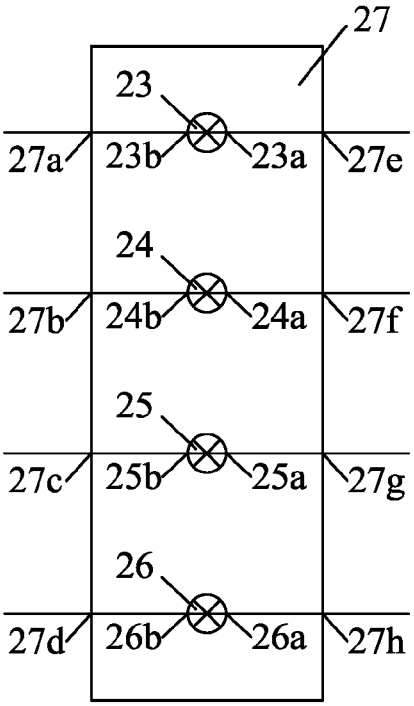
FIG. 73 is a diagram of the independent switch valve assembly.

FIG. 66 is a diagram of the mode selection module of the switch valve assembly type for the drain-for-drain &drain-for-supply brake mode. FIG. 67-FIG. 69 are the front view, left view and top view of the rotary switch valve assembly respectively. FIG. 70-FIG. 72 are the front view, left view and top view of the direct-acting switch valve assembly respectively. FIG. 73 is a diagram of the independent switch valve assembly. Because, for the drain-for-drain &drain-for-supply brake mode, under the drive and brake mode, the first oil supply port 22*a* of the mode selection module connects with the first drive port 22*g* of the mode selection module, the second oil supply port 22*b* of the mode selection module connects with the second drive port 22*h* of the mode selection module, and the third oil supply port 22*c* of the mode selection module connects with the third drive port 22*i* of the mode selection module. The fourth oil supply port 22*d* of the mode selection module connects with the fourth drive port 22*j* of the mode selection module, the fifth oil supply port 22*e* of the mode selection module connects with the fifth drive port 22*k* of the mode selection module, and the sixth oil supply port 22*f* of the mode selection module connects with the sixth drive port 22*m* of the mode selection module.

The switch valve assembly 27 may adopt the dual-layer nested structure, comprising the switch valve assembly housing 27*n* with an oil opening. Actuated by the electromagnetic, hydraulic, mechanical or pneumatic mechanism, the switch valve assembly spindle 27*q* rotates or moves axially in the switch valve assembly housing 27*n* and has two positions. The switch valve assembly 27 comprises the first oil port 27*a* of the switch valve assembly, the second oil port 27*b* of the switch valve assembly, the third oil port 27*c* of the switch valve assembly, the fourth oil port 27*d* of the switch valve assembly, the fifth oil port 27*e* of the switch valve assembly, the sixth oil port 27*f* of the switch valve assembly, the seventh oil port 27*g* of the switch valve assembly and the eighth oil port 27*h* of the switch valve assembly. The first oil supply port 22*a* of the mode selection module, the first drive port 22*g* of the mode selection module and the first oil port 27*a* of the switch valve assembly connect to each other. The second oil supply port 22*b* of the mode selection module, the second drive port 22*h* of the mode selection module and the fifth oil port 27*e* of the switch valve assembly connect to each other. The third oil supply port 22*c* of the mode selection module, the third drive port 22*i* of the mode selection module and the second oil port 27*b* of the switch valve assembly connect to each other. The fourth oil supply port 22*d* of the mode selection module, the fourth drive port 22*j* of the mode selection module and the sixth oil port 27*f* of the switch valve assembly connect to each other. The fifth oil supply port 22*e* of the mode selection module, the fifth drive port 22*k* of the mode selection module and the third oil port 27*c* of the switch valve assembly connect to each other. The sixth oil supply port 22*f* of the mode selection module, the sixth drive port 22*m* of the mode selection module and the seventh oil port 27*g* of the switch valve assembly connect to each other. The oil control inlet 22*r* of the mode selection module connects with the fourth oil port 27*d* of the switch valve assembly, and the oil control outlet 22*s* of the mode selection module connects with the eighth oil port 27*h* of the switch valve assembly. Under the drive mode, the switch valve assembly spindle 27*q* is not actuated. Meanwhile, the first oil port 27*a* of the switch valve assembly disconnects with the fifth oil port 27*e* of the switch valve assembly, the second oil port 27*b* of the switch valve assembly disconnects with the sixth oil port 27*f* of the switch valve assembly, and the third oil port 27*c* of the switch valve assembly disconnects with the seventh oil port 27*g* of the switch valve assembly, but the fourth oil port 27*d* of the switch valve assembly connects with the eighth oil port 27*h* of the switch valve assembly. Under the brake mode, the switch valve assembly spindle 27*q* rotates over a certain angle or moves to a certain distance axially, the first oil port 27*a* of the switch valve assembly connects with the fifth oil port 27*e* of the switch valve assembly, the second oil port 27*b* of the switch valve assembly connects with the sixth oil port 27*f* of the switch valve assembly, and the third oil port 27*c* of the switch valve assembly connects with the seventh oil port 27*g* of the switch valve assembly, but the fourth oil port 27*d* of the switch valve assembly disconnects with the eighth oil port 27*h* of the switch valve assembly.

The switch valve assembly 27 may also adopt the independent switch valve structure, comprising the first switch valve 23, the 2nd switch valve 24, the third switch valve 25 and the fourth switch valve 26. The fifth oil port 27*e* of the switch valve assembly connects with the first oil port 23*a* of the first switch valve, the first oil port 27*a* of the switch valve assembly connects with the first oil port 23*b* of the first switch valve, and the sixth oil port 27*f* of the switch valve assembly connects with the first oil port 24*a* of the second switch valve. The second oil port 27*b* of the switch valve assembly connects with the second oil port 24*b* of the second switch valve, the seventh oil port 27*g* of the switch valve assembly connects with the first oil port 25*a* of the third switch valve, and the third oil port 27*c* of the switch valve assembly connects with the second oil port 25*b* of the third switch valve. The eighth oil port 27*h* of the switch valve assembly connects with the first oil port 26*a* of the fourth switch valve, and the fourth oil port 27*d* of the switch valve assembly connects with the second oil port 26*b* of the fourth switch valve. Under the drive mode, the first oil port 26*a* of the fourth switch valve connects with the second oil port 26*b* of the fourth switch valve, but the first oil port 23*a* of the first switch valve disconnects with the first oil port 23*b* of the first switch valve, the first oil port 24*a* of the second switch valve disconnects with the second oil port 24*b* of the second switch valve, and the first oil port 25*a* of the third switch valve disconnects with the second oil port 25*b* of the third switch valve. Under the brake mode, the first oil port 26*a* of the fourth switch valve is actuated to disconnect to the second oil port 26*b* of the fourth switch valve, but the first oil port 23*a* of the first switch valve connects with the first oil port 23*b* of the first switch valve, the first oil port 24*a* of the second switch valve connects with the second oil port 24*b* of the second switch valve, and the first oil port 25*a* of the third switch valve connects with the second oil port 25*b* of the third switch valve.

Please note that functions of the phase limit module 2 and the mode selection module 22 are independent in this case. The decision on setting the mode selection module 22 shall be made depending on the brake mode in the actual application, but there is no effect on the phase limit module 2 and other components of the system. The structure of the mode selection module 22 shall be selected according to different drive patterns of the mode selection module 22 and brake modes. For internal combustion engines with different numbers of cylinders, it is only necessary to increase or reduce the specific oil port section on the mode selection module 22 and the phase limit module, but it is unnecessary to change other oil port sections and other components of the system. According to different requirements for the flexibility of the valve, the speed of the internal combustion engine and the overall layout of the system, it is only necessary to change elements of the control module and oil delivery module, there is no effect on other parts of the system. For different ignition sequences of internal combustion engines, it is only necessary to adjust the opening angle of each oil port section of the phase limit module spindle 2*n*; or for an internal combustion engine with the brake mode, it is only necessary to change the connection object with the oil path between the phase limit module 2 and the mode selection module 22; or for an internal combustion engine without the brake mode, it is only necessary to change the connection object with the oil path between the phase limit module 2 and the valve actuation module of each cylinder. Therefore, through a simple adjustment only, the system is applicable for different engine types and has a wide range of applications. In the meantime, structures of the mode selection module 22 and the phase limit module 2 and oil port positions, etc. shall be adjusted according to the actual assembly requirements. Besides, various components of the system are connected via oil pipes, which meet the system layout requirement of application vehicle types.

Figure 74:
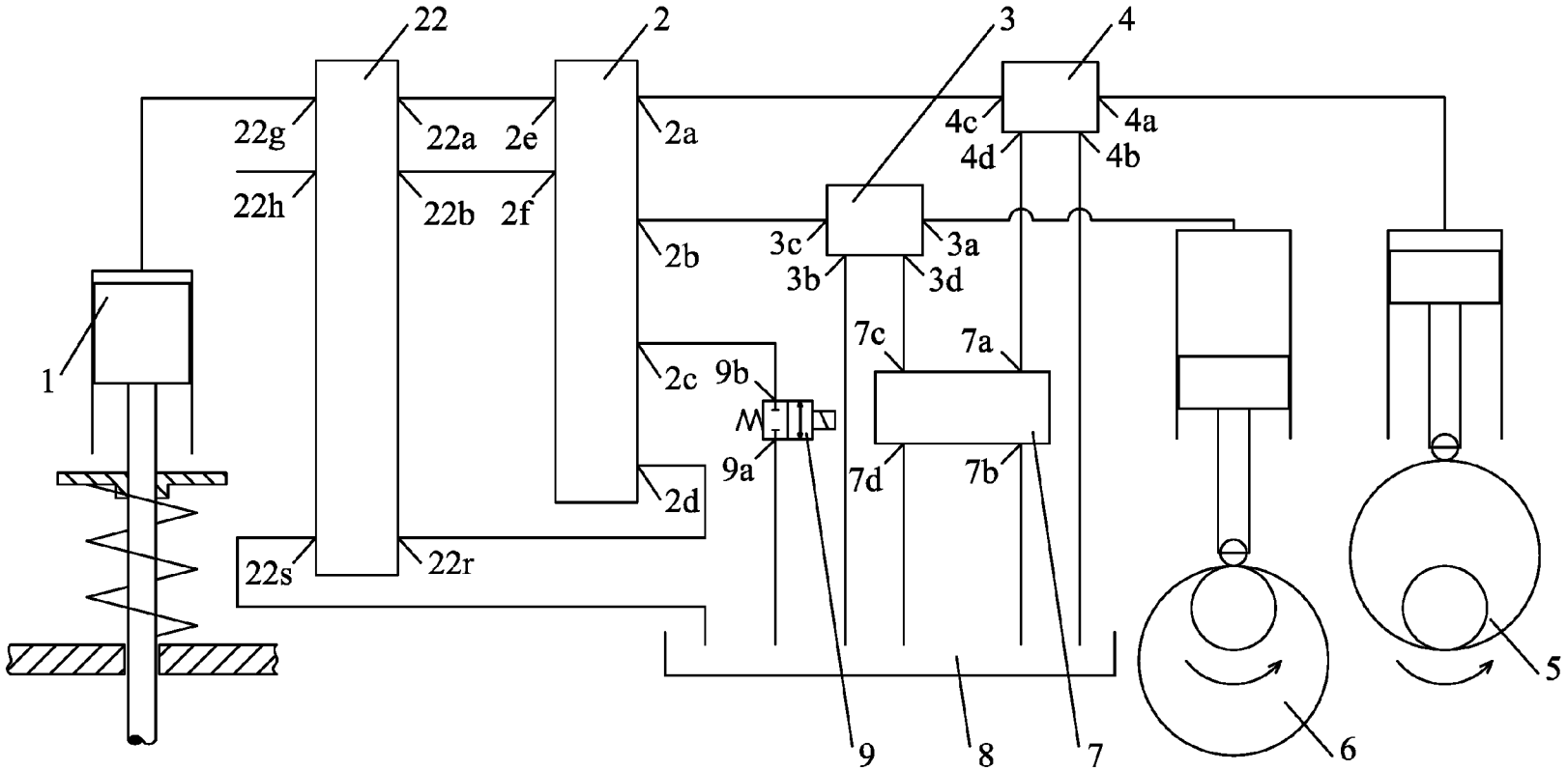
FIG. 74 is a diagram of the fully variable valve of the non-independent oil drain valve controlled on the oil supply side and the modularized multifunctional variable valve actuation system of the check valve.

Take the fully variable valve actuation system of the non-independent oil drain valve controlled on the oil supply side of the naturally aspirated internal combustion engine with the sequence from one-cylinder to five-cylinder to three-cylinder to six-cylinder to two-cylinder to four-cylinder and the drain-for-drain & drain-for-supply brake mode as an example. For instance, the oil drain valve 9 is normally closed. When the first two-position three-way valve 19 is off, the oil supply port 19*a* of the first two-position three-way valve connects with the oil delivery port 19*b* of the first two-position three-way valve and the drive port 19*c* of the first two-position three-way valve is plugged. When the a second two-position three-way valve 21 is off, the oil supply port 21*a* of the second two-position three-way valve connects with the oil delivery port 21*b* of the second two-position three-way valve, and the drive port 21*c* of the second two-position three-way valve is plugged. FIG. 74 is a diagram of a modularized multifunctional variable valve actuation system of the check valve under this circumstance.

Based on design characteristics of the system under this circumstance, the operation of the valve actuation module 1 is decided by the movement law of the first oil supply module 6, the second oil supply module 5 and the phase limit module 2, as well as the working status of the mode selection module 22, the first two-position three-way valve 19, the a second two-position three-way valve 21 and the oil drain valve 9. According to the working status of the mode selection module 22, the working process of the valve actuation module 1 can be divided into the drive mode and the brake mode. Its working process is stated below:

(I) Drive Mode

When the internal combustion engine stays in the drive mode as the power source, the mode selection module 22 is not actuated, the first drive oil supply port 22*a* of the mode selection module keeps connecting with the first drive port 22*g* of the mode selection module, and the oil control inlet 22*r* of the mode selection module keeps connecting with the oil control outlet 22*s* of the mode selection module, but the first drive port 2*e* of the phase limit module disconnects with the second oil supply port 2*a* of the phase limit module all the time. Therefore, the valve actuation module 1 can only work in the range limited by the movement law of the first oil supply module 6 and the phase limit module 2, and specific valve operation parameters are adjusted depending on the working status of the oil drain valve 9 and the first two-position three-way valve 19 in this range. Its working process is stated below:

(1) When the Valve is Actuated: 0° C.A-240° C.A

In this phase, the first drive port 2*e* of the phase limit module connects with the first oil supply port 2*b* of the phase limit module, but the first drive port 2*e* of the phase limit module disconnects with the second oil drain port 2*d* of the phase limit module. Under the drive mode, the valve actuation oil path is completely connected, i.e. the first oil supply port 2*b* of the phase limit module, the first drive port 2*e* of the phase limit module, the first drive oil supply port 22*a* of the mode selection module and the first drive port 22*g* of the mode selection module.

(a) When the First Oil Supply Module 6 Supplies Oil: 0° C.A-120° C.A

At that time, the first drive port 2*e* of the phase limit module connects with the first oil drain port 2*c* of the phase limit module. Under the drive mode, the first oil drain path is completely connected, i.e. the first drive port 22*g* of the mode selection module, the first drive oil supply port 22*a* of the mode selection module, the first drive port 2*e* of the phase limit module and the first oil drain port 2*c* of the phase limit module. The following events can be realized:

a) The valve is opened: when the first oil supply module 6 enters the oil supply phase and the timing signal for valve actuation is received, both the first two-position three-way valve 19 and the oil drain valve 9 are not stimulated. In other words, the oil supply port 19*a* of the first two-position three-way valve connects with the oil delivery port 19*b* of the first two-position three-way valve, but the drive port 19*c* of the first two-position three-way valve is plugged, and The oil inlet of oil drain valve 9*b* disconnects with the oil outlet of oil drain valve 9*a*. The hydraulic oil in the first oil supply module 6 returns to the oil tank 8 via the first two-position three-way valve 19 and the oil delivery module 7. When the timing signal for valve actuation is received, the first two-position three-way valve 19 is stimulated. In other words, the oil supply port 19*a* of the first two-position three-way valve connects with the drive port 19*c* of the first two-position three-way valve, but the oil delivery port 19*b* of the first two-position three-way valve is plugged. After the hydraulic oil passes the first two-position three-way valve 19, it flows into the first oil supply module 6 under the drive mode, conquers the acting force of the spring of the valve actuation module 1 and actuates to open the valve.

b) The valve keeps opening: when the valve actuator stops receiving the timing signal, the first two-position three-way valve 19 is not stimulated. In other words, the oil supply port 19*a* of the first two-position three-way valve connects with the oil delivery port 19*b* of the first two-position three-way valve, but the drive port 19*c* of the first two-position three-way valve is plugged. The hydraulic oil in the valve actuation module 1 is blocked and the valve keeps at the maximum lift position. At that time, when the first oil supply module 6 is still in the oil supply phase, the hydraulic oil in the first oil supply module 6 is pushed into the oil tank 8 by the oil delivery module 7 through the first two-position three-way valve 19.

c) The valve actuator for oil drain is closed: when the timing signal for valve actuation for oil drain is not received, the oil drain valve 9 is stimulated and the oil inlet of oil drain valve 9*b* connects with the oil outlet of oil drain valve 9*a*. Under the effect of the spring of the valve actuation module 1, the hydraulic oil in the valve actuation module 1 returns to the oil tank 8 via the first oil drain path under the drive mode, so as to realize the oil drain close process of the valve. At that time, when the first oil supply module 6 still stays in the oil supply phase, the hydraulic oil in the first oil supply module 6 is pushed back to the oil tank 8 by the oil delivery module 7 via the first two-position three-way valve 19.

(b) In the Oil Absorption Phase of the First Oil Supply Module 6: 120° C.A-240° C.A At that time, the first drive port 2*e* of the phase limit module disconnects with the first oil drain port 2*c* of the phase limit module. The following events can be realized:

a) The valve keeps opening: when the first two-position three-way valve 19 is not stimulated, the hydraulic oil in the valve actuation module 1 is blocked and the valve keeps at the maximum lift position. At that time, the first oil supply module 6 still stays in the oil absorption phase and the hydraulic oil in the oil tank 8 flows into the first oil supply module 6 via the oil delivery module 7 and the first two-position three-way valve 19.

b) The valve actuator is closed for oil absorption: when the timing signal for closing the valve for oil absorption is received, the first two-position three-way valve 19 is stimulated. In other words, the oil supply port 19*a* of the first two-position three-way valve connects with the drive port 19*c* of the first two-position three-way valve, but the oil delivery port 19*b* of the first two-position three-way valve is plugged. Under the oil absorption effect of the first oil supply module 6 and the spring of the valve actuation module 1, the hydraulic oil in the valve actuation module 1 returns to the first oil supply module 6 via the drive oil path, and the first two-position three-way valve 19 under the drive mode, so as to close the valve for oil absorption.

(2) When the Valve Keeps Closing: 240° C.A-720° C.A

In this phase, the phase limit module 2 disconnects the first oil supply port 2*b* of the phase limit module and the first drive port 2*e* of the phase limit module, disconnects the first oil drain port 2*c* of the phase limit module and the first drive port 2*e* of the phase limit module, but connects the second oil drain port 2*d* of the phase limit module and the first drive port 2*e* of the phase limit module. Under the drive, the second oil drain path is completely connected, i.e. the first drive port 22*g* of the mode selection module, the first drive oil supply port 22*a* of the mode selection module, the first drive port 2*e* of the phase limit module, the second oil drain port 2*d* of the phase limit module, the oil control inlet 22*r* of the mode selection module and the oil control outlet 22*s* of the mode selection module. The valve actuation module 1 connects with the oil tank 8 via the second oil drain path under the drive mode, the valve can be closed and keep closing and also the valve gap adjusting module can be replaced.

(II) Brake Mode

When the internal combustion engine stays in the brake mode as the consumption power, the movement of the drive mode selection module 22 makes the first oil supply port 22*a* of the mode selection module, the second oil supply port 22*b* of the mode selection module, the first drive port 22*g* of the mode selection module and the second drive port 22*h* of the mode selection module are connected to each other, but makes the oil control inlet 22*r* of the mode selection module disconnect to the oil control outlet 22*s* of the mode selection module. At that time, the work scope of the valve actuation module 1 is limited by the movement law of the first oil supply module 6 or the second oil supply module 5 and the phase limit module 2, and specific valve operation parameters are adjusted according to the working status of the oil drain valve 9 and the second two-position three-way valve 21 or the first two-position three-way valve 19. Its working process is stated below:

(1) When the Valve can be Actuated by the First Oil Supply Module 6: 0° C.A-240° C.A This phase is an oil supply+oil absorption operation period in which the first oil supply module 6 starts from the oil supply starting point. Meanwhile, the phase limit module 2 makes the first oil supply port 2*b* of the phase limit module connects with the first drive port 2*e* of the phase limit module, makes the second oil supply port 2*a* of the phase limit module disconnect to the first drive port 2*e* of the phase limit module, makes the second oil drain port 2*d* of the phase limit module disconnect to the first drive port 2*e* of the phase limit module, makes the first oil supply port 2*b* of the phase limit module disconnect to the second drive port 2*f* of the phase limit module, makes the second oil supply port 2*a* of the phase limit module disconnect to the second drive port 2*f* of the phase limit module, makes the second oil drain port 2*d* of the phase limit module connect to the second drive port 2*f* of the phase limit module, and makes the first oil drain port 2*c* of the phase limit module disconnect to the second drive port 2*f* of the phase limit module. Under the brake mode, the first valve brake oil path is completely connected, i.e. the first oil supply port 2*b* of the phase limit module, the first drive port 2*e* of the phase limit module, the first oil supply port 22*a* of the mode selection module, the first drive port 22*g* of the mode selection module and the second drive port 22*h* of the mode selection module.

(a) In the Oil Supply Phase of the First Oil Supply Module 6: 0° C.A-120° C.A The phase limit module 2 makes the first oil drain port 2*c* of the phase limit module connect to the first drive port 2*e* of the phase limit module. Under the brake mode, the first oil drain path is completely connected, i.e. the first drive port 22*g* of the mode selection module and the second drive port 22*h* of the mode selection module, the first oil supply port 22*a* of the mode selection module, the first drive port 2*e* of the phase limit module and the first oil drain port 2*c* of the phase limit module. Except different actuation oil paths, the valve operation process that can be realized in this phase is a same with the valve operation process in the oil supply phase of the first oil supply module 6 when the valve can be actuated under the drive mode, so hereby it is not repeated.

(b) In the Oil Absorption Phase of the First Oil Supply Module 6: 120° C.A-240° C.A The phase limit module 2 makes the first oil drain port 2*c* of the phase limit module disconnect to the first drive port 2*e* of the phase limit module. Except different actuation oil paths, the valve operation process that can be realized in this phase is the same with the valve operation process in the oil absorption phase of the first oil supply module 6 when the valve can be actuated under the drive mode, so hereby it is not repeated.

(2) When the Valve Keeps Closing: 240° C.A-360° C.A

In this phase, the phase limit module 2 makes the first oil supply port 2*b* of the phase limit module disconnect to the first drive port 2*e* of the phase limit module, makes the second oil supply port 2*a* of the phase limit module disconnect to the first drive port 2*e* of the phase limit module, makes the second oil drain port 2*d* of the phase limit module disconnect to the first drive port 2*e* of the phase limit module, makes the first oil drain port 2*c* of the phase limit module disconnect to the first drive port 2*e* of the phase limit module, makes the first oil supply port 2*b* of the phase limit module disconnect to the second drive port 2*f* of the phase limit module, makes the second oil supply port 2*a* of the phase limit module disconnect to the second drive port 2*f* of the phase limit module, makes the second oil drain port 2*d* of the phase limit module connect to the second drive port 2*f* of the phase limit module, and makes the first oil drain port 2*c* of the phase limit module disconnect to the second drive port 2*f* of the phase limit module. At that time, the valve actuation module 1 is plugged and the valve can keep closing.

(3) When the Valve can be Actuated by the Second Oil Supply Module 5: 360° C.A-600° C.A This phase is an oil supply+oil absorption operation period in which the second oil supply module 5 starts from the oil supply starting point. Meanwhile, the phase limit module 2 makes the first oil supply port 2*b* of the phase limit module disconnect to the first drive port 2*e* of the phase limit module, makes the second oil supply port 2*a* of the phase limit module disconnect to the first drive port 2*e* of the phase limit module, makes the second oil drain port 2*d* of the phase limit module connect to the first drive port 2*e* of the phase limit module, makes the first oil drain port 2*c* of the phase limit module disconnect to the first drive port 2*e* of the phase limit module, makes the first oil supply port 2*b* of the phase limit module disconnect to the second drive port 2*f* of the phase limit module, makes the second oil supply port 2*a* of the phase limit module connect to the second drive port 2*f* of the phase limit module, and makes the second oil drain port 2*d* of the phase limit module disconnect to the second drive port 2*f* of the phase limit module. Under the brake mode, the 2nd valve brake oil path, the second oil supply port 2*a* of the phase limit module, the second drive port 2*f* of the phase limit module, the first oil supply port of the mode selection module 2*b*, the first drive port 22*g* of the mode selection module and the second drive port 22*h* of the mode selection module are completely connected.

(a) In the Oil Supply Phase of the Second Oil Supply Module 9: 360° C.A-480° C.A The phase limit module 2 makes the first oil drain port 2*c* of the phase limit module connect to the second drive port 2*f* of the phase limit module. Under the brake mode, the second oil drain path is completely connected, i.e. the first drive port 22*g* of the mode selection module and the second drive port 22*h* of the mode selection module, the second oil supply port 2*a* of the phase limit module, the second drive port 2*f* of the phase limit module and the first oil drain port 2*c* of the phase limit module. The valve operation process that can be realized in this phase is the same with the valve operation process in the oil supply phase of the first oil supply module 6 when the valve can be actuated under the drive mode. The difference is that: drive oil paths are different, the oil supply module is the second oil supply module 5, and electromagnetic valves are the second two-position three-way valve 21 and the oil drain valve 9, so hereby it is not repeated.

(b) In the Oil Absorption Phase of the Second Oil Supply Module 5: 480° C.A-600° C.A The phase limit module 2 disconnects the first oil drain port 2*c* of the phase limit module with the second drive port 2*f* of the phase limit module. The valve operation process that can be realized in this phase is the same with the valve operation process in the oil absorption phase of the second oil supply module 5 when the valve can be actuated under the drive mode. The difference is that: drive oil paths are different, the oil supply module is the second oil supply module 5, and electromagnetic valves are the second two-position three-way valve 21 and the oil drain valve 9, so hereby it is not repeated.

(4) When the Valve Keeps Closing: 600° C.A-720° C.A

This phase is the same with the second phase of the brake mode, so hereby it is not repeated.

In the same operation period of the phase limit module, one valve can be actuated under the drive mode, but two valves can be actuated under the brake mode. Therefore, the variable valve event required by the 360° C.A/cycle air compressor brake mode can be realized.

On condition of different cylinder numbers, different valve variability, brake mode availability, different brake modes and different control positions, the operation process of the valve actuation system is slightly different, based on operation characteristics of various components of the system and according to the actual condition. These slight differences are introduced in the form but not illustrated separately in detail. Table 6-Table 8 show oil supply and control components of the valve actuation module of each cylinder under the drive mode, drain-for-drain &drain-for-supply brake mode and supply-for-supply & brake-for-brake mode respectively. Thereof, types of systems numbered from 1 to 6 are the continuously variable type controlled on the oil supply side, the continuously variable type controlled on the valve side, the fully variable type of the non-independent oil drain valve controlled on the valve side, the fully variable type of the independent oil drain valve controlled on the oil supply side and the fully variable type of the independent oil drain valve controlled on the valve side. The symbol "+" means that the control valve is placed on the oil supply port side of the mode selection module and the symbol "−" means that the control valve on the drive port side of the mode selection module.

TABLE 6

| Oil supply and control parts of valve actuation modules of all cylinders under the drive mode | | | | | | |
|---|---|---|---|---|---|---|
| | One-cylinder | Two-cylinder | Three-cylinder | Four-cylinder | Five-cylinder | Six-cylinder |
| | Oil supply | | | | | |
| | The first oil supply module 6: 0°-120° | The first oil supply module 6: 480°-600° | The first oil supply module 6: 240°-360° | The second oil supply module 5: 600°-720° | The second oil supply module 5: 120°-240° | The second oil supply module 5: 360°-480° |
| 1 | The first two-position two-way valve 14 | | | The second two-position two-way valve 15 | | |
| 2 | The 1-1 two-position two-way valve 141 | The 1-2 two-position two-way valve 142 | The 1-3 two-position two-way valve 143 | The 2-3 two-position two-way valve 153 | The 2-2 two-position two-way valve 152 | The 2-1 two-position two-way valve 151 |
| 3 | The first two-position three-way valve 19 and oil drain valve 9 | | | The second two-position three-way valve 21 and oil drain valve 9 | | |
| 4 | The 1-1 two-position three-way valve 191 and oil drain valve 9 | The 1-2 two-position three-way valve 192 and oil drain valve 9 | The 1-3 two-position three-way valve 193 and oil drain valve 9 | The 2-3 two-position three-way valve 213 and oil drain valve 9 | The 2-2 two-position three-way valve 212 and oil drain valve 9 | The 2-1 two-position three-way valve 211 and oil drain valve 9 |

TABLE 6-continued

| Oil supply and control parts of valve actuation modules of all cylinders under the drive mode | | | | | | |
|---|---|---|---|---|---|---|
| | One-cylinder | Two-cylinder | Three-cylinder | Four-cylinder | Five-cylinder | Six-cylinder |
| | Oil supply | | | | | |
| | The first oil supply module 6: 0°-120° | The first oil supply module 6: 480°-600° | The first oil supply module 6: 240°-360° | The second oil supply module 5: 600°-720° | The second oil supply module 5: 120°-240° | The second oil supply module 5: 360°-480° |
| 5 | The first two-position three-way valve 19 and the first oil drain valve 91 | The first two-position three-way valve 19 and the second oil drain valve 92 | The first two-position three-way valve 19 and the third oil drain valve 93 | The second two-position three-way valve 21 and the sixth oil drain valve 96 | The second two-position three-way valve 21 and the fifth oil drain valve 95 | The second two-position three-way valve 21 and the fourth oil drain valve 94 |
| 6 | The 1-1 two-position three-way valve 191 and the first oil drain valve 91 | The 1-2 two-position three-way valve 192 and the second oil drain valve 92 | The 1-3 two-position three-way valve 193 and the third oil drain valve 93 | The 2-3 two-position three-way valve 213 and the sixth oil drain valve 96 | The 2-2 two-position three-way valve 212 and the fifth oil drain valve 95 | The 2-1 two-position three-way valve 211 and the fourth oil drain valve 94 |

TABLE 7

| Oil supply and control parts of valve actuation modules of all cylinders under the supply-for-drain & drain-for-supply brake mode | | | |
|---|---|---|---|
| | One-cylinder + Six-cylinder | Two-cylinder + Five-cylinder | Three-cylinder + Four-cylinder |
| Oil supply | The first oil supply module 6: 0°-120° or the second oil supply module 5: 360°-480° | The first oil supply module 6: 480°-600° or the second oil supply module 5: 120°-240° | The first oil supply module 6: 240°-360° or the second oil supply module 5: 600°-720° |
| 1 | The first two-position two-way valve 14 or the second two-position two-way valve 15 | | |
| 2 | The 1-1 two-position two-way valve 141 or the 2-1 two-position two-way valve 151 | The 2-2 two-position two-way valve 152 or the 1-2 two-position two-way valve 142 | The 1-3 two-position two-way valve 143 or the 2-3 two-position two-way valve 153 |
| 3 | The first two-position three-way valve 19 and oil drain valve 9 or the second two-position three-way valve 21 and oil drain valve 9 | | |
| 4 | The 1-1 two-position three-way valve 191 and oil drain valve 9 or the 2-1 two-position three-way valve 211 and oil drain valve 9 | The 1-2 two-position three-way valve 192 and oil drain valve 9 or the 2-2 two-position three-way valve 212 and oil drain valve 9 | The 1-3 two-position three-way valve 193 and oil drain valve 9 or the 2-3 two-position three-way valve 213 and oil drain valve 9 |
| 5 | The first two-position three-way valve 19 and the first oil drain valve 91 or the second two-position three-way valve 21 and the fourth oil drain valve 94 | The first two-position three-way valve 19 and the second oil drain valve 92 or the second two-position three-way valve 21 and the fifth oil drain valve 95 | The first two-position three-way valve 19 and the third oil drain valve 93 or the second two-position three-way valve 21 and the sixth oil drain valve 96 |
| 6 | The 1-1 two-position three-way valve 191 and the first oil drain valve 91 or the 2-1 two-position three-way valve 211 and the fourth oil drain valve 94 | The 1-2 two-position three-way valve 192 and the second oil drain valve 92 or the 2-2 two-position three-way valve 212 and the fifth oil drain valve 95 | The 1-3 two-position three-way valve 193 and the third oil drain valve 93 or the 2-3 two-position three-way valve 213 and the sixth oil drain valve 96 |

TABLE 8

| Oil supply and control parts of valve actuation modules of all cylinders under the supply-for-supply & drain-for-drain brake mode | | | |
|---|---|---|---|
| | One-cylinder + Six-cylinder | Two-cylinder + Five-cylinder | Three-cylinder + Four-cylinder |
| Oil supply | The first oil supply module 6: 480°-600° or the second oil supply module 5: 120°-240° | The first oil supply module 6: 240°-360° or the second oil supply module 5: 600°-720° | The first oil supply module 6: 0°-120° or the second oil supply module 5: 360°-480° |
| 1 | The first two-position two-way valve 14 or the second two-position two-way valve 15 | | |
| 2+ | The 1-3 two-position two-way valve 143 or the 2-3 two-position two-way valve 153 | The 1-1 two-position two-way valve 141 or the 2-1 two-position two-way valve 151 | The 2-2 two-position two-way valve 152 or the 1-2 two-position two-way valve 142 |
| 2− | The 1-1 two-position two-way valve 141 or the 2-1 two-position two-way valve 151 | The 2-2 two-position two-way valve 152 or the 1-2 two-position two-way valve 142 | The 1-3 two-position two-way valve 143 or the 2-3 two-position two-way valve 153 |
| 3 | The first two-position three-way valve 19 and oil drain valve 9 or the second two-position three-way valve 21 and oil drain valve 9 | | |
| 4+ | The 1-3 two-position three-way valve 193 and oil drain valve 9 or the 2-3 two-position three-way valve 213 and oil drain valve 9 | The 1-1 two-position three-way valve 191 and oil drain valve 9 or the 2-1 two-position three-way valve 211 and oil drain valve 9 | The 1-2 two-position three-way valve 192 and oil drain valve 9 or the 2-2 two-position three-way valve 212 and oil drain valve 9 |
| 4− | The 1-1 two-position three-way valve 191 and oil drain valve 9 or the 2-1 two-position three-way valve 211 and oil drain valve 9 | The 1-2 two-position three-way valve 192 and oil drain valve 9 or the 2-2 two-position three-way valve 212 and oil drain valve 9 | The 1-3 two-position three-way valve 193 and oil drain valve 9 or the 2-3 two-position three-way valve 213 and oil drain valve 9 |
| 5+ | The first two-position three-way valve 19 and the third oil drain valve 93 or the second two-position three-way valve 21 and the sixth oil drain valve 96 | The first two-position three-way valve 19 and the first oil drain valve 91 or the second two-position three-way valve 21 and the fourth oil drain valve 94 | The first two-position three-way valve 19 and the second oil drain valve 92 or the second two-position three-way valve 21 and the fifth oil drain valve 95 |
| 5− | The first two-position three-way valve 19 and the first oil drain valve 91 or the second two-position three-way valve 21 and the fourth oil drain valve 94 | The first two-position three-way valve 19 and the second oil drain valve 92 or the second two-position three-way valve 21 and the fifth oil drain valve 95 | The first two-position three-way valve 19 and the third oil drain valve 93 or the second two-position three-way valve 21 and the sixth oil drain valve 96 |
| 6+ | The 1-3 two-position three-way valve 193 and the third oil drain valve 93 or the 2-3 two-position three-way valve 213 and the sixth oil drain valve 96 | The 1-1 two-position three-way valve 191 and the first oil drain valve 91 or the 2-1 two-position three-way valve 211 and the fourth oil drain valve 94 | The 1-2 two-position three-way valve 192 and the second oil drain valve 92 or the 2-2 two-position three-way valve 212 and the fifth oil drain valve 95 |
| 6− | The 1-1 two-position three-way valve 191 and the first oil drain valve 91 or the 2-1 two-position three-way valve 211 and the fourth oil drain valve 94 | The 1-2 two-position three-way valve 192 and the second oil drain valve 92 or the 2-2 two-position three-way valve 212 and the fifth oil drain valve 95 | The 1-3 two-position three-way valve 193 and the third oil drain valve 93 or the 2-3 two-position three-way valve 213 and the sixth oil drain valve 96 |

The invention claimed is:

1. A modularized multifunctional variable valve actuation system for a six-cylinder internal combustion engine, the system comprising:

a valve actuation module (1);

a first oil supply module (6);

a second oil supply module (5);

an oil delivery module (7);

an oil tank (8);

an oil drain valve (9);

oil pipes;

a phase limit module (2);

a mode selection module (22);

a first control module (3); and a second control module (4);

wherein the first oil supply module (6) and the second oil supply module (5) are cam-plunger oil supply modules with a camshaft angle having a phase difference of 180° and a rotation period of the cam-plunger oil supply modules is double that of an ignition interval angle of the internal combustion engine, and a crank angle in one cycle is 240°;

the first control module (3) comprises a first oil supply port (3*a*), an oil drain port (3*b*), a first drive port (3*c*) and an oil delivery port (3*d*); the second control module (4) comprises a first oil supply port (4*a*), an oil drain port (4*b*), a first drain port (4*c*) and an oil delivery port (4*d*); the oil delivery module (7) comprises a second oil delivery port (7*a*), an oil delivery port (7*b*), a first oil delivery port (7*c*) and an oil inlet (7*d*); the phase limit module (2) comprises a second oil supply port (2*a*), a first oil supply port (2*b*), a second oil drain port (2*d*), a first oil drain port (2*e*), a second drive port (2*f*), a third drive port (2*g*), a fourth drive port (2*h*), a fifth drive port (2*i*) and a sixth drive port (2*j*); the oil delivery port of the oil delivery module (7*b*), the oil inlet of oil delivery module (7*d*), the oil drain port of the first control module (3*b*) and the oil drain port of the second control module (4*b*) all connect to the oil tank (8);

the second oil delivery port of the oil delivery module (7*a*) connects with the oil delivery port of the second control module (4*d*), the first oil delivery port of the oil delivery module (7*c*) connects with the oil delivery port of the first control module (3*d*), and the first oil supply port of the first control module (3*a*) connects with the first oil supply module (6); the first oil supply port of the second control module (4*a*) connects with the second oil supply module (5), the first drive port of the first control module (3*c*) connects with the first oil supply port of the phase limit module (2*b*), and the first drain port of the second control module (4*c*) connects with the second oil supply port of the phase limit module (2*a*);

for the fully variable valve actuation system of a non-independent oil drain valve, the oil drain valve (9) is disposed and the phase limit module (2) comprises the first oil drain port of the phase limit module (2*c*); the first oil drain port of the phase limit module (2*c*) connects with the oil inlet of oil drain valve (9*b*) and the oil outlet of oil drain valve (9*a*) connects with the oil tank (8);

without a brake mode, the first oil drain port of the phase limit module (2*e*), the second drive port of the phase limit module (2*f*), the third drive port of the phase limit module (2*g*), the fourth drive port of the phase limit module (2*h*), the fifth drive port of the phase limit module (2*i*) and the sixth drive port of the phase limit module (2*j*) connect to the valve actuation modules of one-cylinder, six-cylinder, two-cylinder, five-cylinder and three-cylinder and four-cylinder respectively; both connect to the second oil drain port of the phase limit module (2*d*) and the oil tank (8) respectively;

with the brake mode, the mode selection module (22) is disposed; the mode selection module (22) comprises a first oil supply port of the mode selection module (22*a*), a second oil supply port of the mode selection module (22*b*), a third oil supply port of the mode selection module (22*c*), a fourth oil supply port of the mode selection module (22*d*), a fifth oil supply port of the mode selection module (22*e*) and a sixth oil supply port of the mode selection module (22*f*), which are respectively connected to the first oil drain port of the phase limit module (2*e*), the second drive port of the phase limit module (2*f*), the third drive port of the phase limit module (2*g*), the fourth drive port of the phase limit module (2*h*), the fifth drive port of the phase limit module (2*i*) and the sixth drive port of the phase limit module (2*j*) respectively; and the mode selection module (22) further comprises a first drive port of the mode selection module (22*g*), a second drive port of the mode selection module (22*h*), a third drive port of the mode selection module (22*i*), a fourth drive port of the mode selection module (22*j*), a fifth drive port of the mode selection module (22*k*) and a sixth drive port of the mode selection module (22*m*), which are respectively connected to valve actuation modules of one-cylinder, six-cylinder, two-cylinder, five-cylinder and three-cylinder; the mode selection module (22) also comprises an oil control inlet of the mode selection module (22*r*) and an oil control outlet of the mode selection module (22*s*), and both respectively connect to the second oil drain port of the phase limit module (2*d*) and the oil tank (8); for the valve actuation system of an internal combustion engine with the cylinder number as an integral multiple of 6, every 6 cylinders are classified into a group at the crank angle of 120° according to the ignition sequence and each group is equipped with a set of the variable valve actuation system.

2. The system of claim 1, wherein for the fully variable valve actuation system of the continuously variable or independent oil drain valve on the valve side, the first control module (3) further comprises a fifth drive port of the first control module (3*k*), a sixth drive port of the first control module (3*m*) and a seventh drive port of the first control module (3*n*); the fifth drive port of the first control module (3*k*) is connected to the oil path between the first oil drain port of the phase limit module (2*e*) and the first oil supply port of the mode selection module (22*a*) or the oil path between the first drive port of the mode selection module (22*g*) and the valve actuation module of one-cylinder; the sixth drive port of the first control module (3*m*) is connected to the oil path between the third drive port of the phase limit module (2*g*) and the third oil supply port of the mode selection module (22*c*) or the oil path between the third drive port of the mode selection module (22*i*) and the valve actuation module of two-cylinder; the seventh drive port of the first control module (3*n*) is connected to the oil path between the fifth drive port of the phase limit module (2*i*) and the fifth oil supply port of the mode selection module (22*e*) or the oil path between the fifth drive port of the mode selection module (22*k*) and the valve actuation module of three-cylinder; and the second control module (4) further comprises a fifth drive port of the second control module (4*k*), the sixth drive port of the second control module (4*m*) and the seventh drive port of the second control module (4*n*); the fifth drive port of the second control module (4*k*) is connected to the oil path between the second drive port of the phase limit module (2*f*) and the second oil supply port of the mode selection module (22*b*) or the oil path between the second drive port of the mode selection module (22*h*) and the valve actuation module of six-cylinder; the sixth drive port of the second control module (4*m*) is connected to the oil path between the fourth drive port of the phase limit module (2*h*) and the fourth oil supply port of the mode selection module (22*d*) or the oil path between the fourth drive port of the mode selection module (22*j*) and the valve actuation module of five-cylinder; the seventh drive port of the second control module (4*n*) is connected to the oil path between the $6^{th}$ drive port of the phase limit module (2*j*) and the sixth oil supply port of the mode selection module (22*f*) or the oil path between the sixth drive port of the mode selection module (22*m*) and the valve actuation module of four-cylinder.

3. The system of claim 1, wherein for the fully variable valve actuation system controlled on the valve side, the first control module (3) further comprises a second oil supply port of the first control module (3*e*), a third oil supply port of the first control module (3*f*), a fourth oil supply port of the first control module (3*g*), a second drive port of the first control module (3*h*), a third drive port of the first control module (3*i*) and a fourth drive port of the first control module (3*j*);

the second oil supply port of the first control module (3*e*) and the second drive port of the first control module (3*h*) respectively connect to the first oil drain port of the phase limit module (2*e*) and the first oil supply port of the mode selection module (22*a*) or the module the first drive port (22*g*) and the valve actuation module of one-cylinder; the third oil supply port of the first control module (3*f*) and the third drive port of the first control module (3*i*) respectively connect to the third drive port of the phase limit module (2*g*) and the third oil supply port of the mode selection module (22*c*) or the third drive port of the mode selection module (22*i*) and the valve actuation module of two-cylinder; the fourth oil supply port of the first control module (3*g*) and the fourth drive port of the first control module (3*j*) respectively connect to the fifth drive port of the phase limit module (2*i*) and the fifth oil supply port of the mode selection module (22*e*) or the fifth drive port of the mode selection module (22*k*) and the valve actuation module of three-cylinder; the second control module (4) further comprises a second oil supply port of the second control module (4*e*), the third oil supply port of the second control module (4*f*), the fourth oil supply port of the second control module (4*g*), the second drive port of the second control module (4*h*), the third drive port of the second control module (4*i*) and the fourth drive port of the second control module (4*j*); and the second oil supply port of the second control module (4*e*) and the second drive port of the second control module (4*h*) respectively connect to the second drive port of the phase limit module (2*f*) and the second oil supply port of the mode selection module (22*b*) or the second drive port of the mode selection module (22*h*) and the valve actuation module of six-cylinder; the third oil supply port of the second control module (4*f*) and the third drive port of the second control module (4*i*) respectively connect to the fourth drive port of the phase limit module (2*h*) and the fourth oil supply port of the mode selection module (22*d*) or the fourth drive port of the mode selection module (22*j*) and the valve actuation module of five-cylinder; the fourth oil supply port of the second control module (4*g*) and the fourth drive port of the second control module (4*j*) respectively connect to the sixth drive port of the phase limit module (2*j*) and the sixth oil supply port of the mode selection module (22*f*) or the sixth drive port of the mode selection module (22*m*) and the valve actuation module of four-cylinder.

4. The system of claim 1, wherein for the fully variable valve actuation system of the independent oil drain valve controlled on the valve side, the phase limit module (2) and the mode selection module (22) are cancelled; the first oil supply port of the first control module (3*a*), the first drive port of the first control module (3*c*), the second oil supply port of the first control module (3*e*), the third oil supply port of the first control module (3*f*) and the fourth oil supply port of the first control module (3*g*) all connect to the first oil supply module (6); the second drive port of the first control module (3*h*) and the fifth drive port of the first control module (3*k*) both connect to the valve actuation module of one-cylinder; the third drive port of the first control module (3*i*) and the sixth drive port of the first control module (3*m*) both connect to the valve actuation module of two-cylinder; the fourth drive port (3*j*) of the control module and the seventh drive port of the first control module (3*n*) both connect to the valve actuation module of three-cylinder;

the first oil supply port of the second control module (4*a*), the first drain port of the second control module (4*c*), the second oil supply port of the second control module (4*e*), the third oil supply port of the second control module (4*f*) and the fourth oil supply port of the second control module (4*g*) all connect to the second oil supply module (5); the second drive port of the second control module (4*h*) and the fifth drive port of the second control module (4*k*) both connect to the valve actuation module of six-cylinder; the third drive port of the second control module (4*i*) and the sixth drive port of the second control module (4*m*) both connect to the valve actuation module of five-cylinder; the fourth drive port of the second control module (4*j*) and the seventh drive port of the second control module (4*n*) both connect to the valve actuation module of four-cylinder.

5. The system of claim 1, wherein for the continuously variable valve actuation system, the oil delivery module (7) comprises an oil delivery pump (10), a safety valve of the oil delivery pump (11), a first oil delivery check valve (12) and a second oil delivery check valve (13); the oil inlet of the oil delivery pump (10*a*) connects with the oil inlet of the oil delivery module (7*d*), the oil outlet of the safety valve of the oil delivery pump (11*a*) connects with oil delivery port of the oil delivery module (7*b*), and the oil outlet of the first oil delivery check valve (12*b*) connects with the first oil delivery port of the oil delivery module (7*c*);

the oil outlet of the second oil delivery check valve (13*b*) connects with the second oil delivery port of the oil delivery module (7*a*); the oil outlet of the oil delivery pump (10*b*), the safety valve of the oil delivery pump oil inlet (11*b*), the oil inlet of the first oil delivery check valve (12*a*) and the oil inlet of the second oil delivery check valve (13*a*) connect to each other; for the fully variable valve actuation system, the oil delivery module (7) comprises the oil delivery pump (10), the safety valve of oil delivery pump (11), the oil delivery check valve (16) and the system safety valve (17); the oil inlet of oil delivery pump (10*a*) connects with the oil inlet of oil delivery module (7*d*); and the oil outlet of the oil delivery pump (10*b*), the safety valve of the oil delivery pump oil inlet (11*b*) and the oil inlet of the oil delivery check valve (16*a*) connect to each other; the oil outlet of safety valve of the oil delivery pump (11*a*), the oil outlet of system safety valve (17*a*) and the oil delivery port of the oil delivery module (7*b*) connect to each other; the oil outlet of the oil delivery check valve (16*b*), the oil inlet of system safety valve (17*b*), the second oil delivery port of the oil delivery module (7*a*) and the first oil delivery port of the oil delivery module (7*c*) connect to each other.

6. The system of claim 1, wherein for the continuously variable valve actuation system controlled on the oil supply side, the first control module (3) comprises a first two-position two-way valve (14); the oil outlet of the first two-position two-way valve (14*a*) connects with the oil drain port of the first control module (3*b*); the oil inlet of the first two-position two-way valve (14*b*), the first oil supply port of the first control module (3*a*), the first drive port of the first control module (3*c*) and the oil delivery port of the first control module (3*d*) connect to each other;

for the continuously variable valve actuation system controlled on the valve side, the first control module (3) comprises the 1-1 two-position two-way valve (141), the 1-2 two-position two-way valve (142) and the 1-3 two-position two-way valve (143); the first oil supply port of the first control module (3*a*), the first drive port of the first control module (3*c*) and the oil delivery port of the first control module (3*d*) connect to each other; the oil outlet of the 1-1 two-position two-way valve (141*a*), the oil outlet of the 1-2 two-position two-way valve (142*a*), the oil outlet of the 1-3 two-position two-way valve (143*a*) and the oil drain port of the first control module (3*b*) connect to each other; the oil inlet of the 1-1 two-position two-way valve (141*b*) connects with the fifth drive port of the first control module (3*k*), the oil inlet of the 1-2 two-position two-way valve (142*b*) connects with the sixth drive port of the first control module (3*m*), and the oil inlet of the 1-3 two-position two-way valve (143*b*) connects with the seventh drive port of the first control module (3*n*); for the fully variable valve actuation system of the non-independent oil drain valve controlled on the oil supply side, the first control module (3) comprises the first check valve (18) and the first two-position three-way valve (19); the oil inlet of the first check valve (18*a*) connects with the oil drain port of the first control module (3*b*), the oil supply port of the first two-position three-way valve (19*a*) connects with the first oil supply port of the first control module (3*a*), and the oil delivery port of the first two-position three-way valve (19*b*) connects with the oil delivery port of the first control module (3*d*); the valve drive port of the first two-position three-way (19*c*) connects with the first drive port of the first control module (3*c*), and the oil outlet of the first check valve (18*b*) connects with the oil supply port of the first two-position three-way valve (19*a*) or the valve drive port of the first two-position three-way (19*c*);

for the fully variable valve actuation system of the non-independent oil drain valve controlled on the valve side, the first control module (3) comprises the first check valve (18), the 1-1 two-position three-way valve (191), the 1-2 two-position three-way valve (192) and the 1-3 two-position three-way valve (193); the oil inlet of the first check valve (18*a*) connects with the oil drain port of the first control module (3*b*); the oil outlet of the first check valve (18*b*), the first oil supply port of the first control module (3*a*) and the first drive port of the first control module (3*c*) connect to each other; the oil delivery port of the 1-1 two-position three-way valve (191*b*), the oil delivery port of the 1-2 two-position three-way valve (192*b*), the oil delivery port of the 1-3 two-position three-way valve (193*b*) and the oil delivery port of the first control module (3*d*) connect to each other; the oil supply port of the 1-1 two-position three-way valve (191*a*) connects with the second oil supply port of the first control module (3*e*), the oil supply port of the 1-2 two-position three-way valve (192*a*) connects with the third oil supply port of the first control module (3*f*), and the oil supply port of the 1-3 two-position three-way valve (193*a*) connects with the fourth oil supply port of the first control module (3*g*);

the drive port of the 1-1 two-position three-way valve (191*c*) connects with the second drive port of the first control module (3*h*), the drive port of the 1-2 two-position three-way valve (192*c*) connects with the third drive port of the first control module (3*i*), and the drive port of the 1-3 two-position three-way valve (193*c*) connects with the fourth drive port of the first control module (3*j*); for the fully variable valve actuation system of the independent oil drain valve controlled on the oil supply side, the first control module (3) comprises the first check valve (18), the first two-position three-way valve (19), the first oil drain valve (91), the second oil drain valve (92) and the third oil drain valve (93); the oil supply port of the first two-position three-way valve (19*a*) connects with the first oil supply port of the first control module (3*a*), the oil delivery port of the first two-position three-way valve (19*b*) connects with the oil delivery port of the first control module (3*d*) and the valve drive port of the first two-position three-way (19*c*) connects with the first drive port of the first control module (3*c*); the first oil outlet of the oil drain valve (91*a*), the second oil outlet of the oil drain valve (92*a*), the third oil outlet of the oil drain valve (93*a*), the oil inlet of the first check valve (18*a*) and the oil drain port of the first control module (3*b*) connect to each other; the first oil inlet of the oil drain valve (91*b*) connects with the fifth drive port of the first control module (3*k*), the second oil inlet of the oil drain valve (92*b*) connects with the sixth drive port of the first control module (3*m*), and the third oil inlet of the oil drain valve (93*b*) connects with the seventh drive port of the first control module (3*n*); the oil outlet of the first check valve (18*b*) connects with the oil supply port of the first two-position three-way valve (19*a*) or the valve drive port of the first two-position three-way (19*c*);

for the fully variable valve actuation system of the independent oil drain valve controlled on the valve side, the first control module (3) comprises the first check valve (18), the 1-1 two-position three-way valve (191), the 1-2 two-position three-way valve (192), the 1-3 two-position three-way valve (193), the first oil drain valve (91), the second oil drain valve (92) and the third oil drain valve (93); the oil outlet of the first check valve (18*b*), the first oil supply port of the first control module (3*a*) and the first drive port of the first control module (3*c*) connect to each other; the oil delivery port of the 1-1 two-position three-way valve (191*b*), the oil delivery port of the 1-2 two-position three-way valve (192*b*), the oil delivery port of the 1-3 two-position three-way valve (193*b*) and the oil delivery port of the first control module (3*d*) connect to each other; the oil supply port of the 1-1 two-position three-way valve (191*a*) connects with the second oil supply port of the first control module (3*e*), the oil supply port of the 1-2 two-position three-way valve (192*a*) connects with the third oil supply port of the first control module (3*f*), and the oil supply port of the 1-3 two-position three-way valve (193*a*) connects with the fourth oil supply port of the first control module (3*g*); the drive port of the 1-1 two-position three-way valve (191*c*) connects with the second drive port of the first control module (3*h*), the drive port of the 1-2 two-position three-way valve (192*c*) connects with the third drive port of the first control module (3*i*), and the drive port of the 1-3 two-position three-way valve (193*c*) connects with the fourth drive port of the first control module (3*j*); and the first oil outlet of the oil drain valve (91*a*), the second oil outlet of the oil drain valve (92*a*), the third oil outlet of the oil drain valve (93*a*), the oil inlet of the first check valve (18*a*) and the oil drain port of the first control module (3*b*) connect to each other; the first oil inlet of the oil drain valve (91*b*) connects with the fifth drive port of the first control module (3*k*), the 2nd oil inlet of the oil drain valve (92*b*) connects with the sixth drive port of the first control module (3*m*), and the third oil inlet of the oil drain valve (93*b*) connects with the seventh drive port of the first control module (3*n*).

7. The system of claim 1, wherein for the continuously variable valve actuation system controlled on the oil supply side, the second control module (4) comprises a second two-position two-way valve (15); the oil outlet of the second two-position two-way valve (15*a*) connects with the oil drain port of the second control module (4*b*); the oil inlet of the second two-position two-way valve (15*b*), the first oil supply port of the second control module (4*a*), the first drain port of the second control module (4*c*) and the oil delivery port of the second control module (4*d*) connect to each other; for the continuously variable valve actuation system controlled on the valve side, the second control module (4) comprises the 2-1 two-position two-way valve (151), the 2-2 two-position two-way valve (152) and the 2-3 two-position two-way valve (153); the first oil supply port of the second control module (4*a*), the first drain port of the second control module (4*c*) and the oil delivery port of the second control module (4*d*) connect to each other; the oil outlet of the 2-1 two-position two-way valve (151*a*), the oil outlet of the 2-2 two-position two-way valve (152*a*), the oil outlet of the 2-3 two-position two-way valve (153*a*) and the oil drain port of the second control module (4*b*) connect to each other; the oil inlet of the 2-1 two-position two-way valve (151*b*) connects with the fifth drive port of the second control module (4*k*), the oil inlet of the 2-2 two-position two-way valve (152*b*) connects with the sixth drive port of the second control module (4*m*), and the oil inlet of the 2-3 two-position two-way valve (153*b*) connects with the seventh drive port of the second control module (4*n*);

for the fully variable valve actuation system of the non-independent oil drain valve controlled on the oil supply side, the second control module (4) comprises the second check valve (20) and the a second two-position three-way valve (21); the oil inlet of the second check valve (20*a*) connects with the oil drain port of the second control module (4*b*), the oil supply port of the second two-position three-way valve (21*a*) connects with the first oil supply port of the second control module (4*a*), and the oil delivery port of the second two-position three-way valve (21*b*) connects with the oil delivery port of the second control module (4*d*); the drive port of the second two-position three-way valve (21*c*) connects with the first drain port of the second control module (4*c*), and the oil outlet of the second check valve (20*b*) connects with the oil supply port of the second two-position three-way valve (21*a*) or the drive port of the second two-position three-way valve (21*c*);

for the fully variable valve actuation system of the non-independent oil drain valve controlled on the valve side, the second control module (4) comprises the second check valve (20), the 2-1 two-position three-way valve (211), the 2-2 two-position three-way valve (212) and the 2-3 two-position three-way valve (213); the oil inlet of the second check valve (20*a*) connects with the oil drain port of the second control module (4*b*); the oil outlet of the second check valve (20*b*), the first oil supply port of the second control module (4*a*) and the first drain port of the second control module (4*c*) connect to each other; the oil delivery port of the 2-1 two-position three-way valve (211*b*), the oil delivery port of the 2-2 two-position three-way valve (212*b*), the oil delivery port of the 2-3 two-position three-way valve (213*b*) and the oil delivery port of the second control module (4*d*) connect to each other; the oil supply port of the 2-1 two-position three-way valve (211*a*) connects with the second oil supply port of the second control module (4*e*), the oil supply port of the 2-2 two-position three-way valve (212*a*) connects with the third oil supply port of the second control module (4*f*), and the oil supply port of the 2-3 two-position three-way valve (213*a*) connects with the fourth oil supply port of the second control module (4*g*); the drive port of the 2-1 two-position three-way valve (211*c*) connects with the second drive port of the second control module (4*h*), the drive port of the 2-2 two-position three-way valve (212*c*) connects with the third drive port of the second control module (4*i*), and the drive port of the 2-3 two-position three-way valve (213*c*) connects with the fourth drive port of the second control module (4*j*); for the fully variable valve actuation system of the independent oil drain valve controlled on the oil supply side, the second control module (4) comprises the second check valve (20), the a second two-position three-way valve (21), the fourth oil drain valve (94), the fifth oil drain valve (95) and the sixth oil drain valve (96); the oil supply port of the second two-position three-way valve (21*a*) connects with the first oil supply port of the second control module (4*a*), the oil delivery port of the second two-position three-way valve (21*b*) connects with the oil delivery port of the second control module (4*d*), and the drive port of the second two-position three-way valve (21*c*) connects with the first drain port of the second control module (4*c*);

the fourth oil outlet of the oil drain valve (94*a*), the fifth oil outlet of the oil drain valve (95*a*), the sixth oil outlet of the oil drain valve (96*a*), the oil inlet of the second check valve (20*a*) and the oil drain port of the second control module (4*b*) connect to each other; the fourth oil inlet of the oil drain valve (94*b*) connects with the fifth drive port of the second control module (4*k*), the fifth oil inlet of the oil drain valve (95*b*) connects with the sixth drive port of the second control module (4*m*), and the sixth oil inlet of the oil drain valve (96*b*) connects with the seventh drive port of the second control module (4*n*); the oil outlet of the second check valve (20*b*) connects with the oil supply port of the second two-position three-way valve (21*a*) or the drive port of the second two-position three-way valve (21*c*); for the fully variable valve actuation system of the independent oil drain valve controlled on the valve side, the second control module (4) comprises the second check valve (20), the 2-1 two-position three-way valve (211), the 2-2 two-position three-way valve (212), the 2-3 two-position three-way valve (213), the fourth oil drain valve (94), the fifth oil drain valve (95) and the sixth oil drain valve (96); the oil outlet of the second check valve (20*b*), the first oil supply port of the second control module (4*a*) and the first drain port of the second control module (4*c*) connect to each other; the oil delivery port of the 2-1 two-position three-way valve (211*b*), the oil delivery port of the 2-2 two-position three-way valve (212*b*), the oil delivery port of the 2-3 two-position three-way valve (213*b*) and the oil delivery port of the second control module (4*d*) connect to each other; the oil supply port of the 2-1 two-position three-way valve (211*a*) connects with the second oil supply port of the second control module (4*e*), the oil supply port of the 2-2 two-position three-way valve (212*a*) connects with the third oil supply port of the second control module (4*f*), and the oil supply port of the 2-3 two-position three-way valve (213*a*) connects with the fourth oil supply port of the second control module (4*g*); and the drive port of the 2-1 two-position three-way valve (211*c*) connects with the second drive port of the second control module (4*h*), the drive port of the 2-2 two-position three-way valve (212*c*) connects with the third drive port of the second control module (4*i*), and the drive port of the 2-3 two-position three-way valve (213*c*) connects with the fourth drive port of the second control module (4*j*); the fourth oil outlet of the oil drain valve (94*a*), the fifth oil outlet of the oil drain valve (95*a*), the sixth oil outlet of the oil drain valve (96*a*), the oil inlet of the second check valve (20*a*) and the oil drain port of the second control module (4*b*) connect to each other; the fourth oil inlet of the oil drain valve (94*b*) connects with the fifth drive port of the second control module (4*k*), the fifth oil inlet of the oil drain valve (95*b*) connects with the sixth drive port of the second control module (4*m*), and the sixth oil inlet of the oil drain valve (96*b*) connects with the seventh drive port of the second control module (4*n*).

8. The system of claim 1, wherein the phase limit module (2) comprises a three-layer nested structure, from the exterior to the interior, comprising a phase limit module housing (2*k*) with an oil opening, a phase limit module sleeve (2*m*) notched and tapped axially and a phase limit module axle spindle (2*n*) notched radially;

the phase limit module spindle (2*n*) is actuated by the crankshaft of the internal combustion engine through the gear or chain wheel transmission mechanism, the crank angle rotates a cycle every 720°, and the phase limit module sleeve (2*m*) is nested and fixed inside the phase limit module housing (2*k*) and rotates constantly with the phase limit module spindle (2*n*) according to the ignition sequence of the internal combustion engine;

for the continuously variable valve actuation system, with the constant rotation of the phase limit module spindle (2*n*), the first drive port 2*e* of the phase limit module, the third drive port (2*g*) of the phase limit module and the fifth drive port (2*i*) of the phase limit module connect to the first oil supply port 2*b* or the second oil drain port 2*d* of the phase limit module respectively and alternately; the second drive port of the phase limit module (2*f*), the fourth drive port of the phase limit module (2*h*) and the sixth drive port of the phase limit module (2*j*) connect to the second oil supply port of the phase limit module (2*a*) or the second oil drain port of the phase limit module (2*d*) respectively and alternately; and for the fully variable valve actuation system, the first oil drain port of the phase limit module (2*e*), the third drive port of the phase limit module (2*g*) and the fifth drive port of the phase limit module (2*i*) connect to the first oil supply port of the phase limit module (2*b*), the first oil drain port of the phase limit module (2*c*) or the second oil drain port of the phase limit module (2*d*) respectively and alternatively; the second drive port of the phase limit module (2*f*), the fourth drive port of the phase limit module (2*h*) and the sixth drive port of the phase limit module (2*j*) connect to the second oil supply port of the phase limit module (2*a*), the first oil drain port of the phase limit module (2*c*) or the second oil drain port of the phase limit module (2*d*) respectively and alternately.

9. The system of claim 1, wherein the mode selection module (22) adopts a dual-layer nested structure and comprises a mode selection module housing (22*n*) with an oil opening and a notched mode selection module spindle (22*q*); actuated by the electromagnetic, hydraulic, mechanical or pneumatic mechanism, the mode selection module spindle (22*q*) rotates or moves axially in the mode selection module housing (22*n*) and has two positions;

under the drive mode, the mode selection module spindle (22*q*) is not actuated; at the same time, the oil control inlet of the mode selection module (22*r*) connects with the oil control outlet of the mode selection module (22*s*), the first oil supply port of the mode selection module (22*a*) connects with the first drive port of the mode selection module (22*g*), and the second oil supply port of the mode selection module (22*b*) connects with the second drive port of the mode selection module (22*h*); the third oil supply port of the mode selection module (22*c*) connects with the third drive port of the mode selection module (22*i*), the fourth oil supply port of the mode selection module (22*d*) connects with the fourth drive port of the mode selection module (22*j*), the fifth oil supply port of the mode selection module (22*e*) connects with the fifth drive port of the mode selection module (22*k*), and the sixth oil supply port of the mode selection module (22*f*) connects with the sixth drive port of the mode selection module (22*m*);

under the brake mode, the drive mode selection module spindle (22*q*) rotates over a certain angle or moves to a certain distance axially and the oil control inlet of the mode selection module (22*r*) disconnects with the oil control outlet of the mode selection module (22*s*); when the drain-for-drain &drain-for-supply brake mode is adopted, the first oil supply port of the mode selection module (22*a*), the second oil supply port of the mode selection module (22*b*), the first drive port of the mode selection module (22*g*) and the second drive port of the mode selection module (22*h*) connect to each other; the third oil supply port of the mode selection module (22*c*), the fourth oil supply port of the mode selection module (22*d*), the third drive port of the mode selection module (22*i*) and the fourth drive port of the mode selection module (22*j*) connect to each other; and the fifth oil supply port of the mode selection module (22*e*), the sixth oil supply port of the mode selection module (22*f*), the fifth drive port of the mode selection module (22*k*) and the sixth drive port of the mode selection module (22*m*) connect to each other; when the supply-for-supply & brake-for-brake mode is adopted, the first oil supply port of the mode selection module (22*a*), the second oil supply port of the mode selection module (22*b*), the fifth drive port of the mode selection module (22*k*) and the sixth drive port of the mode selection module (22*m*) connect to each other; the third oil supply port of the mode selection module (22*c*), the fourth oil supply port of the mode selection module (22*d*), the first drive port of the mode selection module (22*g*) and the second drive port of the mode selection module (22*h*) connect to each other; the fifth oil supply port of the mode selection module (22*e*), the sixth oil supply port of the mode selection module (22*f*), the third drive port of the mode selection module (22*i*) and the fourth drive port of the mode selection module (22*j*) connect to each other.

10. The system of claim 1, wherein for the valve actuation system with the drain-for-drain &drain-for-supply brake mode, the mode conversion (22) comprises a switch valve assembly structure, the switch valve assembly (27) adopts a dual-layer nested structure and comprises a switch valve assembly housing (27*n*) with an oil opening and a notched switch valve assembly spindle (27*q*); actuated by the electromagnetic, hydraulic, mechanical or pneumatic mechanism, the switch valve assembly spindle (27*q*) rotates or moves axially in the switch valve assembly housing (27*n*) and has two positions;

the switch valve assembly (27) comprises a first oil port of the switch valve assembly (27*a*), a second oil port of the switch valve assembly (27*b*), a third oil port of the switch valve assembly (27*c*), a fourth oil port of the switch valve assembly (27*d*), a fifth oil port of the switch valve assembly (27*e*), a sixth oil port of the switch valve assembly (27*f*), a seventh oil port of the switch valve assembly (27*g*) and an eighth oil port of the switch valve assembly (27*h*); the first oil supply port of the mode selection module (22*a*), the first drive port of the mode selection module (22*g*) and the first oil port of the switch valve assembly (27*a*) connect to each other; the second oil supply port of the mode selection module (22*b*), the second drive port of the mode selection module (22*h*) and the fifth oil port of the switch valve assembly (27*e*) connect to each other; the third oil supply port of the mode selection module (22*c*), the third drive port of the mode selection module (22*i*) and the second oil port of the switch valve assembly (27*b*) connect to each other; the fourth oil supply port of the mode selection module (22*d*), the fourth drive port of the mode selection module (22*j*) and the sixth oil port of the switch valve assembly (27*f*) connect to each other; the fifth oil supply port of the mode selection module (22*e*), the fifth drive port of the mode selection module (22*k*) and the third oil port of the switch valve assembly (27*c*) connect to each other; the sixth oil supply port of the mode selection module (22*f*), the sixth drive port of the mode selection module (22*m*) and the seventh oil port of the switch valve assembly (27*g*) connect to each other; the oil control inlet of the mode selection module (22*r*) connects with the fourth oil port of the switch valve assembly (27*d*) and the oil control outlet of the mode selection module (22*s*) connects with the eighth oil port of the switch valve assembly (27*h*);

under the drive mode, the switch valve assembly spindle (27*q*) is not actuated; at that time, the first oil port of the switch valve assembly (27*a*) disconnects with the fifth oil port of the switch valve assembly (27*e*), the second oil port of the switch valve assembly (27*b*) disconnects with the sixth oil port of the switch valve assembly (27*f*), and the third oil port of the switch valve assembly (27*c*) disconnects with the seventh oil port of the switch valve assembly (27*g*), but the fourth oil port of the switch valve assembly (27*d*) connects with the eighth oil port of the switch valve assembly (27*h*);

under the brake mode, the switch valve assembly spindle (27*q*) rotates over a certain angle or moves to a certain distance axially, the first oil port of the switch valve assembly (27*a*) connects with the fifth oil port of the switch valve assembly (27*e*), the second oil port of the switch valve assembly (27*b*) connects with the sixth oil port of the switch valve assembly (27*f*), and the third oil port of the switch valve assembly (27*c*) connects with the seventh oil port of the switch valve assembly (27*g*), but the fourth oil port of the switch valve assembly (27*d*) disconnects with the eighth oil port of the switch valve assembly (27*h*); the switch valve assembly (27) comprises the independent switch valve structure and comprises the first switch valve (23), the 2nd switch valve (24), the third switch valve (25) and the fourth switch valve (26); the fifth oil port of the switch valve assembly (27*e*) connects with the first oil port of the first switch valve (23*a*), the first oil port of the switch valve assembly (27*a*) connects with the second oil port of the first switch valve (23*b*), and the sixth oil port of the switch valve assembly (27*f*) connects with the first oil port of the second switch valve (24*a*); the second oil port of the switch valve assembly (27*b*) connects with the second oil port of the second switch valve (24*b*), the seventh oil port of the switch valve assembly (27*g*) connects with the first oil port of the third switch valve (25*a*), and the third oil port of the switch valve assembly (27*c*) connects with the second oil port of the third switch valve (25*b*); the eighth oil port of the switch valve assembly (27*h*) connects with the first oil port of the fourth switch valve (26*a*), and the fourth oil port of the switch valve assembly (27*d*) connects with the second oil port of the fourth switch valve (26*b*);

under the drive mode, the first oil port of the fourth switch valve (26*a*) connects with the second oil port of the fourth switch valve (26*b*), but the first oil port of the first switch valve (23*a*) disconnects with the second oil port of the first switch valve (23*b*), the first oil port of the second switch valve (24*a*) disconnects with the second oil port of the second switch valve (24*b*), and the first oil port of the third switch valve (25*a*) disconnects with the second oil port of the third switch valve (25*b*); and under the brake mode, the first oil port of the fourth switch valve (26*a*) disconnects with the second oil port of the fourth switch valve (26*b*), the first oil port of the first switch valve (23*a*) disconnects with the second oil port of the first switch valve (23*b*), but the first oil port of the second switch valve (24*a*) connects with the second oil port of the second switch valve (24*b*), and the first oil port of the third switch valve (25*a*) connects with the second oil port of the third switch valve (25*b*).

* * * * *